US008439482B1

(12) United States Patent
Kodama et al.

(10) Patent No.: US 8,439,482 B1
(45) **Date of Patent: *May 14, 2013**

(54) CARTRIDGE AND PRINTING MATERIAL SUPPLY SYSTEM

(75) Inventors: Hidetoshi Kodama, Matsumoto (JP); Izumi Nozawa, Matsumoto (JP); Tadahiro Mizutani, Shiojiri (JP); Kazutoshi Matsuzaki, Shiojiri (JP); Kazumasa Harada, Matsumoto (JP); Satoshi Nakata, Matsumoto (JP); Hidetaka Kawata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/410,528

(22) Filed: Mar. 2, 2012

(30) Foreign Application Priority Data

Jan. 12, 2012 (JP) ..... 2012-3652
Jan. 12, 2012 (JP) ..... 2012-3653
Jan. 12, 2012 (JP) ..... 2012-3694
Jan. 12, 2012 (JP) ..... 2012-3698

(51) Int. Cl.
*B41J 2/175* (2006.01)

(52) U.S. Cl.
USPC ..... 347/49

(58) Field of Classification Search ..... 347/49, 347/50, 84, 85, 86, 87
See application file for complete search history.

(56) References Cited

U.S. PATENT DOCUMENTS 4,907,018 A * 3/1990 Pinkerpell et al. ..... 346/139 R
6,276,780 B1 8/2001 Carrese et al.
6,488,369 B1 12/2002 Steinmetz et al.
6,502,917 B1 1/2003 Shinada et al.
6,955,422 B2 10/2005 Miyazawa et al.
6,979,079 B2 12/2005 Hashii et al.
7,213,914 B2 5/2007 Anma et al.
7,237,881 B2 7/2007 Hayasaki et al.
7,244,018 B2 * 7/2007 Hashii et al. ..... 347/86
7,278,721 B2 10/2007 Shimizu et al.
7,562,958 B2 7/2009 Asauchi
2002/0135634 A1 9/2002 Lodal et al.
2007/0279464 A1 12/2007 Harazim
2009/0096850 A1 4/2009 Sulser et al.
2012/0056955 A1 3/2012 Kodama et al.
2012/0056956 A1 * 3/2012 Kodama et al. ..... 347/86

FOREIGN PATENT DOCUMENTS

DE 102006036716 B3 9/2007
EP 1547783 A2 6/2005
JP 2002-019142 A 1/2002
JP 2003-011390 A 1/2003

(Continued)

OTHER PUBLICATIONS

U.S. Appl. No. 13/410,461, filed Mar. 2012, Kodama et al.*

(Continued)

*Primary Examiner* — Anh T. N. Vo
(74) *Attorney, Agent, or Firm* — Stroock & Stroock & Lavan LLP

(57) ABSTRACT

A cartridge comprises an ink supply structure, a terminal bearing structure, and a first restriction portion. The terminal bearing structure has terminals arranged in a terminal plane which is neither parallel nor perpendicular to a plane defined by a mounting direction leading edge of the ink supply structure, so that the contact portions of the terminals receive a force in a direction opposite from the mounting direction. An engagement portion of the first restriction portion is provided at a position adjacent to the terminal bearing structure.

30 Claims, 50 Drawing Sheets

FOREIGN PATENT DOCUMENTS

| | | | |
|---|---|---|---|
| JP | 2005-022345 | A | 1/2005 |
| JP | 2005-144723 | A | 6/2005 |
| JP | 2007-230249 | A | 9/2007 |

OTHER PUBLICATIONS

U.S. Appl. No. 13/410,478, filed Mar. 2012, Kodama et al.*
International Search Report and the Written Opinion of the International Searching Authority issued on Dec. 14, 2012 in International Application No. PCT/JP2012/001395, filed on Mar. 1, 2012.
International Search Report and the Written Opinion of the International Searching Authority issued on Dec. 17, 2012 in International Application No. PCT/JP2012/001397, filed on Mar. 1, 2012.
International Search Report and the Written Opinion of the International Searching Authority issued on Dec. 17, 2012 in International Application No. PCT/JP2012/001409, filed on Mar. 1, 2012.
International Search Report and the Written Opinion of the International Searching Authority issued on Dec. 17, 2012 in International Application No. PCT/JP2012/001410, filed on Mar. 1, 2012.

* cited by examiner

F4-F4 CROSS SECTION

VIEW OF ARROW F9

VIEW OF ARROW F10

F16–F16 CROSS SECTION

CARTRIDGE AND PRINTING MATERIAL SUPPLY SYSTEM

CROSS REFERENCE TO RELATED APPLICATIONS

This application claims priority to Japanese Patent Application Nos. 2012-3652, 2012-3653, 2012-3694 and 2012-3698 each of which were filed on Jan. 12, 2012, the entire contents of each of which is incorporated by reference herein.

BACKGROUND OF THE INVENTION

1. Technical Field

The present invention relates to a cartridge, a combination of a cartridge and a printing device (or portion thereof) and/or a printing material supply system including the cartridge and a printing device.

2. Related Art

Various mechanisms have been proposed for attachment and detachment of a cartridge to a printing device. Examples of such mechanisms are disclosed in U.S. Publication No. 2005/0151811 (which corresponds to JP-A-2007-230249), U.S. Pat. No. 7,008,053 (which corresponds to JP-A-2005-022345), U.S. Pat. No. 6,276,780 (which corresponds to JP-A-2002-019142), U.S. Pat. No. 6,955,422, U.S. Pat. No. 6,074,042, and U.S. Pat. No. 7,018,030.

U.S. Publication No. 2005/0151811 discloses a cartridge with a latching lever 3 and electric contact terminal pads 102. Lever 3 includes an anchoring portion 6 for engaging with the printer. The anchoring portion 6 is disposed far away from the contact pads 102. Because anchoring portion 6 is far away from the cartridge terminals, the engagement with the printer can offer only limited contribution to the accuracy and stability of positioning of the cartridge terminals with respect to the respective printer terminals.

In addition, lever 3 in U.S. Publication No. 2005/0151811 needs to be long enough to reach a location accessible by the user so the user can operate it. It also projects far away from the side wall of the cartridge. Such a large lever results in a larger cartridge, which can also result in a large-size printer, in which the cartridge is attached to and detached from, as well as bulky packaging for transportation and distribution of the cartridges, which in turn increases transportation and parts costs.

Also, the cartridge structure that connects the anchoring portion 6 to the cartridge-side terminals includes a flexible section of the lever 3. Even though the anchoring portion 6 might be securely engaged with the printer, vibration generated during printing operations can be transmitted through the flexible section of the lever 3 to the cartridge terminals, and so can influence the positioning of the cartridge terminals with respect to the printer terminals. This is particularly a concern for on-carriage type ink cartridges, such as those disclosed of U.S. Publication No. 2005/0151811, because they are mounted on a printer's carriage, to which the print head is attached. In on-carriage printers, the carriage is scanned back and forth over the print medium during printing operations. The ink cartridges in the carriage undergo great acceleration force with each change in scan direction, in addition to other vibration generated during printing operations.

The lever in U.S. Publication No. 2005/0151811 is formed integrally with the cartridge and is elastically deformable. With this configuration, the material used to produce the cartridge is limited to a material with sufficient moldability for making this configuration, and also with sufficient flexibility and durability that is needed for the lever to elastically deform during engagement and disengagement with the printer.

The lever might plastically deform under operations by the user. Such plastic deformation of the lever may cause positional misalignment between cartridge-side terminals and printer terminals, which could result in poor electrical communication. Plastic deformation also reduces the durability of the lever. Also, special measures, such as those disclosed in U.S. Pat. No. 7,018,030, must be taken during packaging of the cartridge to prevent creep deformation of the lever while the cartridge is packaged, especially when the cartridge is packaged in a vacuum package.

U.S. Pat. No. 6,276,780 discloses a cartridge without any memory or electrical terminals. Because this type of cartridge requires no electrical connection with the printer, there is no need to include structure or configuration for maintaining stable positioning and alignment of cartridge terminals to printer terminals.

In addition, the cartridge is attached to the printer by a latch mechanism 132 (in FIGS. 9-16 of U.S. Pat. No. 6,276,780) that is disposed on the printer. Cartridge-side latch ramps 220 that engage the latch mechanism 132 are far away from the pivot axis of the latch mechanism 132, in the direction in which the cartridge is removed from the printer. As a result, when a resilient member 156 or compression force seal 152 applies to the cartridge a force (indicated by arrow X in FIG. 12 U.S. Pat. No. 6,276,780) in the direction in which to the cartridge is removed from the printer, this force can be easily converted into a force that releases engagement of the retainer portion 134 from the cartridge latch ramps 220, so that the cartridge might become separated from the printer during use of the printer. Because the engagement configuration disclosed in U.S. Pat. No. 6,276,780 includes this inherent risk of the cartridge becoming separated from the printer, it is not suitable for use with the configurations disclosed in U.S. Publication No. 2005/0151811, which require proper contact between the cartridge terminals and printer terminals. Moreover, contact between the cartridge and printer terminals in the configurations in U.S. Publication No. 2005/0151811 applies force from the terminals of the printer in lateral direction to the cartridge, so that the cartridge might move in the in lateral direction. The latch mechanism 132 of U.S. Pat. No. 6,276,780 is not suitable for the cartridge of U.S. Publication No. 2005/0151811 at least for the reason that it might not be able to match the lateral direction movement of the cartridge, so that the latch mechanism 132 becomes detached from the cartridge.

U.S. Pat. No. 6,074,042 discloses an ink cartridge with electrical contacts 54. As shown in FIGS. 12A to 13B thereof, the electrical contacts 54 are at the leading edge of the direction in which the cartridge is mounted into the printer. With this configuration, when the cartridge is mounted into the printer, the electrical contacts 54 of the cartridge press flat against spring biased electrical contacts 104 of the printer. Metal oxidation, oil, or other non-conductive matter at the outer surface of the metal electrical contacts 54 can become sandwiched between the conductive metal of the cartridge and printer electrical contacts, possibly hindering electrical communication between the cartridge and the printer.

U.S. Pat. No. 6,955,422 discloses, for example in FIGS. 2a to 2d thereof, a cartridge 1 that has a memory device 7 with electrodes 7a. The electrodes 7a are aligned substantially parallel to the direction of cartridge insertion into the printer. With this configuration, the printer electrodes 106 slide across the surface of the circuit board (on which the electrodes 7a are formed) for a long distance. The surface of the circuit board is typically covered with an electrically insulating resin material. When the printer electrodes 106 scrape against the circuit board, they can damage this insulation so that fragments of the insulation flake away from the circuit board. The insulation fragments can get caught between the printer electrodes 106 and the cartridge electrodes 7a, and become a cause of poor or otherwise unreliable electrical communication between the printer and the cartridge.

As shown in FIGS. 5 to 6B of U.S. Pat. No. 6,955,422, the printer is provided with a leaf spring 103 that exerts an urging force that presses the surface of memory device 7 against the printer electrodes 106 when the cartridge is mounted in the printer, and that moves the cartridge 1 upward when the cartridge is pulled out of the printer.

U.S. Pat. No. 7,008,053 discloses in FIG. 5 an elastic piece 40 provided on the printer. When the cartridge is fully mounted in the printer, the lower end 40a of the elastic piece 40 abuts against a flat surface 12a at the upper portion of the projecting portion 12 on which the electrodes 14 are located. The abutment between the lower end 40b and the flat surface 12a restricts upward movement of the projecting portion 12. However, the configuration of U.S. Pat. No. 7,008,053 includes no means located near the projecting portion 12 for restricting downward movement of the projecting portion 12. As a result, projecting portion 12 is fairly free to vibrate vertically during operation of the printer and therefore the electrodes can become misaligned or disconnected from the printer terminals.

In the presence of various mechanisms for attachment and detachment, there is a need to reduce the total size of a printer for better usability and ease of installation. For reducing the size of the printer, it is typically necessary to reduce the sizes of a large number of components forming the printer and relevant elements. These components and relevant elements include a cartridge attached to the printer and a cartridge mounting structure for attachment of the cartridge.

For improved use of the printer, information regarding the printing material contained in the cartridge (for example, information regarding the remaining amount of the printing material) is often displayed on the monitor of the printer. The cartridge attached to this printer would have a circuit board with a memory for storing the information regarding the printing material. The circuit board has terminals (cartridge-side terminals) used to send and receive information to and from the printer. The information regarding the printing material is transmitted between the memory and a controller of the printer through the contact of these cartridge-side terminals and terminals on the printer (device-side terminals). It is accordingly necessary to maintain stable electrical connection between the cartridge-side terminals and the device-side terminals.

As will be described below, there is no known mechanism to meet these requirements in a fully acceptable manner.

This problem is not limited to a cartridge containing ink for printing but is also commonly found in any of printing devices and/or cartridges configured to supply or eject various other printing materials (for example, toner) as well as ink.

Consequently, there is a need to ensure stable electrical connection between cartridge-side terminals and device-side terminals. There is also a need to attain size reduction of a cartridge, a printer and a printing material supply system including the cartridge attached to the printer.

SUMMARY

In order to more suitably achieve at least part of the foregoing, the present invention provides various aspects and embodiments described below.

First Aspect:

A cartridge detachably attached to a printing device, the printing device comprising a cartridge mounting structure configured to have: (i) a device-side bottom wall member; (ii) a first device-side side wall member, which can be at a front thereof, provided to intersect the device-side bottom wall member; and (iii) a second device-side side wall member, which can be at a rear thereof, provided to intersect the device-side bottom wall member and to be opposed to the first device-side side wall member. The device can include a printing material supply structure, which can be in the form of a tube, structured to have a base end provided on the device-side bottom wall member and a peripheral end to be connected with the cartridge and configured to supply a printing material contained in the cartridge to a head. The cartridge preferable includes a plurality of device-side electrical contact terminals which can be provided in a device-side corner section where the device-side bottom wall member intersects the first (front) device-side side wall member. The cartridge can also include a lever provided on the first (front) device-side side wall member in a rotatable manner to be used for attachment and detachment of the cartridge to and from the printing device. The lever can be oriented such that a Z axis represents an axis parallel to a central axis C of the printing material supply structure/tube, an X axis represents an axis, along which the printing material supply tube and the device-side terminals are arrayed and which is orthogonal to the Z axis, and a Y axis represents an axis orthogonal to both the Z axis and the X axis. A +Z-axis direction represents a direction along the Z axis from the base end to the peripheral end of the printing material supply tube, which can be an upwards direction. A −Z-axis direction represents a reverse direction to the +Z-axis direction. A +X-axis direction represents a direction along the X axis from the printing material supply tube towards the device-side terminals, which can be a frontwards direction. A −X-axis direction represents a reverse direction to the +X-axis direction. A +Y-axis direction represents a direction along the Y axis going to one end, which can be a sideways direction, and −Y-axis direction represents a direction along the Y axis going to the other end. The cartridge can be constructed so that the device-side terminals are in contact with the cartridge to apply a force, which can be a resilient or elastic force, to the cartridge in a specified direction including a +Z-axis direction component in an attached state of the cartridge to the cartridge mounting structure. The lever can have an operating member at the +Z-axis direction end (which can be the top end) and a first device-side restriction element at the −Z-axis direction end (which can be the bottom end) to lock the cartridge and thereby restrict motion of the cartridge in the +Z-axis direction. The lever can be constructed to rotate about a specified position between the operating member and the first device-side restriction element as an axis of rotation, wherein the X axis, the Y axis and the Z axis with respect to the cartridge in the attached state respectively correspond to an X axis, a Y axis and a Z axis of the cartridge. The cartridge can comprise a first face located on the −Z-axis direction side and a second face located on the +Z-axis direction side, as two faces opposed to each other in the Z-axis direction; a third face located on the +X-axis direction side and a fourth face located on the −X-axis direction side, as two faces opposed to each other in the X-axis direction and intersecting the first face and the second face; a corner section arranged to connect the first face with the third face; a sloped surface provided to form part of the corner section and inclined in a specific direction including the +X-axis direction component and the −Z-axis direction component. An ink supply structure can be provided on the first face to be connected with the printing material supply tube. A plurality of cartridge-side terminals can be provided corresponding to the respective device-side terminals and located on the sloped surface to receive a force in a specified direction including the +Z-axis direction component from the device-side terminals. Due to the slope at the area of contact, the force can also have a −X-axis direction component. The cartridge can also include a first cartridge-side restriction element configured to be locked by the first device-side restriction element and thereby restrict motion of the cartridge in the +Z-axis direction.

The above configuration can be provided with either or both of two features in the following two embodiments. In one embodiment the added feature is that the first cartridge-side restriction element is provided at a specific position on the third face close to an intersecting part, where the third face intersects the sloped surface, and is located on the −Z-axis direction side of the axis of rotation of the lever. In another embodiment, the cartridge-side terminals comprise a first terminal including a first outer part located at the most +Y-axis direction end; and a second terminal including a second outer part located at the most −Y-axis direction end, wherein the first cartridge-side restriction element is located not outside but inside a range between the first outer part and the second outer part in the Y-axis direction.

The cartridge according to a first aspect of the invention has the first cartridge-side restriction element that engages with the lever of the printing device. Because the lever is not made integral with the cartridge, the material for producing the cartridge can be different from the material used for producing the lever. Also, the material of the cartridge can be selected with less concern for flexibility and durability requirements, and greater focus on other properties such as resistance to ink. Thus, different plastics, thermoplastics and resins can be used to make the different components.

Also, because the lever is not on the cartridge, no special care is needed to prevent creep deformation of the lever in packaging of the cartridge for transportation and distribution. This simplifies packaging requirements and improves the user's convenience.

Because the lever is not an integral part of the cartridge, the cartridge can be made smaller. This further allows size reduction of the packaging material, such as paper or box, used to package the cartridge for transportation or distribution of the cartridge, thus advantageously reducing the transportation cost and the parts cost.

Because the lever is not integral with the cartridge, the first cartridge-side restriction element can be made with a small size and simple structure, and with higher rigidity compared with the structures described in U.S. Publication No. 2005/0151811. This results in significantly reducing the possibility of plastic deformation of the first cartridge-side restriction element. In the attached state, the cartridge can be kept at the proper position in the cartridge mounting structure, which maintains normal or good contact between the cartridge-side terminals and the device-side terminals and reduces the possibility of poor continuity. In the cartridge of the first aspect, since the first cartridge-side restriction element can have a small size and simple structure, no special care to prevent creep deformation of the lever is required in packaging for transportation and distribution of the cartridge, unlike the cartridges of U.S. Publication No. 2005/0151811. This improves the user's experience and convenience of use.

In the cartridge according to the first aspect, the first cartridge-side restriction element is provided on the −Z-axis direction side of the axis of rotation of the lever. Even when the force is applied in the direction including the +Z-axis direction component from the device-side terminals to move the cartridge in the +Z-axis direction, the lever serves to restrict the motion of the cartridge in the +Z-axis direction. This reduces the possibility of the first cartridge-side restriction element becoming unlocked or disengaged from the first device-side restriction element, thus ensuring stable electrical connection between the cartridge-side terminals and the device-side terminals and reducing the possibility of poor continuity. The first device-side restriction element can move about the axis of rotation of the lever with the movement of the cartridge in the −X-axis direction when force in the −X-axis direction is applied from the device-side terminals to the mounted cartridge. This reduces the possibility that the first cartridge-side restriction element is uncoupled from the first device-side restriction element.

In the cartridge according to the first aspect, the first cartridge-side restriction element is provided at the specific position on the third face close to the intersecting part. The cartridge can thus be fixed to the cartridge mounting structure at a position near to the contact between the cartridge-side terminals and the device-side terminals. This reduces the possibility of positional misalignment of the cartridge-side terminals relative to the device-side terminals and reduces the poor continuity between the cartridge-side terminals and the device-side terminals. In the event the cartridge falls, the first cartridge-side restriction element prevents the cartridge-side terminals from being directly hit against, for example, the floor surface and thereby helps protect the cartridge-side terminals from being damaged. Especially when the cartridge-side terminals are mounted on the circuit board with a memory unit, this protects the vulnerable memory unit from being damaged and enhances the effect of shock resistance. Providing the first cartridge-side restriction element at the position close to the intersecting part enables the lever of the cartridge mounting structure to be located at the position closer to the first face. This enables size reduction of the cartridge and the printing device in the Z-axis direction.

Second Aspect:

The cartridge according to the first aspect, wherein the first cartridge-side restriction element is provided at a specific position close to an intersecting part, where the third face intersects the sloped surface.

In the cartridge according to the second aspect, the first cartridge-side restriction element is provided at the specific position close to the intersecting part. The cartridge can thus be fixed to the cartridge mounting structure at the position near to the contact between the cartridge-side terminals and the device-side terminals. The first cartridge-side restriction element prevents the positional misalignment of the cartridge-side terminals relative to the device-side terminals. Thus the first cartridge-side restriction element reduces the possibility of poor continuity between the cartridge-side terminals and the device-side terminals. In the event the cartridge falls, the first cartridge-side restriction element reduces the possibility of cartridge-side terminals from being directly hit against, for example, the floor surface and thereby helps protect the cartridge-side terminals from being damaged. Especially when the cartridge-side terminals are mounted on the circuit board with a memory unit, this protects the vulnerable memory unit from being damaged and enhances the effect of shock resistance. When the first cartridge-side restriction element formed as a projection, the effects of shock resistance are further enhanced. Providing the first cartridge-side restriction element at the position close to the intersecting part enables the lever of the cartridge mounting structure to be located at the position closer to the first face. This enables size reduction of the cartridge and the printing device in the Z-axis direction.

Third Aspect:

The cartridge according to either one of the first aspect and/or second aspect, wherein the first cartridge-side restriction element is provided at a position intersecting a plane (plane Yc), which passes through center of a width or the Y-axis direction length of the cartridge and is parallel to the Z axis and the X axis.

When the cartridge is in a mounted condition in the printer, the cartridge receives a force from the printer-side terminal group in a direction that includes a +Z axis direction component, and the first cartridge-side restriction portion is pressed against the first printer-side restriction portion of the lever by this force. By providing the first cartridge-side restriction portion at a location intersected by the plane Yc, the portion of the first cartridge-side restriction portion in the vicinity of the position intersected by the plane Yc would hardly move at all, even if the cartridge were to move about the X axis or Z axis by application of an external force. It should be noted that the first cartridge-side restriction portion is arranged at a position that is near the intersection portion, the edge of the circuit board, or both. By providing the first cartridge-side restriction portion, which hardly moves, at a location extremely near to cartridge-side terminal group, electrical connection between the cartridge-side terminal group and the printer-side terminal group can be stable.

Fourth Aspect:

The fourth aspect is the embodiment described above where the cartridge-side terminals comprise a first terminal including a first outer part located at the most +Y-axis direction end; and a second terminal including a second outer part located at the most −Y-axis direction end, wherein at least part of the first cartridge-side restriction element is located between the first outer part and the second outer part in the Y-axis direction and as mentioned above can be implemented independent from or together with the above described embodiments of the first aspect addressed above.

In the cartridge according to the fourth aspect, at least part of the first cartridge-side restriction element is located between the first outer part and the second outer part. This locates the first cartridge-side restriction element of little motion at the position very close to the cartridge-side terminals, thus ensuring the stable electrical connection between the cartridge-side terminals and the contact mechanism.

Fifth Aspect:

The cartridge according to the fourth aspect, wherein the first cartridge-side restriction element is located not outside but inside of a range between the first outer part and the second outer part in the Y-axis direction.

Some of the printer-side terminals might protrude out farther than the others. In the example shown in FIG. 31, the terminal 731 protrudes out further. When the cartridge is mounted within the printer, the cartridge-side terminal group will receive from the printer-side terminal group a force with a +Z axis direction component. If the cartridge is held too securely, then contact with some of the printer-side terminals (terminal 734 in FIG. 31's example), might not be proper. By positioning the first cartridge-side restriction portion to completely the inside of the terminals in the widthwise direction, the cartridge can tilt sufficiently to adjust the direction in which the slanted surface faces, so that electrical connection between the cartridge-side terminal group and the printer-side terminal group can be even more stable. These benefits are also relevant to the configurations of the embodiments addressed above.

Sixth Aspect:

The cartridge according to any one of the first aspect to the fifth aspect, further comprising a second cartridge-side restriction element configured to be locked by a second device-side restriction element provided on the second device-side side wall member and thereby restrict motion of the cartridge in the +Z-axis direction, and the second cartridge-side restriction element is provided on the fourth face.

The cartridge according to the sixth aspect has the second cartridge-side restriction element on the fourth face to restrict the motion of the cartridge in the +Z-axis direction, so as to restrict the motion of the cartridge in the +Z-axis direction from both the +X-axis direction end and the −X-axis direction end. This further prevents the positional misalignment of the respective cartridge-side terminals relative to the cartridge mounting structure and further ensures the stable electrical connection between the cartridge-side terminals and the device-side terminals.

Seventh Aspect:

The cartridge according to the sixth aspect, wherein the second cartridge-side restriction element is a projection to be inserted in the second device-side restriction element formed as a recess or a through hole.

In the cartridge according to the seventh aspect, inserting the second cartridge-side restriction element into the second device-side restriction element provides the pivot point of rotation to turn the cartridge about the vicinity of the second cartridge-side restriction element. This facilitates attachment and detachment of the cartridge to and from the cartridge mounting structure.

Eighth Aspect:

The cartridge according to any one of the first aspect to the seventh aspect, wherein the first cartridge-side restriction element is located on the −X-axis direction side of the axis of rotation of the lever.

In the cartridge according to the eighth aspect, in the attached state, the first cartridge-side restriction element generates rotational moment on the lever to turn the lever about the axis of rotation of the lever in the reverse direction to the unlocking direction. This reduces the possibility that the first cartridge-side restriction element is unlocked from the first device-side restriction element and further ensures the stable electrical connection between the cartridge-side terminals and the device-side terminals. Even when the cartridge receives the force in the −X-axis direction from the device-side terminals to move in the −X-axis direction, the first device-side restriction element moves in the −X-axis direction with the movement of the cartridge. Such moving reduces the possibility that the first cartridge-side restriction element becomes unlocked from the first device-side restriction element.

Ninth Aspect:

The cartridge according to the eighth aspect, wherein the first cartridge-side restriction element has a first abutting part that abuts a first portion of the first device-side restriction element to restrict motion of the cartridge in the +Z-axis direction, and a second abutting part that abuts a second portion of the first device-side restriction element to restrict motion of the cartridge in the +X-axis direction.

In the cartridge according to the ninth aspect, the first cartridge-side restriction element has the first abutting part and the second abutting part and thus ensures generation of the rotational moment on the lever to turn the lever about the axis of rotation of the lever in the reverse direction to the unlocking direction. This further reduces the possibility that the first cartridge-side restriction element is unlocked from the first device-side restriction element and more effectively prevents the poor continuity between the cartridge-side terminals and the device-side terminals.

Tenth Aspect:

The cartridge according to any one of the first aspect to the ninth aspect, further comprising a projection configured to abut the operating member of the lever and receive a force including the +Z-axis direction component during detachment of the cartridge attached to the cartridge mounting structure from the cartridge mounting structure, and the projection is provided on the +Z-axis direction side of the first cartridge-side restriction element on the third face.

The cartridge according to the tenth aspect further has the projection. The cartridge can be readily removed from the cartridge mounting structure by using the operating member of the lever and the projection.

Eleventh Aspect:

The cartridge according to any one of the first aspect to the tenth aspect, wherein the corner section has a step extended from the first face in the +Z-axis direction, the step is located on the −X-axis direction side and the −Z-axis direction side of the sloped surface, and the step has a third cartridge-side restriction element that is in contact with a third device-side restriction element provided on the cartridge mounting structure, so as to restrict motion of the cartridge in the Y-axis direction.

In the cartridge according to the eleventh aspect, the third cartridge-side restriction element to restrict the motion of the cartridge in the Y-axis direction is provided in the corner section with the cartridge-side terminals. This restricts the motion of the third face-side of the cartridge in the Y-axis direction in the attached state of the cartridge.

Twelfth Aspect:

The cartridge according to the eleventh aspect, wherein the third cartridge-side restriction element comprises a pair of projection members configured to receive the third device-side restriction element protruded from the device-side bottom wall member in the +Z-axis direction, and the pair of projection members are protruded from the step in the +X-axis direction.

In the cartridge according to the twelfth aspect, the simple structure of providing the pair of projection members protruded in the +X-axis direction from the step effectively restricts the motion of the third face-side of the cartridge in the Y-axis direction in the attached state of the cartridge.

Thirteenth Aspect:

The cartridge according to either one of the eleventh aspect and the twelfth aspect, wherein part of the third cartridge-side restriction element overlaps the sloped surface, when the cartridge is viewed from the first face side in the +Z-axis direction.

In the cartridge according to the thirteenth aspect, the third cartridge-side restriction element and the sloped surface are located to partly overlap with each other. This further restricts the motion of the third face-side of the cartridge in the Y-axis direction about the printing material supply tube.

Fourteenth Aspect:

The cartridge according to any one of the first aspect to the thirteenth aspect, wherein the ink supply structure is provided at a specific position on the first face closer to the fourth face than the third face.

The cartridge according to the fourteenth aspect has the ink supply structure located closer to the fourth face than the third face. This structure lowers the possibility of adhesion of the printing material on the cartridge-side terminals, compared with the structure where the ink supply structure is located closer to the third face than the fourth face. This reduces the poor continuity between the cartridge-side terminals and the device-side terminals.

Fifteenth Aspect:

The cartridge according to any one of the first aspect to the fourteenth aspect, wherein the first cartridge-side restriction element is a projection.

The cartridge according to the fifteenth aspect provides the first cartridge-side restriction element as a projection which can be of a small size and simple structure.

Sixteenth Aspect:

The cartridge according to any one of the first aspect to the fifteenth aspect, wherein the cartridge-side terminals include a cartridge-side ground terminal that is in contact with a device-side ground terminal of the device-side terminals, which is connected with a ground line, and the cartridge-side ground terminal is provided on center of the width or the Y-axis direction length of the cartridge and is configured to be in contact with the device-side ground terminal before any other cartridge-side terminal is in contact with a corresponding device-side terminal in the course of attachment of the cartridge to the cartridge mounting structure.

In the cartridge according to the sixteenth aspect, the force first applied from the cartridge mounting structure to the cartridge-side terminals is generated on the substantial center of the width or the Y-axis direction length of the cartridge. This prevents the force applied to the cartridge-side terminals from acting to tilt the cartridge in the Y-axis direction, thus ensuring stable electrical connection between the cartridge-side terminals and the device-side terminals. The cartridge-side ground terminals are in contact with the corresponding device-side ground terminals, prior to the contact of the other cartridge-side terminals with the corresponding device-side terminals. The grounding function of the cartridge-side ground terminal advantageously prevents or reduces the high voltage-induced troubles and failures, even when an unexpected high voltage is applied to the cartridge.

Seventeenth Aspect:

The cartridge according to the sixteenth aspect, wherein a Z-axis direction length of the cartridge-side ground terminal is longer than the Z-axis direction length of the other cartridge-side terminal.

The cartridge according to the seventeenth aspect ensures the contact between the cartridge-side ground terminal and the device-side ground terminal.

Eighteenth Aspect:

A cartridge detachably attached to a printing device, the printing device comprising a cartridge mounting structure configured to allow attachment and detachment of the cartridge; a printing material supply tube structured to have a base end provided on a bottom of the cartridge mounting structure and a peripheral end to be connected with the cartridge and configured to supply a printing material contained in the cartridge to a head; a plurality of device-side terminals provided to be in contact with the cartridge; and a lever provided to be used for attachment and detachment of the cartridge, wherein a Z axis represents an axis parallel to a central axis C of the printing material supply tube, an X axis represents an axis, along which the printing material supply tube and the device-side terminals are arrayed and which is orthogonal to the Z axis, and a Y axis represents an axis orthogonal to both the Z axis and the X axis, wherein a +Z-axis direction represents a direction along the Z axis going from the base end to the peripheral end of the printing material supply tube, a −Z-axis direction represents a reverse direction to the +Z-axis direction, a +X-axis direction represents a direction along the X axis going from the printing material supply tube to the device-side terminals, a −X-axis direction represents a reverse direction to the +X-axis direction, a +Y-axis direction represents a direction along the Y axis going to one end, and −Y-axis direction represents a direction along the Y axis going to the other end, wherein the device-side terminals are in contact with the cartridge to apply a force to the cartridge in a specified direction including the +Z-axis direction component in an attached state of the cartridge to the cartridge mounting structure, and the lever has an operating member at the +Z-axis direction end and a first device-side restriction element at the −Z-axis direction end to lock the cartridge and thereby restrict motion of the cartridge in the +Z-axis direction, the lever rotating about a specified position between the operating member and the first device-side restriction element as an axis of rotation, wherein the X axis, the Y axis and the Z axis with respect to the cartridge in the attached state respectively correspond to an X axis, a Y axis and a Z axis of the cartridge. The cartridge comprises an ink supply structure located at the −Z-axis direction end of the cartridge to be connected with the printing material supply tube; a circuit board located on the +X-axis direction side of the ink supply structure and has a surface inclined in a specified direction including the +X-axis direction component and the −Z-axis direction component; a plurality of cartridge-side terminals provided corresponding to the respective device-side terminals and located on the surface of the circuit board to receive a force in a specified direction including the +Z-axis direction component from the device-side terminals; and a first cartridge-side restriction element configured to be locked by the first device-side restriction element and thereby restrict motion of the cartridge in the +Z-axis direction and located on the +X-axis direction side of the printing material supply port, The above configuration can be provided with either or both of the features in the following two embodiments. In one embodiment the added feature is that the first cartridge-side restriction element is provided at a specific position close to a board end and is located on the −Z-axis direction side of the axis of rotation of the lever, the board end being located on the +Z-axis direction side of the surface of the circuit board. In another embodiment, the cartridge-side terminals comprise a first terminal including a first outer part located at the most +Y-axis direction end; and a second terminal including a second outer part located at the most −Y-axis direction end, wherein the first cartridge-side restriction element is located not outside but inside a range between the first outer part and the second outer part in the Y-axis direction.

The cartridge according to the eighteenth aspect has the first cartridge-side restriction element locked by the lever of the printing device. The first cartridge-side restriction element is located on the −Z-axis direction side of the axis of rotation of the lever. This structure does not require any engagement member between the axis of rotation and the operating member of the lever like the cartridge according to the first aspect described above and has the similar advantageous effects to those of the cartridge according to the first aspect. For example, the cartridge according to the eighteenth aspect shortens the distance between the lever and the cartridge, thus allowing size reduction in the X-axis direction of the printing device and the whole printing material supply system including the cartridge and the printing device.

In the cartridge according to the eighteenth aspect, the first cartridge-side restriction element is provided on the −Z-axis direction side of the axis of rotation of the lever. This enables restriction of the motion of the cartridge in the +Z-axis direction by the lever like the cartridge according to the first aspect and has the similar advantageous effects to those of the cartridge according to the first aspect. For example, this ensures a more stable electrical connection between the cartridge-side terminals and the device-side terminals and reduces the poor continuity.

According to the embodiment where the cartridge-side terminals comprise a first terminal including a first outer part located at the most +Y-axis direction end; and a second terminal including a second outer part located at the most −Y-axis direction end, wherein the first cartridge-side restriction element is located not outside but inside a range between the first outer part and the second outer part in the Y-axis direction, the first cartridge-side restriction element is located not outside but inside the range between the first outer part and the second outer part. This enables fine adjustment of the direction of the sloped surface with the cartridge-side terminals provided thereon, like the cartridge according to the first embodiment. Even when the position of each of the device-side terminals or the slope of the first cartridge-side restriction element varies due to the manufacturing error, such fine adjustment of the direction of the sloped surface ensures the stable electrical connection between the cartridge-side terminals and the device-side terminals.

According to the embodiment where the first cartridge-side restriction element is provided at a specific position close to a board end and is located on the −Z-axis direction side of the axis of rotation of the lever, the board end being located on the +Z-axis direction side of the surface of the circuit board, the first cartridge-side restriction element is provided at the position close to the board end located on the +Z-axis direction side. In other words, the first cartridge-side restriction element is arranged as close as possible to the cartridge-side terminals. Since the first cartridge-side restriction element is locked by the lever, the periphery of the first cartridge-side restriction element has substantially no position shift by application of an external force to the cartridge. Providing the cartridge-side terminals at the location of extremely small position shift effectively prevents the positional misalignment of the respective cartridge-side terminals relative to the cartridge mounting structure, thus maintaining the stable electrical connection between the cartridge-side terminals and the device-side terminals.

Nineteenth Aspect:

A printing material supply system, comprising a printing device; and the cartridge according to any one of the first aspect to the eighteenth aspect, the printing device comprising a cartridge mounting structure configured to have: (i) a device-side bottom wall member; (ii) a first device-side side wall member provided to intersect the device-side bottom wall member; and (iii) a second device-side side wall member provided to intersect the device-side bottom wall member and to be opposed to the first device-side side wall member; a printing material supply tube structured to have a base end provided on the device-side bottom wall member and a peripheral end to be connected with the cartridge and configured to supply a printing material contained in the cartridge to a head; a plurality of device-side terminals provided in a device-side corner section where the device-side bottom wall member intersects the first device-side side wall member; and a lever provided on the first device-side side wall member in a rotatable manner to be used for attachment and detachment of the cartridge to and from the printing device, wherein a Z axis represents an axis parallel to a central axis C of the printing material supply tube, an X axis represents an axis, along which the printing material supply tube and the device-side terminals are arrayed and which is orthogonal to the Z axis, and a Y axis represents an axis orthogonal to both the Z axis and the X axis, wherein a +Z-axis direction represents a direction along the Z axis going from the base end to the peripheral end of the printing material supply tube, a −Z-axis direction represents a reverse direction to the +Z-axis direction, a +X-axis direction represents a direction along the X axis going from the printing material supply tube to the device-side terminals, a −X-axis direction represents a reverse direction to the +X-axis direction, a +Y-axis direction represents a direction along the Y axis going to one end, and −Y-axis direction represents a direction along the Y axis going to the other end, wherein the device-side terminals are in contact with the cartridge to apply a force to the cartridge in a specified direction including the +Z-axis direction component in an attached state of the cartridge to the cartridge mounting structure, and the lever has an operating member at the +Z-axis direction end and a first device-side restriction element at the −Z-axis direction end to lock the cartridge and thereby restrict motion of the cartridge in the +Z-axis direction, the lever rotating about a specified position between the operating member and the first device-side restriction element as an axis of rotation.

The printing material supply system according to the nineteenth aspect includes the cartridge in accordance with any one of the first aspect to the eighteenth aspect, so as to allow size reduction of the printing material supply system in both the X-axis direction and the Z-axis direction and reduce the possibility that the first device-side restriction element is unlocked from the first cartridge-side restriction element. This ensures the stable electrical connection between the cartridge-side terminals and the device-side terminals and reduces the poor continuity.

As can be appreciated by one of ordinary skill in the art, the embodiments of the present invention are directed to an ink cartridge, and/or combinations of an ink cartridge with a printing apparatus, or a portion of a printing apparatus where the ink cartridge is installed on the apparatus, and/or systems for supplying ink to a printing apparatus where the system includes the printing apparatus (or portions thereof) and/or where the system does not include the printing apparatus.

In one embodiment an ink supply system for supplying ink to an ink jet printing apparatus is disclosed where the ink jet printing apparatus includes a plurality of apparatus-side contact forming members. The ink supply system preferably includes an ink chamber for storing ink and an ink supply structure, adapted and configured to supply ink from the ink chamber to the ink jet printing apparatus. The ink supply structure has a mounting direction leading edge defining a plane. The ink supply system preferably includes an electrical device. The ink supply system can also include a terminal bearing structure having a plurality of electrically conductive terminals, the terminals adapted and arranged on the terminal bearing structure to make contact with and receive elastic force from the contact forming members at contact portions of said terminals when the ink supply system supplies ink to the printing apparatus. The ink supply system can also include a first restriction portion including an engagement portion adapted to engage with the engagement portion of a lever on the printing apparatus so as to restrict movement of the terminal bearing structure and terminals thereon in a direction opposite the mounting direction. The engagement portion of the first restriction portion is preferably positioned adjacent the terminal bearing structure. The terminals can be arranged substantially in a terminal plane which is neither parallel nor perpendicular to the plane defined by the leading edge when the ink supply system supplies ink to the printing apparatus. Alternatively, the terminal bearing structure determines the plane and/or the plane is defined by the terminals in contact with the respective structure on the printing apparatus.

In one embodiment of the system, the terminal plane is at an angle of between about 20 and 50 degrees, preferably from about 25 and 40 degrees to the plane defined by the leading edge when the ink supply system supplies ink to the printing apparatus.

In one embodiment of the system, when the ink supply system is in place to supply ink to the printing apparatus, the engagement portion of the first restriction portion is located to the left of a right edge of a rightmost terminal of the plurality of terminals and to the right of a left edge of a leftmost terminal of the plurality of terminals.

In one embodiment of the system, the terminals are adapted and arranged on the terminal bearing structure to make contact with and receive elastic force from the contact forming members at contact portions of the terminals. The contact portions are arranged substantially in a contact portion plane. When the ink supply system is in place to supply ink to the printing apparatus, the engagement portion of the first restriction portion can be located to the left of the rightmost contact portion of the plurality of terminals and to the right of the leftmost contact portion of the plurality of terminals. The contact portions can define a plane at an angle over 0 degrees and less than 90 degrees so the plane defined by the leading edge. This plane defined by the contact portions is preferably to the plane defined by the leading edge when the ink supply system supplies ink to the printing apparatus.

In one embodiment, the ink supply system also includes a body that includes a front or first surface, and a rear or second surface, the front or first surface and rear or second surface opposite each other. The ink supply system can also include a restriction portion proximate to the rear or second surface of the body, referred to as the second restriction portion, the terminal bearing structure proximate to the front or first surface of the body. The second restriction portion can include an engagement portion adapted and configured to engage with a respective portion of the ink jet printing apparatus. The distance between the engagement portion of the second restriction portion and the plane defined by the leading edge is more than the distance between the engagement portion of the first restriction portion and the plane defined by the leading edge, when the distances are measured in an orthogonal direction to the plane defined by the leading edge.

In one embodiment, the second restriction portion can be proximate to the rear or second surface of the body, the terminal bearing structure proximate to the first surface or front of the body, the second restriction portion including an engagement portion adapted and configured to engage with a respective portion of the ink jet printing apparatus, wherein the distance between the engagement portion of the second restriction portion and the plane defined by the leading edge is more than the distance between the engagement portion of the first restriction portion and the plane defined by the leading edge, when the distances are measured in an orthogonal direction to the plane defined by the leading edge.

In one embodiment, the distance between the engagement portion of the first restriction portion and the plane defined by the leading edge is less than the distance between a pivot point of the lever and the plane defined by the leading edge when the ink supply system supplies ink to the printing apparatus, when the distances are measured in an orthogonal direction to the plane defined by the leading edge.

In one embodiment, when the ink supply system supplies ink to the printing apparatus, the engagement portion of the first restriction portion is on the right and the ink supply structure is facing down, the engagement portion of the first restriction portion is to the left of a pivot point of the lever.

In one embodiment the ink supply system includes a body proximate the terminal bearing structure and when the ink supply system supplies ink to the printing apparatus, at least a portion of the engagement portion of the first restriction portion is located substantially at the widthwise center of the body.

In one embodiment, the ink supply system can include an adapter where the ink supply structure, the terminal bearing structure and the first restriction portion are positioned on the adapter and the ink chamber is adapted and configured to be mated with the adapter. In another embodiment, the system can include an adapter where the terminal bearing structure and the first restriction portion are positioned on the adapter, the ink supply structure is positioned on the ink chamber and the ink chamber is adapted and configured to be mated with the adapter. Alternatively, the system can include an adapter, an ink tank external from the ink jet printing apparatus, a tube and an auxiliary adapter where the ink supply structure is positioned on the auxiliary adapter, the terminal bearing structure and the first restriction portion are positioned on the adapter and the tube supplies ink from the external tank to the auxiliary adapter when the ink supply system supplies ink to the printing apparatus.

In one embodiment, the ink supply system includes a body that includes a top and a bottom, the top and bottom being opposite each other, where the plane defined by the leading edge is substantially flush with the bottom.

The present invention is not limited to the cartridge, the combination of the ink cartridge with the printing apparatus or the printing material supply system described herein but may be implemented by diversity of other aspects, for example, a liquid cartridge, a liquid container, a printing material container, a cartridge adapter, a circuit board, a printing device, a liquid ejection device, and a liquid supply system including a liquid ejection device and a liquid cartridge. The invention is not limited to the above aspects, but a multiplicity of variations and modifications may be made to these aspects without departing from the scope of the invention. When addressing a combination of an ink cartridge with a printing apparatus and/or an ink jet printing apparatus it should be understood that the ink cartridge is installed attached or mounted on the printing apparatus.

BRIEF DESCRIPTION OF DRAWINGS

The foregoing summary, as well as the following description of embodiments, will be better understood when read in conjunction with the appended drawings wherein like reference numerals refer to like components. For the purposes of illustrating the device of the present application, there is shown in the drawings certain embodiments. It should be understood, however, that the application is not limited to the precise arrangement, structures, features, embodiments, aspects, and devices shown, and the arrangements, structures, features, embodiments, aspects and devices shown may be used singularly or in combination with other arrangements, structures, features, embodiments, aspects and devices.

The drawings are not necessarily drawn to scale and are not in any way intended to limit the scope of this invention, but merely to clarify a single illustrated embodiment of the invention. In the drawings.

DESCRIPTION OF PREFERRED EMBODIMENTS

In order to further clarify the configurations and the operations of the invention, some embodiments of the invention are described below with reference to the accompanied drawings.

A. First Embodiment

A-1. General Configuration of Printing Material Supply System

Figure 1:
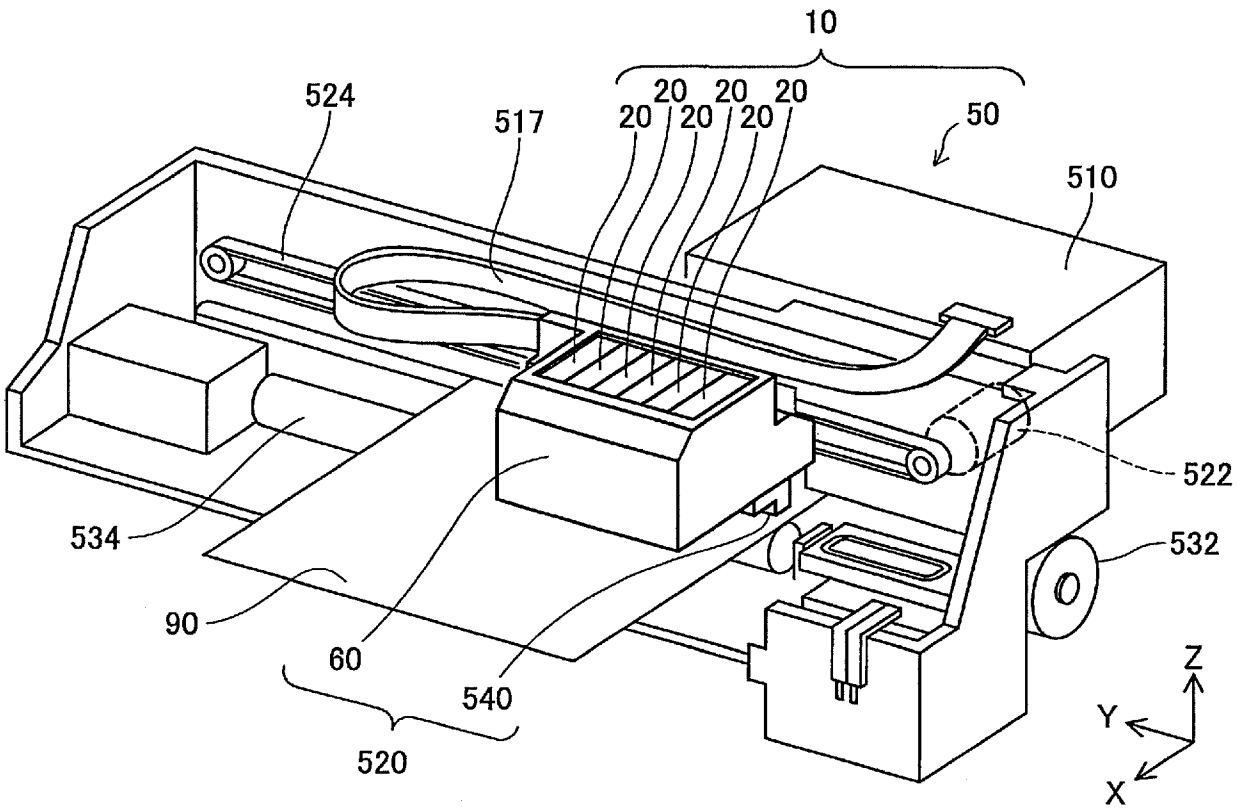
FIG. 1 is a perspective view illustrating the configuration of a printing material supply system.

FIG. 1 is a perspective view illustrating the configuration of a printing material supply system 10. XYZ axes orthogonal to one another are shown in FIG. 1. The XYZ axes in FIG. 1 correspond to the XYZ axes in the other drawings. In the subsequent drawings, the XYZ axes are shown when needed. The printing material supply system 10 includes cartridges 20 and a printer 50 serving as a printing device. In the printing material supply system 10, the cartridges 20 are removably attached to a holder 60 of the printer 50 by the user.

Each of the cartridges 20 in the printing material supply system 10 contains ink as a printing material. The ink as the printing material contained in the cartridge 20 is supplied through a ink supply structure and a printing material supply tube (described later) to a head 540. According to this embodiment, a plurality of the cartridges 20 are removably attached to the holder 60 of the printer 50. More specifically, six cartridges 20 respectively containing six different color inks (i.e., black, yellow, magenta, light magenta, cyan and light cyan) are attached to the holder 60. It will be appreciated by one of ordinary skill in the art that, although the description herein references ink, any substance that can be used for printing is envisaged to be usable as described in more detail below in connection with the disclosed cartridge, combination and/or supply system and the invention should not be limited thereby.

According to other embodiments, the number of cartridges attached to the holder 60 is not limited to six but may be greater than six or less than six. According to other embodiments, the number of different color inks is not limited to six colors but may be greater than six colors or less than six colors. According to other embodiments, two or more cartridges 20 attached to the holder 60 may contain one identical color ink. The detailed structures of the cartridge 20 and the holder 60 will be described later.

The printer 50 of the printing material supply system 10 shown in FIG. 1 is a compact inkjet printer for personal use. The printer 50 has a controller 510 and a carriage 520 including the holder 60, in addition to the holder 60. The carriage 520 also includes the head 540. The printer 50 supplies ink from the cartridge 20 attached to the holder 60 through the printing material supply tube (described later) to the head 540 and ejects ink from the head 540 onto a printing medium 90, such as printing sheet or label, so as to print various data, such as character strings, figures and images, on the printing medium 90. Although described in terms of an ink jet printer, one of ordinary skill in the art will appreciate the applicability of the invention to other printer types and printing material supply systems as described in more detail below and the invention should not be limited thereby.

The controller 510 of the printer 50 serves to control the operations of the respective parts of the printer 50. The carriage 520 of the printer 50 is configured to scan the head 540 reciprocally across the printing medium 90. The head 540 of the printer 50 has an ink ejection mechanism configured to eject ink from the cartridge 20 attached to the holder 60 onto the printing medium 90. The controller 510 and the carriage 520 are electrically connected via a flexible cable 517. The ink ejection mechanism of the head 540 is operated by control signals from the controller 510.

According to this embodiment, the carriage 520 has the head 540 and the holder 60. This type of the printer 50 having the cartridges 20 attached to the holder 60 on the carriage 520 serving to move the head 540 is called "on-carriage type" printer. According to another embodiment, a stationary holder 60 may be provided at a different position from the carriage 520, and ink may be supplied from each of the cartridges 20 attached to the stationary holder 60 to the head 540 of the carriage 520 through a flexible tube. This type of the printer is called "off-carriage type" printer.

According to this embodiment, the printer 50 has a main scan feed mechanism and a sub-scan feed mechanism to move the carriage 520 and the printing medium 90 relative to each other and implement printing on the printing medium 90. The main scan feed mechanism of the printer 50 includes a carriage motor 522 and a drive belt 524 and serves to transfer the power of the carriage motor 520 to the carriage 520 by means of the drive belt 520, so as to move the carriage 520 back and forth in a main scanning direction. The sub-scan feed mechanism of the printer 50 includes a feed motor 532 and a platen 534 and serves to transfer the power of the feed motor 532 to the platen 534, so as to feed the printing medium 90 in a sub-scanning direction orthogonal to the main scanning direction. The carriage motor 522 of the main scan feed mechanism and the feed motor 532 of the sub-scan feed mechanism are operated by control signals from the controller 510.

According to this embodiment, when the printing material supply system 10 is in the orientation typical for use, the X axis represents the axis along the sub-scanning direction (front-rear direction), in which the printing medium 90 is fed. The Y axis represents the axis along the main scanning direction (left-right or side-to-side direction when the system 10 is viewed from the front), in which the carriage 520 is moved back and forth. The Z axis represents the axis in the direction of gravity (vertical direction). The use state of the printing material supply system 10 means the state of the printing material supply system 10 placed on a horizontal plane. In this embodiment, the horizontal plane is a plane parallel to the X axis and the Y axis, i.e., XY plane.

According to this embodiment, the +X-axis direction represents the sub-scanning direction (forward direction), the −X-axis direction represents its reverse direction (backward direction) the +Z-axis direction represents the direction going from the bottom to the top of the printing material supply system 10 in the direction opposite to the direction of gravity (upward direction), and the −Z-axis direction represents the reverse to the +Z axis direction, that is, the direction of gravity (downward direction). In this embodiment, the +X-axis direction side (front side) is the front face of the printing material supply system 10. According to this embodiment, the +Y-axis direction represents the direction going from the right side face to the left side face of the printing material supply system 10 (leftward direction), and the −Y-axis direction represents its reverse direction (rightward direction). In this embodiment, the plurality of cartridges 20 attached to the holder 60 are arrayed in the direction along the Y axis (left-right or side-to-side direction) called the "Y-axis direction". Similarly the direction along the X axis (front-rear direction) and the direction along the Z axis (vertical direction) are called the "X-axis direction" and the "Z-axis direction".

A-2. Structure for Attachment of Cartridge 20 to Holder 60

Figure 2:
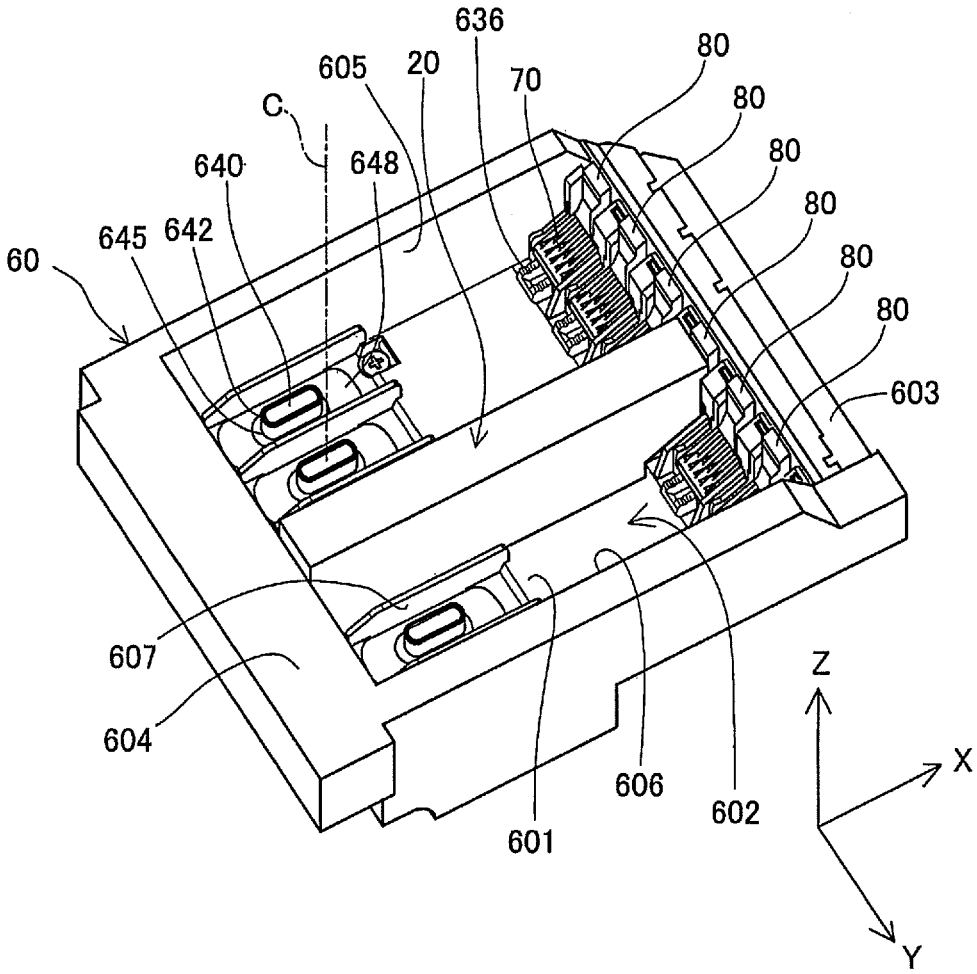
FIG. 2 is a perspective view illustrating a holder with a cartridge attached thereto.
Figure 3:
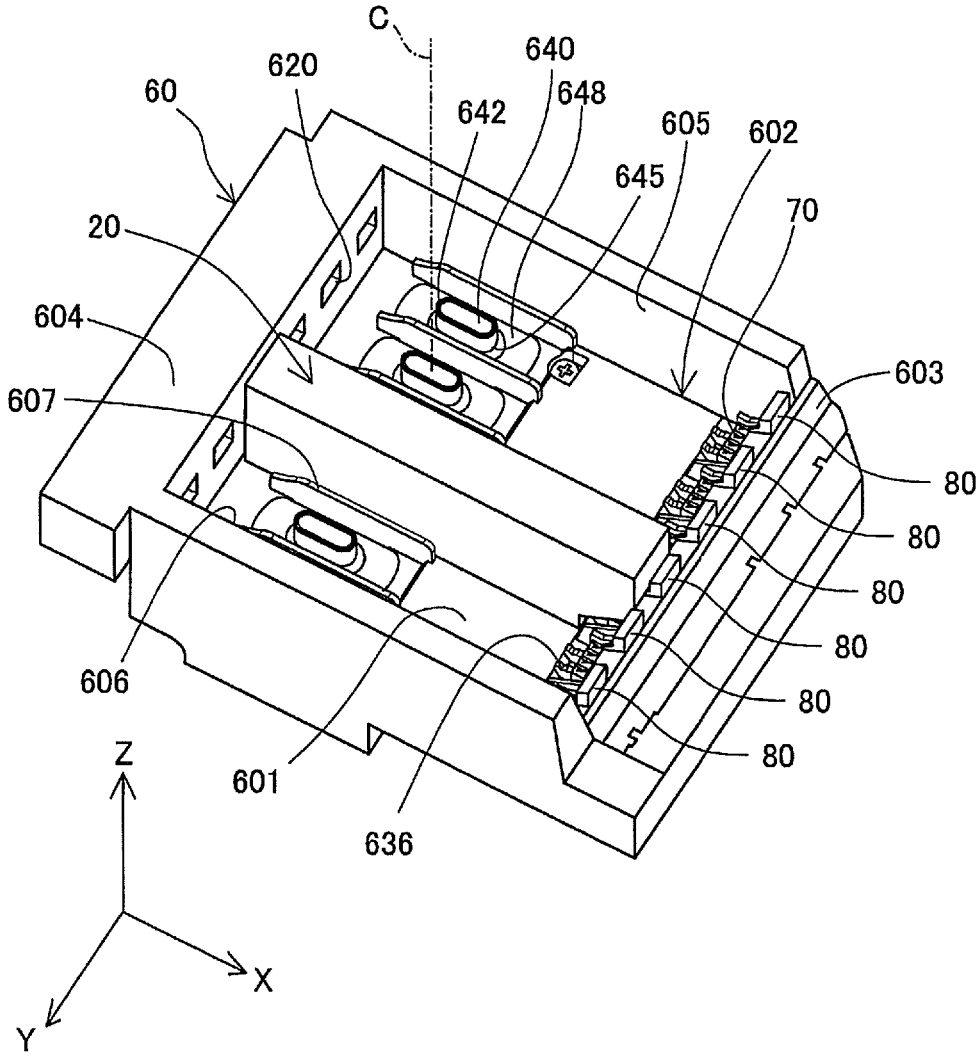
FIG. 3 is a perspective view illustrating a holder with a cartridge attached thereto.
Figure 4:
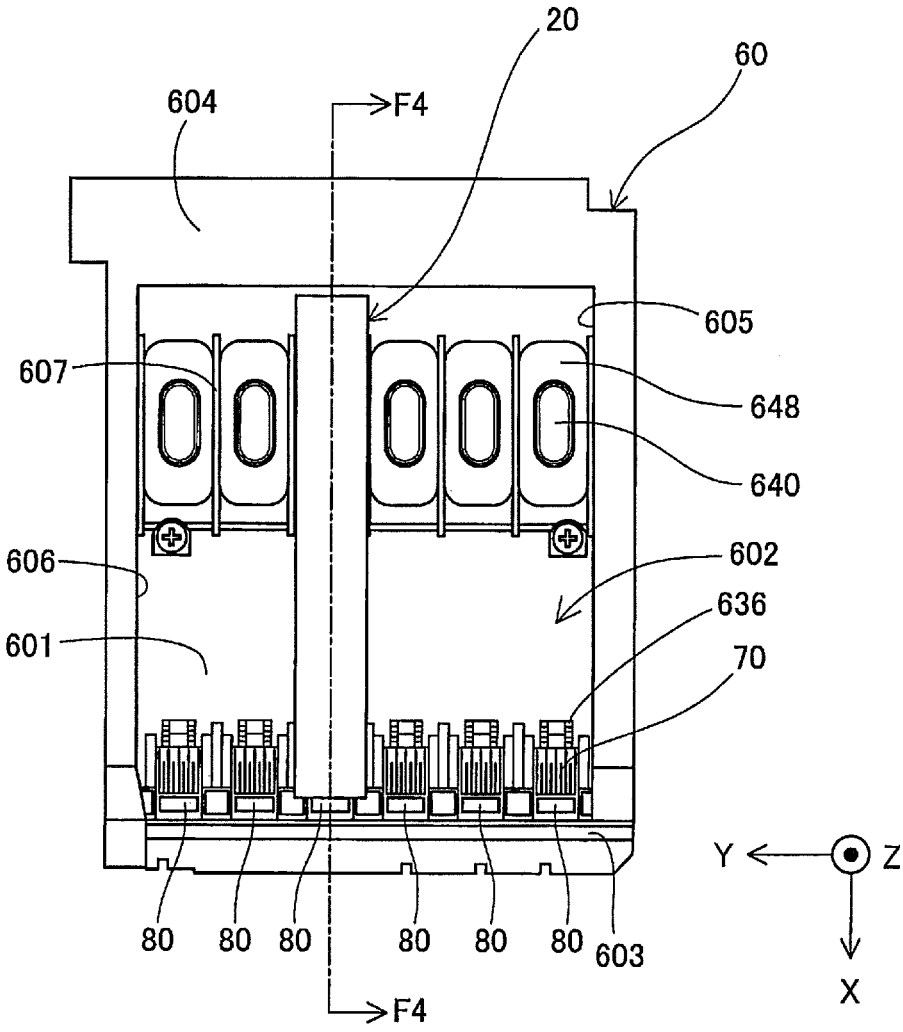
FIG. 4 is a top view illustrating a holder with a cartridge attached thereto.

FIGS. 2 and 3 are perspective views illustrating the holder 60 with the cartridge 20 attached thereto. FIG. 4 is a top view illustrating the holder 60 holder 60 with the cartridge 20 attached thereto. In the state illustrated in FIGS. 2 to 4, one cartridge 20 is properly attached at a designed attachment position of the holder 60. The state of "properly attached at a designed attachment position" and a "mounted" position means that the cartridge 20 is attached, or said differently, mounted, such that cartridge-side terminals are located at positions respectively in contact with corresponding device-side terminals included in a contact mechanism of the printer 50 (described later).

As shown in FIGS. 2 and 3, the holder 60 of the printer 50 has five wall members 601, 603, 604, 605 and 606. A recess formed by these five wall members serves as a cartridge chamber or cartridge mounting structure 602. The cartridge chamber 602 is parted by partition walls 607 into a plurality of slots (mounting spaces) to receive the respective cartridges 20. The partition walls 607 serve as guides to insert the cartridges 20 into the respective slots, but may be omitted as appropriate. Each slot has a printing material supply tube 640, a contact mechanism 70, a lever 80, a second device-side restriction element 620 and a projection 636 serving as a third device-side restriction element. One side face (+Z-axis direction side face, top face) of each slot is open, and the cartridge 20 is attached to and detached from the holder 60 via this open side face (open top face).

The cartridge 20 is attached to the holder 60 in such a state that the cartridge 20 is locked by the lever 80 and the second device-side restriction element 620 and that the ink supply structure (described later) is connected with the printing material supply tube 640. This state is called "attached state of the cartridge 20 to the holder 60" simply "attached" state or alternatively "mounted" state. Connecting the printing material supply tube 640 with the ink supply structure of the cartridge 20 enables ink as the printing material contained in the cartridge 20 to be supplied to the head 540 (FIG. 1). The printing material supply tube 640 has a peripheral end 642 (also called "connection end") located on the +Z-axis direction side and a base end 645 located on the −Z-axis direction side. The base end 645 is provided on the bottom wall member 601, and the peripheral end 642 is connected with the ink supply structure of the cartridge 20. The printing material supply tube 640 has a central axis C parallel to the Z axis. The direction going from the base end 645 to the peripheral end 642 along the central axis C is the +Z-axis direction.

As shown in FIG. 2, an elastic member 648 is provided around the printing material supply tube 640 to seal the periphery of the ink supply structure of the cartridge 20 in the attached state, so as to prevent leakage of ink from the ink supply structure to the periphery. In the attached state, the elastic member 648 applies a pressing force including a +Z-axis direction component to the cartridge 20.

In the attached (mounted) state, electrical connection between the terminals provided on a circuit board (described later) of the cartridge 20 and those of the contact mechanism 70 in each slot of the holder 60 allows transmission of various information between the cartridge 20 and the printer 50.

Figure 5:
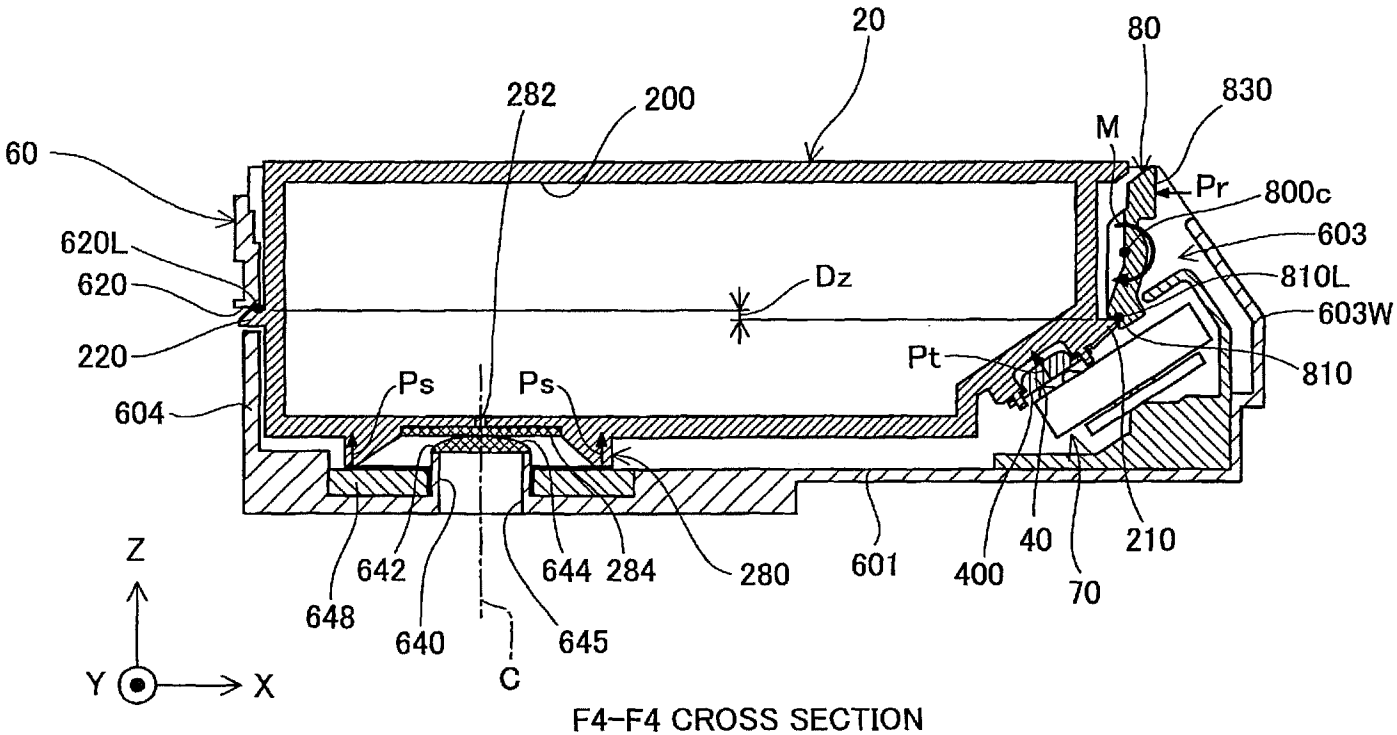
FIG. 5 is a sectional view taken on line F4-F4 in FIG. 4.

FIG. 5 is a sectional view, taken on F4-F4 line of FIG. 4. The projection 636 is omitted from the illustration. The printing material supply tube 640 of the printer 50 is connected with an ink supply structure 280 of the cartridge 20, so that ink is supplied from the cartridge 20 to the head 540 (FIG. 1) via a printing material flow path 282.

According to this embodiment, a porous filter 644 serving to filter the ink supplied from the cartridge 20 is provided at the peripheral end 642 of the printing material supply tube 640. The porous filter 644 may be made of, for example, stainless steel mesh or stainless steel woven fabric. According to another embodiment, the porous filter may not be located at the peripheral end 642 of the printing material supply tube 640.

The contact mechanism 70 of the printer 50 is located on the +X-axis direction side of the printing material supply tube 640 and is configured to be electrically connectable with the terminals provided on a circuit board 40 of the cartridge 20. In the attached state of the cartridge 20, a pressing force Pt including a +Z-axis direction vector component is applied from the terminals of the contact mechanism 70 to the circuit board 40. In the attached state of the cartridge 20, a pressing force Ps in the +Z-axis direction is applied from the elastic member 648 to the ink supply structure 280.

A lever 80 used for attachment and detachment of the cartridge 20 has an operating member 830 at a +Z-axis direction end and a engagement portion 810 at a −Z-axis direction end. The first device-side restriction element or engagement portion 810 (more specifically its first device-side locking face described later) is configured to engage with a first cartridge-side restriction portion 210 at a first locking position 810L in the attached state. The first locking position 810L is located on the +Z-axis direction side and on the +X-axis direction side of the contact between the terminals provided on the circuit board 40 and the contact mechanism 70. The engagement portion 810 engages with the first cartridge-side restriction portion 210 to restrict the motion of the cartridge 20 in the +Z-axis direction.

The lever 80 pivots around an axis 800*c* at the position between the operating member 830 and the engagement portion 810. The axis of rotation 800*c* of the lever 80 is located on the +Z-axis direction side and on the +X-axis direction side of the first locking position 810L.

The user uses the operating member 830 of the lever 80 to remove the cartridge 20 from the holder 60. For removal of the cartridge 20, the user presses the operating member 830 in the −X-axis direction. This pressing applies a force Pr (called "operating force Pr") from the +X-axis direction side toward the −X-axis direction side, to the operating member 830. This operating force Pr turns the lever 80 around the axis 800*c* and moves the engagement portion 810 in the +X-axis direction from the first locking position 810L. This releases the engagement of the first cartridge-side restriction portion 210 with the engagement portion 810 and enables the cartridge 20 to be removed from the holder 60.

The second device-side restriction element 620 is provided on the side wall member 604 and is configured to engage with a second cartridge-side restriction element 220 at a second locking position 620L. According to this embodiment, the second device-side restriction element 620 is a through hole formed in the side wall member 604 of the holder 60. The second locking position 620L is located on the +Z-axis direction side and on the −X-axis direction side of the printing material supply tube 640. The second device-side restriction element 620 engages with the second cartridge-side restriction element 220 (which can also be referred to as the second restriction element 220) to restrict the motion of the cartridge 20 in the +Z-axis direction. As described above, the motion of the cartridge 20 in the +Z-axis direction is restricted by both its +X-axis direction end and its −X-axis direction end in the attached state.

The second locking position 620L, at which the second cartridge-side restriction element 220 is in contact with the second device-side restriction element 620, serves as a pivot point, around which the cartridge 20 is turned to be attached to and detached from the holder 60. In other words, the cartridge 20 is turned around the second locking position 620L along a plane parallel to the Z axis and the X axis for attachment or detachment. The second cartridge side restriction element 220 and the second device-side restriction element 620 accordingly serve as the pivot point of rotation of the cartridge 20 for attachment or detachment of the cartridge 20. The attachment and detachment of the cartridge 20 to and from the holder 60 will be described in detail later.

As shown in FIG. 5, in the attached state, the first locking position 810L is located on the −Z-axis direction side by a distance Dz from the second locking position 620L. This reduces the possibility that the first cartridge-side restriction portion 210 is disengaged from the engagement portion 810 by the pressing forces Ps and Pt applied from the holder 60 to the cartridge 20. The cartridges 20 can thus be stably held at the designed attachment position.

Figure 6A:
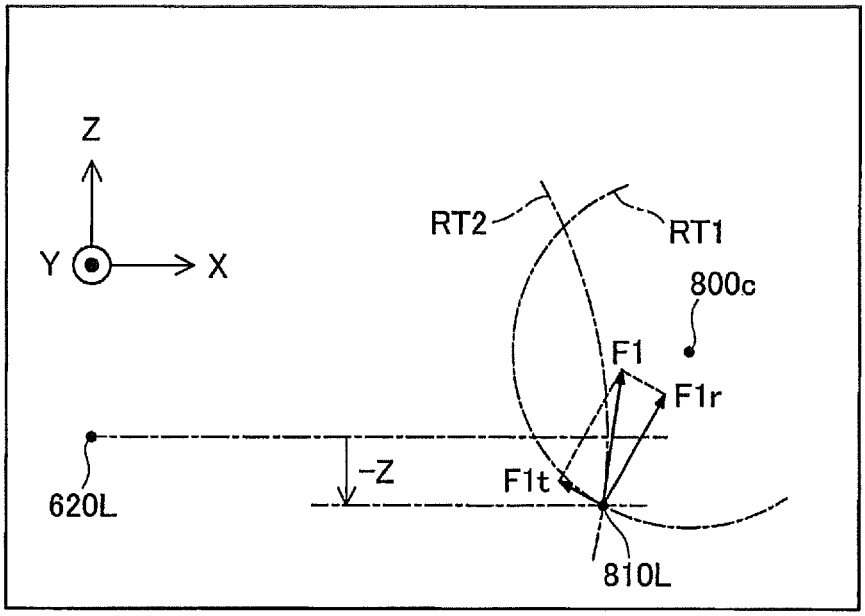
FIGS. 6A and 6B show how the force is applied from the cartridge to a lever.
Figure 6B:
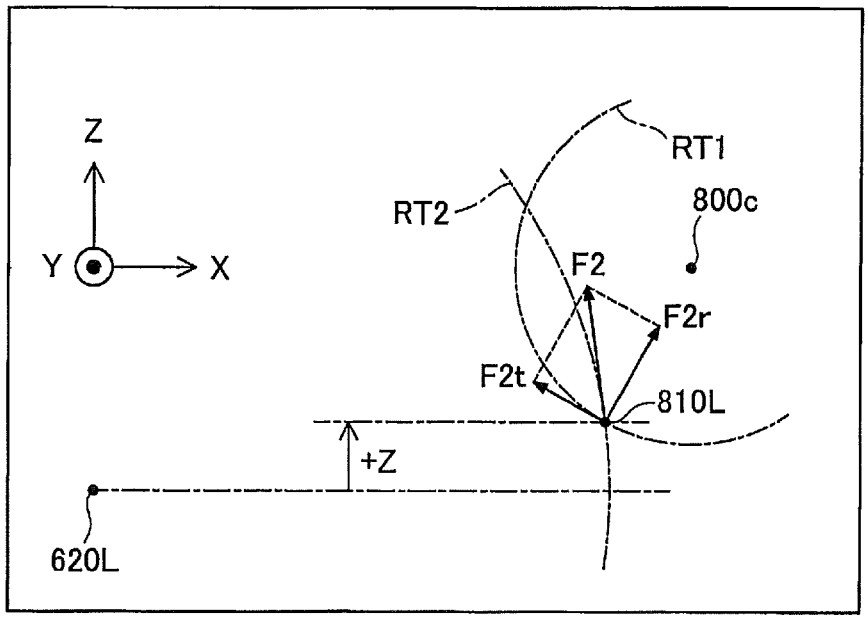

FIGS. 6A and 6B illustrate force applied from the cartridge 20 to the lever 80 at the first locking position 810L. In the state of FIG. 6A where the first locking position 810L is located on the −Z-axis direction side of the second locking position 620L, a force F1 is applied from the cartridge 20 to the lever 80 at the first locking position 810L. In the state of FIG. 6B where the first locking position 810L is located on the +Z-axis direction side of the second locking position 620L, a force F2 is applied from the cartridge 20 to the lever 80 at the first locking position 810L. The force F1 shown in FIG. 6A has the same magnitude as that of the force F2 shown in FIG. 6B.

FIGS. 6A and 6B schematically show the positional relationships of the first locking position 810L, the second locking position 620L and the axis of rotation 800*c* (also called "pivot center 800*c*") to one another on the X axis and on the Z axis. The difference between the two positional relationships shown in FIGS. 6A and 6B is the difference of the second locking position 620L on the Z axis. An arc RT1 shown in FIGS. 6A and 6B shows the rotation locus of the first locking position 810L around the axis of rotation 800*c*. An arc RT2 shown in FIGS. 6A and 6B shows the rotation locus of the first locking position 810L around the second locking position 620L.

In the example illustrated in FIG. 6A, the first locking position 810L is located on the −Z-axis direction side of the second locking position 620L, so the force F1, which is applied in the tangential direction of the arc RT2 at the first locking position 810L, has a +X-axis direction vector component and a +Z-axis direction vector component. The force F1 is accordingly resolved into a vector component F1*t* in the tangential direction of the arc RT1 and a vector component F1*r* in the radial direction of the arc RT1.

In the example illustrated in FIG. 6B, the first locking position 810L is located on the +Z-axis direction side of the second locking position 620L, so the force F2, which is applied in the tangential direction of the arc RT2 at the first locking position 810L, has a −X-axis direction vector component and a +Z-axis direction vector component. The force F2 is accordingly resolved into a vector component F2*t* in the tangential direction of the arc RT1 and a vector component F2*r* in the radial direction of the arc RT1.

As clearly understood from the comparison between FIGS. 6A and 6B, when the magnitude of force F1 is equal to the magnitude of force F2 (F1=F2), the positional relationships of the first locking position 810L, the second locking position 620L and the axis of rotation 800*c* to one another result in "F1*t*<F2*t*" for the vector component in the tangential direction of the arc RT1 and "F1*r*>F2*r*" for the vector component in the radial direction of the arc RT1. In comparison to the state illustrated in FIG. 6B, the state in FIG. 6A has a larger force vector component from the cartridge 20 towards the axis of rotation 800*c* of the lever 80 and a smaller force vector component in the direction that will turn the lever 80 clockwise, that is, as viewed from the +Y-axis direction, around the axis of rotation 800*c*. In other words, locating the first locking position 810L on the −Z-axis direction side of the second locking position 620L more effectively reduces the possibility that the first cartridge-side restriction portion 210 is disengaged from the engagement portion 810, compared with locating the first locking position 810L on the +Z-axis direction side of the second locking position 620L. In either state, no force acts in the +X-axis direction to release the engagement at the first locking position 810L, so both states provide a benefit in reducing the possibility that the first cartridge-side restriction portion 210 will become disengaged from the engagement portion 810.

A-3. Detailed Structure of Cartridge

Figure 7:
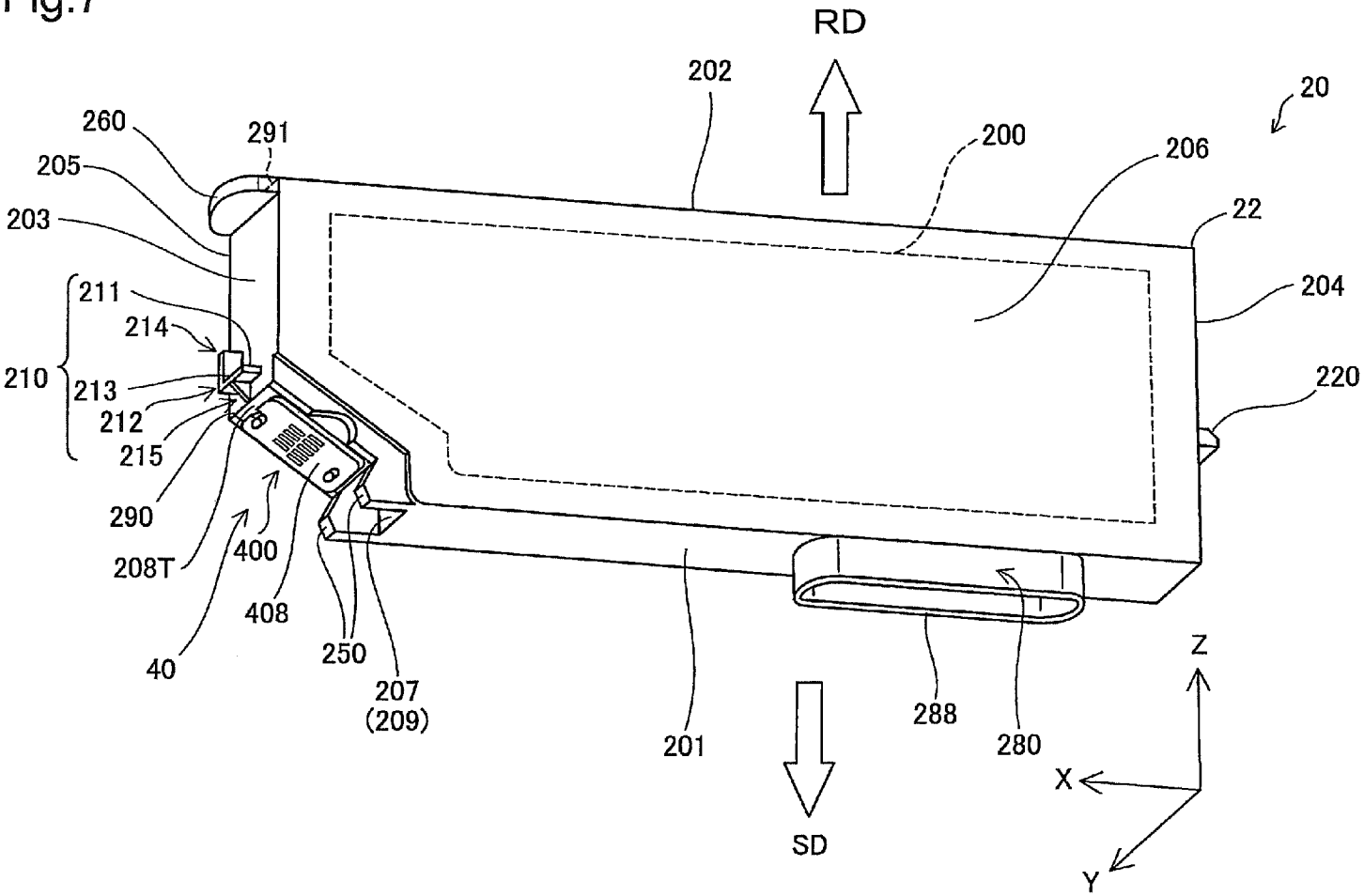
FIG. 7 is a perspective view illustrating the structure of the cartridge.
Figure 8:
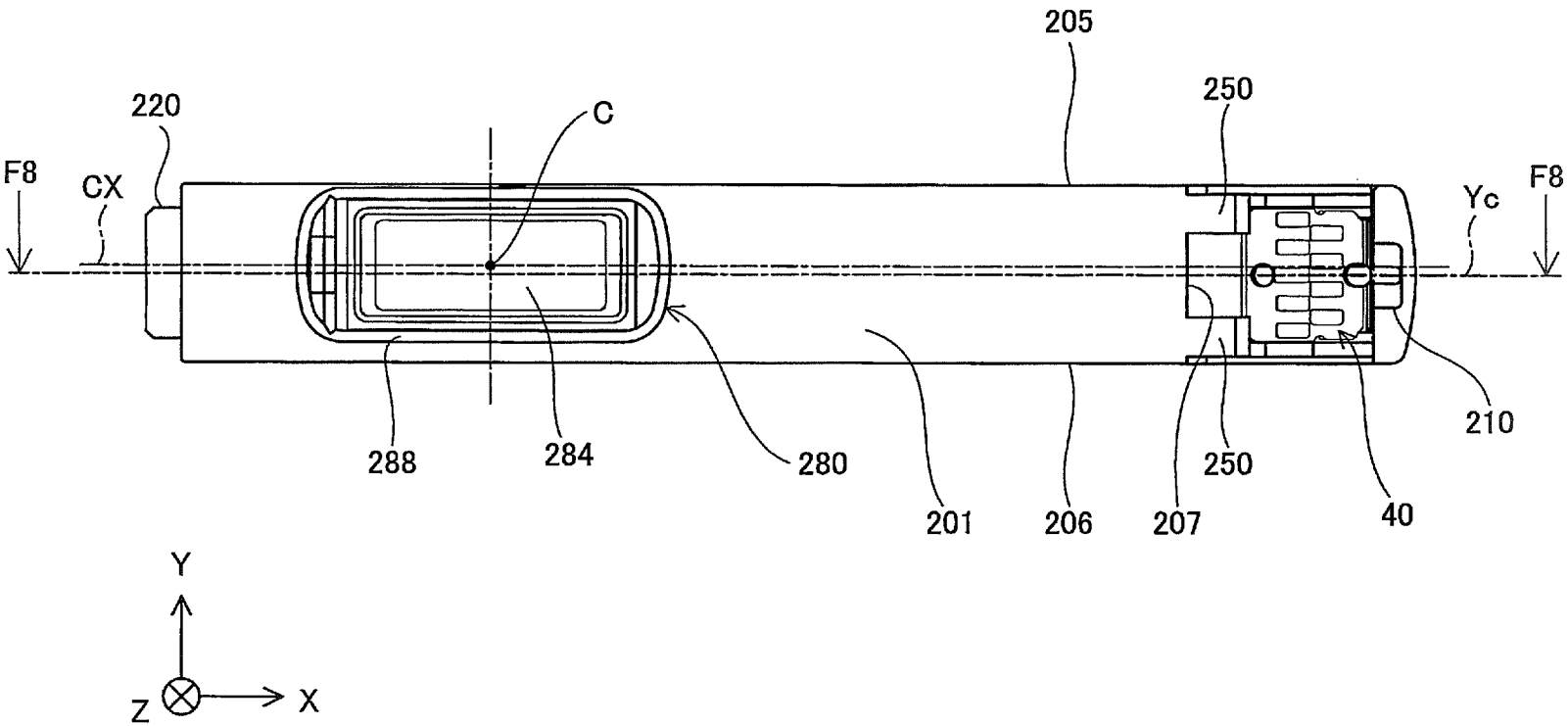
FIG. 8 is a bottom view of the cartridge.
Figure 9:
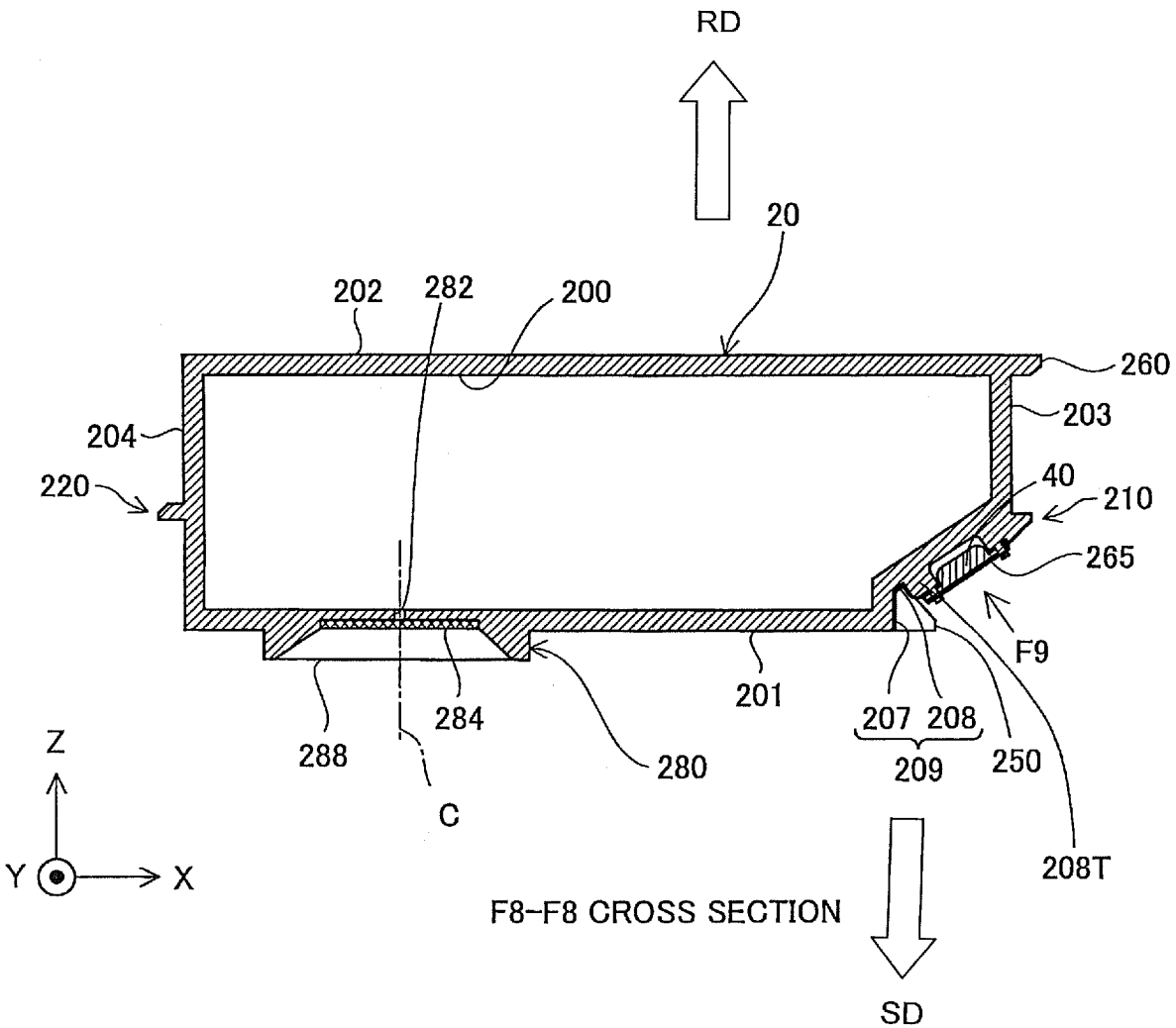
FIG. 9 is a sectional view, taken on line F8-F8 in FIG. 8.
Figure 10A:
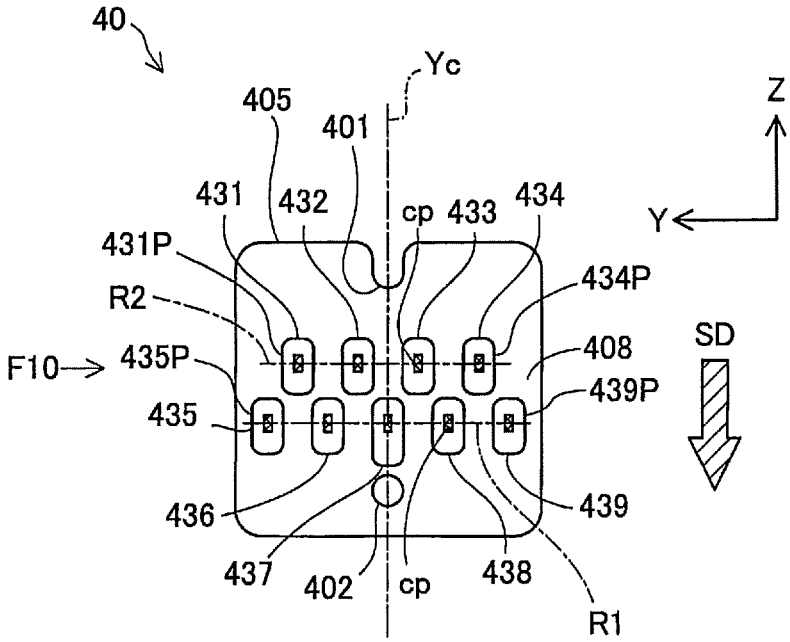
FIGS. 10A and 10B illustrate the detailed structure of a circuit board.
Figure 10B:
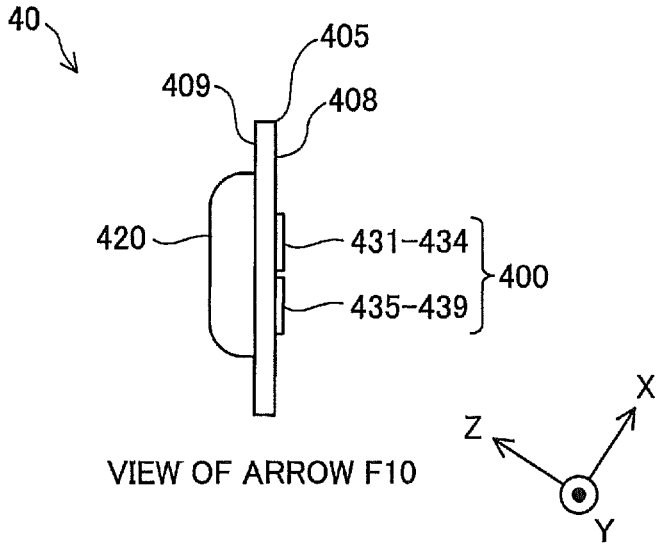

FIG. 7 is a perspective view illustrating the structure of cartridge 20 as one example of a cartridge in accordance with one embodiment of the invention. FIG. 8 is a bottom view of the cartridge 20. FIG. 9 is a sectional view, taken on line F8-F8 in FIG. 8. FIGS. 10A and 10B illustrate the detailed structure of the circuit board 40. FIG. 10A is a view of the circuit board 40 seen from the direction indicated by arrow F9 in FIG. 9, and FIG. 10B is a view of the circuit board 40 seen from arrow F10 in FIG. 10A. According to this embodiment, the X axis, the Y axis and the Z axis represent the axes on the cartridge 20 in the attached state. The +X-axis direction side in the attached state is the front face of the cartridge 20. A plane Yc shown in FIG. 8 is a plane that passes through the center of the width or the Y-axis direction length of the cartridge 20 and is parallel to the Z axis and the X axis (i.e., ZX plane). A plane CX shown in FIG. 8 is a plane that passes through the central axis C and is parallel to the Z axis and the X axis (i.e., ZX plane).

As shown in FIG. 7, the cartridge 20 includes an ink chamber 200 containing ink, a housing 22, the ink supply structure 280, the circuit board 40 and the first cartridge-side restriction portion 210. The cartridge 20 is attached to the holder 60 in a mounting direction SD, which is the −Z-axis direction (vertically downward direction in the embodiment). The special orientation or posture of the cartridge 20 is generally not constant during actual insertion of the cartridge 20 to the holder 60. In the course of attachment of the cartridge 20 to the holder 60, the cartridge 20 may be inclined with respect to the Z axis. In the state immediately before the attachment and in the attached state, however, the ink supply structure 280 receives the printing material supply tube 640 having the central axis C parallel to the Z axis, so that the special orientation of the cartridge 20 is restricted by the printing material supply tube 640, and so is substantially aligned in the Z axis direction. For this reason, and because the general direction of movement of the cartridge 20 while being mounted into the holder 60 is in the −Z axis direction, the −Z axis direction can be considered as the mounting direction SD of the cartridge 20. For the same reasons, the +Z axis direction can be considered as a removal direction RD (FIG. 9) in which the cartridge 20 is removed from the holder 60. Because the −Z axis direction and the +Z axis direction are opposite directions, the mounting direction SD and the removal direction RD can be considered opposite directions.

The housing 22 (also called "cartridge body 22") defines an inner space including the ink chamber 200 of the cartridge 20. The housing 22 also forms at least part of the outer wall surfaces of the cartridge 20 and may be made of a synthetic resin, such as polypropylene (PP). The cartridge 20 is in a rectangular prism shape having congruent side faces or in an approximate rectangular parallelepiped shape. Part of the housing 22 may be made of a resin film.

The cartridge 20 has a length (X-axis direction length), a width (Y-axis direction length) and a height (Z-axis direction length), wherein the length, the height and the width descend in this order. The magnitude relation of the length, the width and the height of the cartridge 20 is, however, not limited to this order but may be determined arbitrarily; for example, the height, the length and the width may descend in this order or the height, the length and the width may be equal to one another.

The housing 22 of the cartridge 20 includes a first wall or a bottom 201, a second wall or a top 202, a third wall or a front 203, a fourth wall or a rear 204, a fifth wall 205, a six wall 206 and connection walls 209. The connection walls 209 include a seventh wall 207 and an eighth wall 208 (FIG. 9). The first to the eighth walls 201 to 208 define the inner space including the ink chamber 200 of the cartridge 20. In the description below, the symbols 201 to 208 assigned to the first to the eighth walls are also used to represent the outer surfaces of the walls constituting the housing 22 of the cartridge 20 (i.e., first to eighth faces 201 to 208). The outer surfaces (first to eighth faces) 201 to 208 of the first to the eighth walls are substantial planes. The "substantial plane" means not only a perfectly flat plane but can include a plane having partial slight irregularity. In other words, the "substantial plane" includes a plane that has partial slight irregularity but is still recognizable as a face or a wall of the housing 22 of the cartridge 20. The first to the eighth faces 201 to 208 are in rectangular shapes in the planar view.

The first face (first wall) 201, the second face (second wall) 202, the third face (third wall) 203, the fourth face (fourth wall) 204, the fifth face (fifth wall) 205 and the sixth face (sixth wall) 206 are also called bottom face (bottom wall) 201, top face (top wall) 202, front face (front wall) 203, rear face (rear wall) 204, left side face (left wall) 205 and right side face (right wall) 206, respectively. The outer surfaces of the walls can also be referred to the front 203, rear 204, top 202 and bottom 201, or as first to fourth surfaces where first surface refers to front 203, second surface refers to rear 204, third surface refers to top 202 and fourth surface refers to bottom 201.

The first face 201 and the second face 202 are opposed to each other in the Z-axis direction. The first face 201 is located on the −Z-axis direction side, while the second face 202 is located on the +Z-axis direction side. The third face 203 and the fourth face 204 are opposed to each other in the X-axis direction. The third face 203 is located on the +X-axis direction side, while the fourth face 204 is located on the −X-axis direction side. The fifth face 205 and the sixth face 206 are opposed to each other in the Y-axis direction. The fifth face 205 is located on the +Y-axis direction side, while the sixth face 206 is located on the −Y-axis direction side.

According to this embodiment, the first face 201 located on the −Z-axis direction side forms the bottom face in the attached state. The first face 201 is an XY plane parallel to the X axis and the Y axis and perpendicular to the Z axis. The first face 201 is a horizontal face in the attached state.

The second face 202 located on the +Z-axis direction side forms the top face in the attached state. The second face 202 is opposed to the first face 201 and is parallel to the first face 201. The second face 202 is a plane (XY plane) parallel to the X axis and the Y axis and perpendicular to the Z axis. The second face 202 is a horizontal face in the attached state.

The third face 203 located on the +X-axis direction side forms a side face in the attached state. The third face 203 is perpendicular to the first face 201 and the second face 202 and is a plane (YZ plane) parallel to the Y axis and the Z axis and perpendicular to the X axis. Among sides of the third face 203, a side 290 located on the most −Z-axis direction side is called "first side 290", and a side 291 located on the most +Z-axis direction side is called "second side 291". In the specification hereof, the expression that "two faces intersect or cross each other" means not only the state that two faces actually cross each other but the state that an extension of one face intersects the other face and the state that extensions of two faces cross each other.

The fourth face 204 located on the −X-axis direction side forms a side face in the attached or mounted state. The fourth face 204 is perpendicular to the first face 201 and the second face 202. The fourth face 204 is parallel to the third face 203. The fourth face 204 is a plane (YZ plane) parallel to the Y axis and the Z axis and perpendicular to the X axis.

The fifth face 205 located on the +Y-axis direction side and the sixth face 206 located on the −Y-axis direction side form side faces in the attached state. The fifth face 205 and the sixth face 206 are perpendicular to the first to the fourth faces 201 to 204. The fifth face 205 and the sixth face 206 are planes (XZ planes) parallel to the X axis and the Z axis and perpendicular to the Y axis. The sixth face 206 is parallel to the fifth face 205.

As shown in FIG. 9, the connection faces 209 couple the first face 201 with the third face 203. The seventh face 207 of the connection faces 209 is perpendicular to the first face 201 and is a plane (YZ plane) parallel to the Y axis and the Z axis. The seventh face 207 is vertically-angled relative to the first face 201 and can also be referred to as a "step". In other words, the seventh face 207 is extended in the +Z-axis direction from the first face 201. The seventh face 207 is located on the −X-axis direction side and on the −Z-axis direction side of the eighth face 208. The eighth face 208 couples the seventh face 207 with the third face 203. The eighth face 208 is a sloped surface inclined in a direction including a +X-axis direction vector component and a −Z-axis direction vector component. The eighth face 208 is inclined to the first face 201 and the third face 203. The eight face 208 is perpendicular to the fifth face 205 and the sixth face 206. In other words, the eighth face 208 is inclined to the XY plane and the YZ plane and is perpendicular to the XZ plane. The eighth face 208 has a board mounting member 208T protruded outward from the eighth face 208.

The relationships of the first to the sixth faces 201 to 206 indicate that the facing direction of the first face 201 and the second face 202 is the Z-axis direction, the facing direction of the third face 203 and the fourth face 204 is the X-axis direction and the facing direction of the fifth face 205 and the sixth face 206 is the Y-axis direction.

As shown in FIG. 7, the circuit board 40 is preferably mounted on the board mounting member 208T of the eighth face 208. The circuit board 40 has a terminal bearing structure 408 that is inclined in the direction including the +X-axis direction vector component and the −Z-axis direction vector component, like the eighth face 208. In this embodiment, the terminal bearing structure 408 comprises the surface of the circuit board 40. The terminal bearing structure 408 is inclined to the first face 201 and the third face 203. The terminal bearing structure 408 is perpendicular to the fifth face 205 and the sixth face 206. In other words, the terminal bearing structure 408 is inclined to the XY plane and the YZ plane and is perpendicular to the XZ plane. The terminal bearing structure 408 is also called "sloped terminal bearing structure 408". The terminal bearing structure 408 has cartridge-side terminals 400, which are in contact with the device-side terminals of the contact mechanism 70 (FIG. 2). The angle of inclination is preferably between 0 degrees and 90 degrees, more preferably between 20 degrees and 50 degrees and most preferably from about 25 degrees to 40 degrees.

Figure 42A:
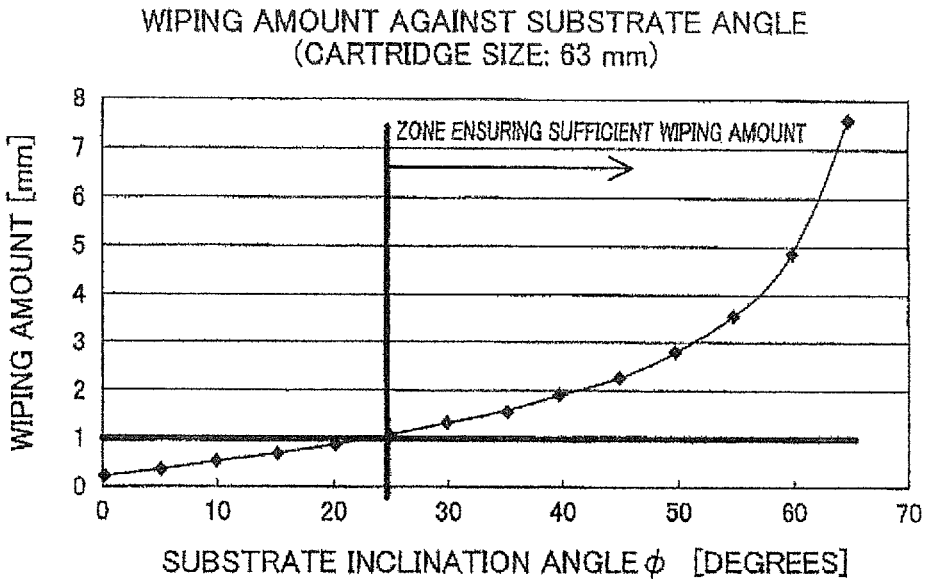
FIG. 42A is a graph showing a relation of wiping amount of a board terminal to a board inclination angle ϕ
Figure 42B:
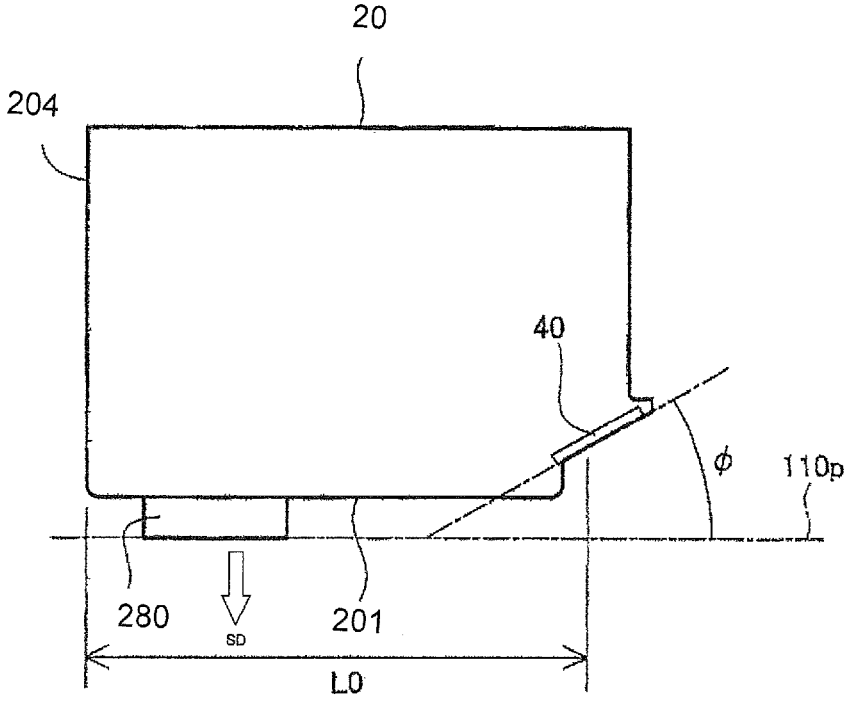
FIG. 42B shows the wiping amount of a board terminal.

FIGS. 42A and 42B shows the relation of a wiping amount of the terminal on the circuit board 40 by an apparatus-side terminal with respect to an inclination angle ϕ of the circuit board 40. The inclination angle ϕ of the circuit board 40 represents an angle between the plane 110*p* extended from the mounting direction leading edge of the ink supply structure 280 and a plane in which the terminals 400 of the circuit board 40 are arranged. The plane defined by the terminals 400 is neither perpendicular nor parallel to the plane 110*p*. The inclination angle ϕ is generally an acute angle (less than 90 degrees). In this embodiment, the plane 110*p* extended from the mounting direction leading edge is parallel to the bottom face 201 of the cartridge 20. Also, the plane in which the terminals 400 are arranged is parallel to the board surface of the circuit board 40. Accordingly, in this embodiment, the inclination angle ϕ is equal to the angle between the bottom face 201 of the cartridge 20 and the board surface of the circuit board 40. Also, for simplicity sake, the terminal bearing structure 408 may be used interchangeably with "plane defined by the terminals" or "terminal plane". When contact portions 431-439 are referenced in connection with the terminal bearing structure 408 the term "plane defined by the contact portions" or "contact portion plane" can be used interchangeably well. In the course of attachment or mounting of the cartridge 20, as shown in FIGS. 24-27, the front face 203 (the first surface) of the cartridge 20 goes down with slight pivotal rotation on the rear face 204 (the second surface) of the cartridge 20. In this process, the circuit board 40 slightly rotates and comes into contact with the apparatus-side contact forming members 731-739 on the terminal base 709, so that the respective contact portions 431-439 are wiped by the apparatus-side contact forming members 731-739. The wiping of the terminal on the circuit board 40 by the corresponding apparatus-side terminal properly removes the dust or oxide coating on the surface of the terminal on the circuit board 40 to enhance the electric conductivity (electrical connection).

The plot of FIG. 42A shows the wiping length (wiping amount) of the terminal on the circuit board 40 by the corresponding apparatus-side contact forming members as ordinate, and the board inclination angle ϕ as abscissa. The calculation is on the assumption that distance L0 in the X direction from the second surface (rear face) 204 of the cartridge 20 to the contact portion of the ground terminal 437 that comes into contact with the corresponding apparatus-side ground terminal 737 is 63 mm. In general, the greater board inclination angle ϕ causes the board surface to be closer to the vertical plane and increases the wiping amount. In order to sufficiently remove the dust or oxide coating on the surface of the terminal on the circuit board 40, the wiping amount is preferably not less than 1 mm. According to the graph of FIG. 42A, the board inclination angle ϕ is preferably not less than 25 degrees to ensure the wiping amount of not less than 1 mm.

Figure 25:
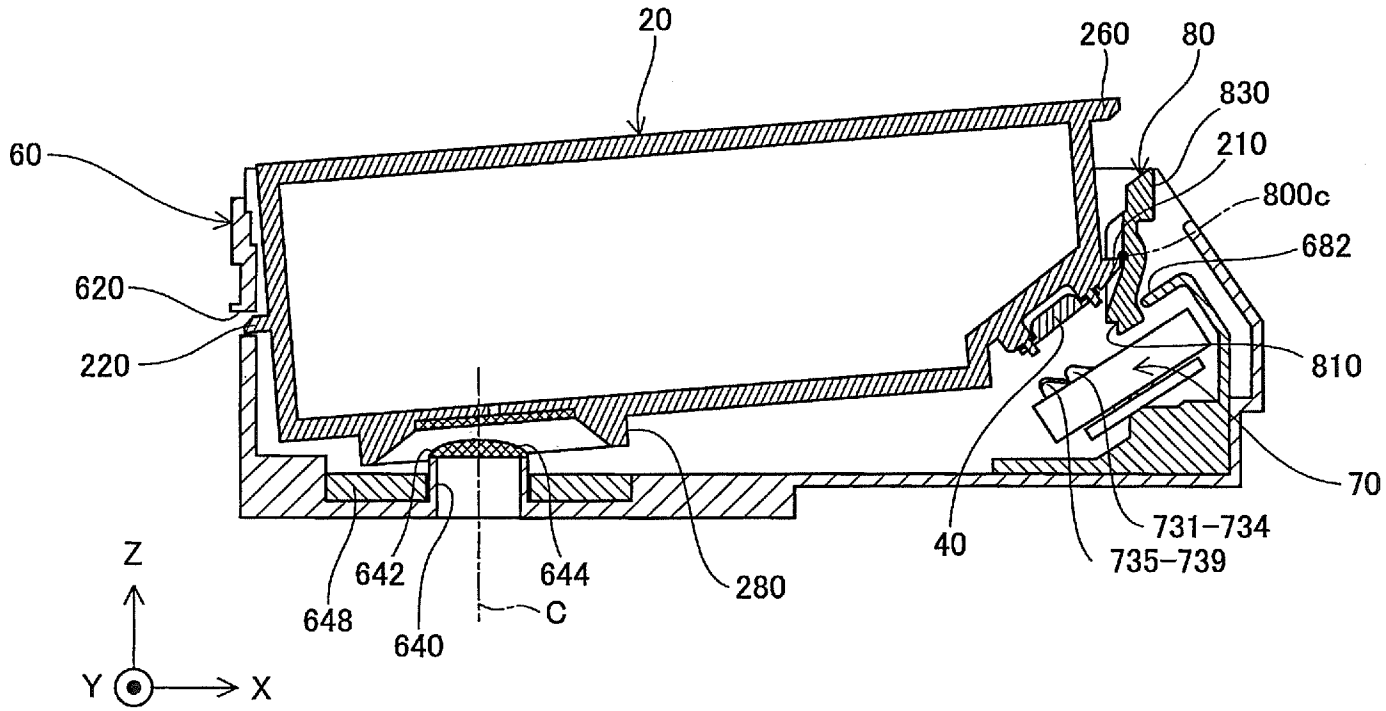
FIG. 25 shows the procedure for attachment of the cartridge to the holder.
Figure 43A:
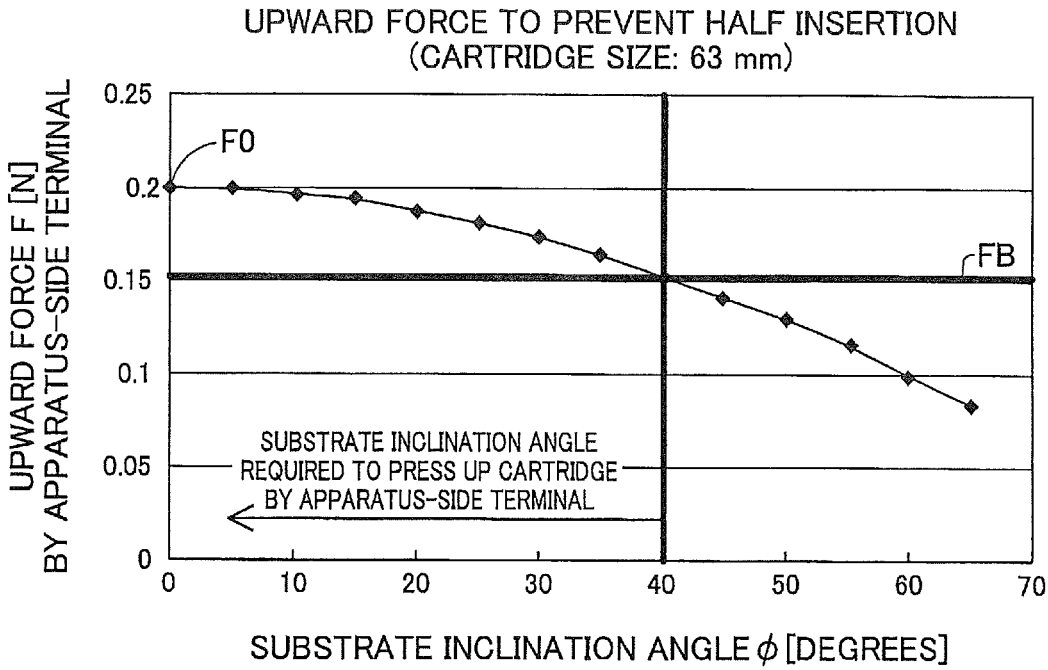
FIG. 43A is a graph showing a relation of upward force by an apparatus-side ground terminal to a board inclination angle ϕ.
Figure 43B:
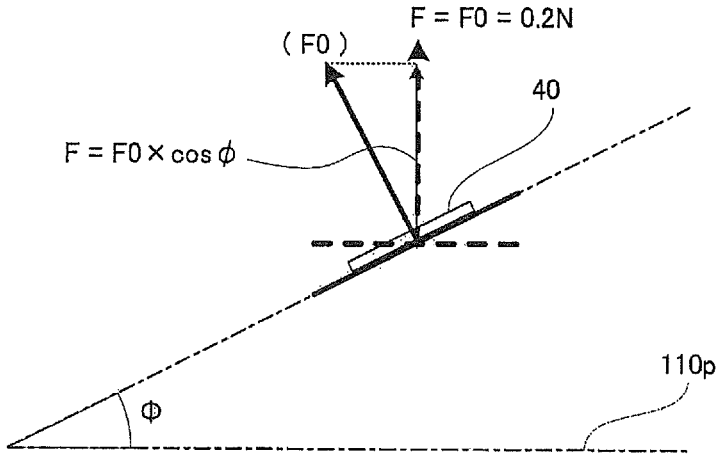
FIG. 43B shows the upward force by the apparatus-side ground terminal.

FIG. 43A shows the relation of upward force F by the apparatus-side ground terminal 737 to the board inclination angle ϕ in consideration of preventing half insertion of the cartridge. The calculation of FIG. 43A is also on the assumption that the distance L0 is equal to 63 mm, like the calculation of FIG. 42A. The weight of the cartridge (including the weight of ink) is assumed to be 30 grams. This value is the standard weight of the cartridge for inkjet printing apparatuses for household use. The "half insertion of the cartridge" denotes the state where the engagement portion 810 of the lever 80 is located just beside the elastic member 682 as shown in FIG. 25, i.e., the state immediately before the complete engagement. This state of half insertion is also called "half engagement". In this state of half engagement, only the apparatus-side ground terminal 737 among the plurality of apparatus-side contact forming members 731-739 applies the upward force to the circuit board 40. It should be noted that in the printing apparatus shown in FIG. 1, the holder 60 does not have a cover. When the user releases the hand in this state of half engagement, the cartridge 20 may be kept in this state of half engagement. The plot of FIG. 43A shows the calculation result of the upward force by the apparatus-side ground terminal 737 to prevent such half insertion of the cartridge 20. FIG. 43B shows the relation of the upward force F to the board inclination angle ϕ.

The upward force by the apparatus-side ground terminal 737 is a +Z-direction vector component (vertically upward vector component in this embodiment) of the force applied from the apparatus-side ground terminal 737 to the circuit board 40 (and the cartridge 20) in the state of half engagement of FIG. 25. When the ground terminal 437 of the circuit board 40 is pressed against the apparatus-side ground terminal 737, a pressing force in a direction perpendicular to the board surface of the circuit board 40 is applied to the ground terminal 437 by the elastic force of the apparatus-side ground terminal 737. The calculation of the upward force of FIG. 43A is on the assumption that pressing force F0 of the apparatus-side ground terminal 737 is 0.2 N in the direction perpendicular to the board surface. Since the upward force F (=F0×cos ϕ) is the +Z-direction vector component of the pressing force F0, F=F0=0.2 N holds at the board inclination angle ϕ=0 degree as shown by the broken line in FIG. 43B. The upward force F varies according to the curve F=F0×cos ϕ with a variation in board inclination angle ϕ. The curve of FIG. 43A is the curve F=F0×cos ϕ. With an increase in board inclination angle ϕ (ϕ approaching 90 degrees), the board surface approaches the XZ plane and reduces the upward force F. An upward force FB balancing with the cartridge 20 having the distance L0 of 63 mm and the weight of 30 grams is approximately 0.15 N (the position of thick horizontal line in FIG. 43A). This means that the upward force of not less than 0.15 N enables the cartridge 20 to be pressed vertically upward by the apparatus-side ground terminal 737. In order to ensure the upward force of not less than 0.15 N, the board inclination angle ϕ is preferably not greater than 40 degrees, as clearly understood from FIG. 43A.

When the user releases the hand in the state of half engagement of FIG. 25, the cartridge 20 may be kept in the state of half engagement. If the board inclination angle ϕ is set to be not greater than 40 degrees as shown in FIG. 43A, however, when the user releases the hand in the state of half engagement, the apparatus-side ground terminal 737 presses the front face 203 of the cartridge 20 in the +Z direction (upward direction). This clearly disengages the cartridge from the apparatus- and facilitates the user to find the failed attachment. From this point of view, it is preferable to set the board inclination angle ϕ to be not greater than 40 degrees.

Figure 44:
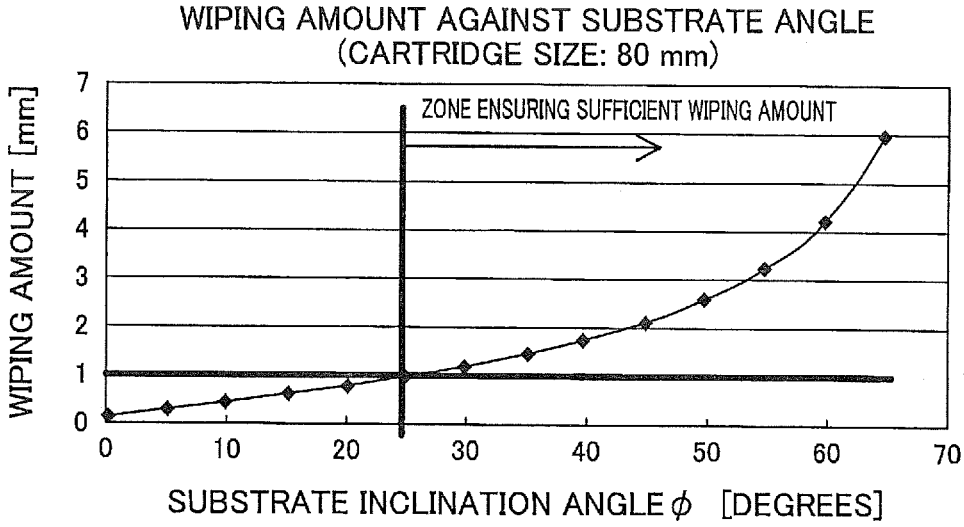
FIG. 44 is a graph showing another relation of wiping amount of the board terminal to a board inclination angle ϕ.
Figure 45:
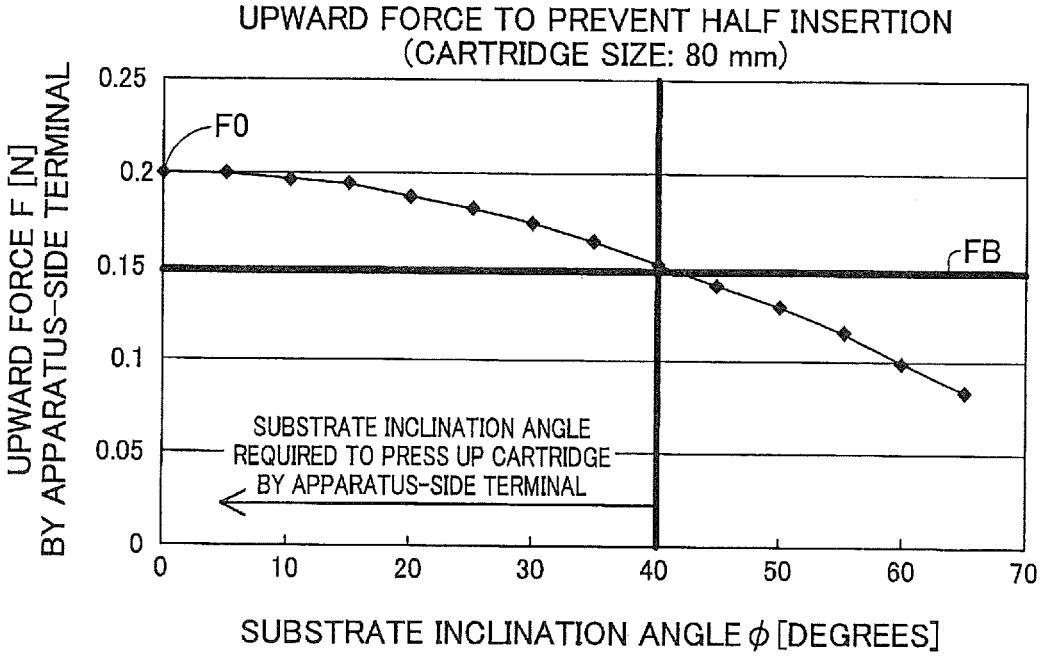
FIG. 45 is a graph showing another relation of upward force by the apparatus-side ground terminal to a board inclination angle ϕ.

FIGS. 44 and 45 show the characteristics of a cartridge having a greater dimension in the X direction than the dimension of the cartridge in FIGS. 42 and 43A. Whereas the cartridge is assumed to have the distance L0=63 mm in FIGS. 42 and 43A, it is assumed to have the distance L0=80 mm in FIGS. 44 and 45. The calculation of the upward force of FIG. 45 is on the assumption that F0=0.2 N and the weight of the cartridge (including the weight of ink) is 30 g, like the calculation of FIG. 43A. As clearly understood from the result of FIG. 44, like the result of FIG. 42A, in order to ensure the wiping amount of not less than 1 mm, the board inclination angle ϕ is preferably not less than 25 degrees. Although the distance L0 is 80 mm in the calculation of FIG. 45 relative to 63 mm in the calculation of FIG. 43A, the upward force FB balancing with the cartridge 20 having the weight of 30 grams is almost equal to that of FIG. 43A and is approximately 0.15 N (the position of thick horizontal line in FIG. 45). As clearly understood from the result of FIG. 45, like the result of FIG. 43A, in order to prevent half engagement of the cartridge, the board inclination angle ϕ is preferably not greater than 40 degrees.

By taking into account the characteristics of FIGS. 42 through 45, discussed above, it is preferable to set the board inclination angle ϕ to be not less than 25 degrees and not greater than 40 degrees.

The increased pressing force of the apparatus-side ground terminal 737 ensures the sufficient upward force even at the greater board inclination angle ϕ. In this case, it is preferable to set the pressing force of the apparatus-side ground terminal 737 and the board inclination angle ϕ to such values that enable the cartridge 20 to be pressed upward and changed from the state of half engagement to the disengagement state by the pressing force of the apparatus-side ground terminal 737, when the user release the hand from the cartridge 20 in the state of half engagement.

The seventh face 207 and the terminal bearing structure 408 form part of the outer surfaces of the cartridge 20. More specifically the seventh face 207 and the terminal bearing structure 408 form a portion of a corner section 265 coupling the first face 201 and the third face 203 that form part of the outer surfaces of the cartridge 20. For better understanding, the corner section 265 is shown by a thick line in FIG. 9. The third face 203 and the corner section 265 are opposed to the first device-side side wall member 603 of the holder 60 (FIG. 14) in the attached state of the cartridge 20 to the holder 60 as described later. The third face 203 and the corner section 265 are thus called "first opposed outer wall surface". The fourth face 204 is opposed to the second device-side side wall member 604 of the holder 60 (FIG. 15) in the attached state as described later. The fourth face 204 is thus called "second opposed outer wall surface".

As shown in FIG. 10A, the circuit board 40 has a boss groove 401 at a +Z-axis direction end and a boss hole 402 at a −Z-axis direction end. The circuit board 40 is fixed to the eighth face 208 of the cartridge 20 by means of the boss groove 401 and the boss hole 402. According to this embodiment, the boss groove 401 and the boss hole 402 are provided at positions intersecting the plane Yc passing through the center of the width (Y-axis direction length) of the cartridge 20. According to another embodiment, at least one of the boss groove 401 and the boss hole 402 may be omitted from the circuit board 40, and the circuit board 40 may be fixed to the eighth face 208 by an adhesive or by an engagement click (not shown) provided on the eighth face 208.

As shown in FIGS. 10A and 10B, the circuit board 40 includes the cartridge-side terminals 400 provided on the terminal bearing structure 408 and a memory unit 420 provided on a rear face 409. The terminal bearing structure 408 and the rear face 409 are planes. A portion or a side of the plane terminal bearing structure 408 located on the most +Z-axis direction side in the mounting state of the circuit board 40 on the cartridge 20 is called a board end 405.

The cartridge-side terminals 400 include nine terminals 431 to 439. The memory unit 420 stores information regarding ink of the cartridge 20 (for example, remaining amount of ink and ink color). The cartridge-side terminals 400 are electrically conductive and can be coupled to an electrical device that is part of the cartridge 20. As used herein, electrical device can refer to a resistor, sensor or memory device, or other device that produces or is powered by electricity as can be appreciated by one of ordinary skill in the art.

As shown in FIG. 10A, the nine cartridge-side terminals 431 to 439 are all in approximate rectangular shape and are arrayed in two rows that are substantially perpendicular to the mounting direction SD. The substantially perpendicular rows are extended in the width direction (Y-axis direction) of the cartridge 20. The row the two row to the rear with respect to the mounting direction SD is called first terminal row R1 (lower line R1), and the front line along the mounting direction SD is called second terminal row R2 (upper line R2). The first terminal row R1 and the second terminal row R2 have different positions in the Z-axis direction. More specifically, the first terminal row R1 is located on the −Z-axis direction side of the second terminal row R2. Each of the terminals 431 to 439 has a contact portion cp at its center, which is in contact with the contact mechanism 70. The first terminal row R1 and the second terminal row R2 may be regarded as lines formed by a plurality of contact portions cp.

The terminals 431 to 439 may be called by the following names corresponding to their functions or applications. For differentiation from the terminals on the printer 50, the word "cartridge-side" may be prefixed to each name. For example, the "ground terminal 437" may be called "cartridge-side ground terminal 437".

<First Terminal Row R1>

(1) attachment detection terminal (first terminal) 435;
(2) power terminal 436;
(3) ground terminal 437;
(4) data terminal 438; and
(5) attachment detection terminal (second terminal) 439.

<Second Terminal Row R2>

(6) attachment detection terminal (third terminal) 431;
(7) reset terminal 432;
(8) clock terminal 433; and
(9) attachment detection terminal (fourth terminal) 434.

The contact portions cp of the terminals 435 to 439 on the first terminal row R1 and the contact portions cp of the terminals 431 to 434 on the second terminal row R2 are arranged alternately or more specifically in zigzag.

The four attachment detection terminals 431, 434, 435 and 439 are used to check the good/poor electrical contact with the corresponding device-side terminals provided in the contact mechanism 70, so that the printer 50 can detect whether the cartridge 20 is properly attached at the designed attachment position of the holder 60. These four terminals 431, 434, 435 and 439 are collectively called "attachment detection terminals". According to this embodiment, the four cartridge-side terminals 431, 434, 435 and 439 are electrically connected with one another inside the circuit board 40. When the cartridge 20 is attached to the holder 60, these terminals 431, 434, 435 and 439 are electrically connected with a ground line (not shown) on the printer 50 via the ground terminal 437. The method of detecting attachment by using the four attachment detection terminals 431, 434, 435 and 439 will be described later.

The other five cartridge-side terminals 432, 433, 436, 437 and 438 are terminals for the memory unit 420. These five terminals 432, 433, 436, 437 and 438 are thus also called "memory terminals".

The reset terminal 432 receives a reset signal RST, which is to be supplied to the memory unit 420. The clock terminal 433 receives a clock signal SCK, which is to be supplied to the memory unit 420. The power terminal 436 receives a power-supply voltage VDD (for example, rated voltage of 3.3 V), which is to be supplied to the memory unit 420. The ground terminal 437 receives a ground voltage VSS (0V), which is to be supplied to the memory unit 420. The data terminal 438 receives a data signal SDA, which is to be supplied to the memory unit 420.

The first terminal 435 as one of the attachment detection terminals includes a first outer part 435P located on the most +Y-axis direction side of the cartridge-side terminals 400. The second terminal 439 as one of the attachment detection terminals includes a second outer part 439P located on the most −Y-axis direction side of the cartridge-side terminals 400. The third terminal 431 as one of the attachment detection terminals includes a third outer part 431P located on the most +Y-axis direction side of the second terminal line R. The fourth terminal 434 as one of the attachment detection terminals includes a fourth outer part 434P located on the most −Y-axis direction side of the second terminal line R. In this embodiment, the first to fourth outer parts 435P, 439P, 431P, 434P are substantially straight edges of the corresponding terminals and extend substantially in the Z axis direction, but this should not be considered a limitation. For example, the edges could be curved and could extend in a direction not parallel to the Z axis direction, such as shown for the terminals 431, 434 in the example of FIGS. 41A and 41B, and the outer part of the terminal could still be understood as the outermost portion of the edge in the Y axis direction.

Among the contact portions cp of the cartridge-side terminals 400, the ground terminal 437 having the contact portion cp on the center in the Y-axis direction is provided at the position intersecting the plane Yc passing through the center of the width (Y-axis direction length) of the cartridge 20. The contact portions cp of the other terminals 431 to 436, 438 and 439 are arranged to be symmetrical with respect to the line of intersection of the plane Yc and the ground terminal 437 as the axis. The ground terminal 437 is configured to be in contact with the contact mechanism 70 prior to the other cartridge-side terminals 431 to 436, 438 and 439 in the course of attachment of the cartridge 20 to the holder 60. The pressing force first applied from the holder 60 to the circuit board 40 is thus generated on the substantial center of the width or the Y-axis direction length of the cartridge 20 both before and after the cartridge is completely mounted. This prevents the pressing force applied to the circuit board 40 from acting to tilt the cartridge 20 in the Y-axis direction and thereby enables the attachment of the cartridge 20 at the designed attachment position. Such contact of the ground terminal 437 with the contact mechanism 70 of the holder 60 prior to the other cartridge-side terminals 431 to 436, 438 and 439 advantageously prevents or reduces the high voltage-induced troubles and failures by the grounding function of the ground terminal 437, even when an unexpected high voltage is applied to the cartridge 20.

According to this embodiment, the ground terminal 437 is formed longer along the Z-axis direction than the other cartridge-side terminals 431 to 436, 438 and 439. This ensures the contact of the ground terminal 437 with the contact mechanism 70 of the holder 60. According to another embodiment, all the cartridge-side terminals 431 to 439 on the circuit board 40 may be formed in the same size.

Figure 5A:
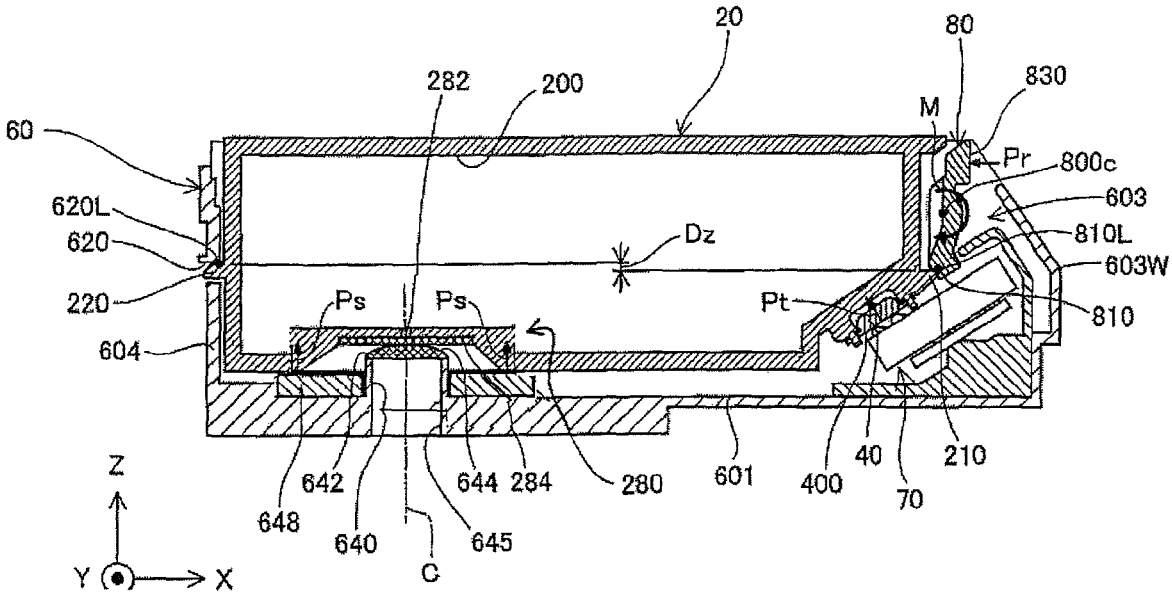
FIG. 5A is a sectional view illustrating a holder with a cartridge attached thereto.

As shown in FIG. 9, the ink supply structure 280 is protruded in the −Z-axis direction from the first face 201. The ink supply structure 280 communicates with the ink chamber 200 via the printing material flow path 282. The ink supply structure 280 is connected with the printing material supply tube 640 (FIG. 5) of the printer 50 to supply the ink contained in the ink chamber 200 to the head 540 (FIG. 1). In other words, the ink supply structure 280 is open to the outside, in order to supply the ink contained in the ink chamber 200 to outside of the cartridge 20. As can be seen in FIG. 5A, ink supply structure 280 need not protrude from the first face 201. Rather, in one embodiment, it can be flush or substantially flush with the first face 201. In such an embodiment, material supply tube 640 is raised so as to be proximate to the first face when the cartridge 20 is mounted.

The ink supply structure 280 is provided at the position closer to the fourth face 204 than the third face 203 on the first face 201. The distance between the outer surface of the ink supply structure 280 and the third face 203 in the X-axis direction is accordingly greater than the distance between the outer surface of the ink supply structure 280 and the fourth face 204.

The ink supply structure 280 has an open peripheral end. The surface at this open peripheral end is referred to as open surface 288, or alternately a mounting direction leading edge, and defines a horizontal plane in the attached state. That is, the open surface 288 is the leading edge (XY plane) of the cartridge in the mounting direction SD and defines an XY axes plane which is parallel to the X axis and the Y axis.

A resin foam 284 is provided inside the ink supply structure 280 at the position on the +Z-axis direction side of the open surface 288 or more specifically at the position in contact with the printing material flow path 282. According to this embodiment, before shipment of the cartridge 20, the open surface 288 of the ink supply structure 280 is sealed with a sealing member (not shown), such as a cap or a film. For attachment of the cartridge 20 to the holder 60, the sealing member (not shown) for sealing the open surface 288 is removed from the cartridge 20.

According to this embodiment, the ink supply structure 280 is protruded in the −Z-axis direction with the center on the central axis C of the printing material supply tube 640. According to another embodiment, the center of the ink supply structure 280 may be deviated from the central axis C of the printing material supply tube 640. According to this embodiment, the open surface 288 of the ink supply structure 280 viewed from the −Z-axis direction is formed by the line-symmetrical housing with respect to axes parallel to the X axis and the Y axis. According to another embodiment, the open surface 288 of the ink supply structure 280 may be formed by the asymmetric housing and may have a mounting direction leading edge defining a plane. The open surface 288 viewed from the Z direction is in the rounded rectangular shape according to this embodiment but may be in any other suitable shape, e.g., precise circle, ellipse, oval, square or rectangle according to other embodiments.

Figure 9A:
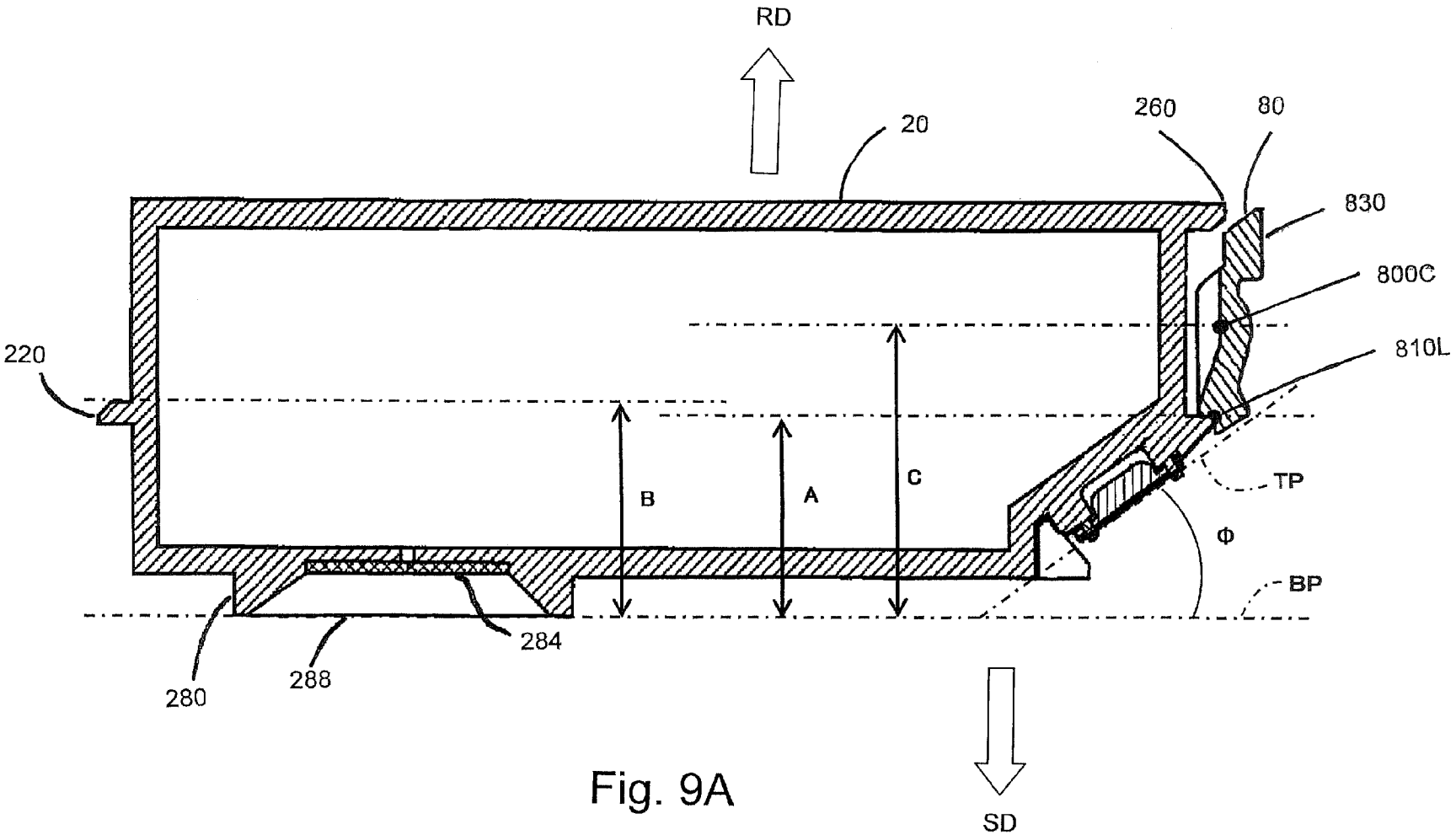
FIG. 9A is a view of the cartridge and the lever when the cartridge is in its mounted position.

As shown in FIG. 9A, plane BP is a plane formed by the mounting direction leading edge of the open surface 288 of ink supply structure 280. Distance A is the distance between plane BP and the engagement portion 212 of the first restriction portion 210. Distance B is the distance between plane BP and an engagement portion of the second restriction element 220. Distance C is the distance between plane BP and the lever 80's pivot point around axis 800C. As can be seen in FIG. 9A, the distance between plane BP and an engagement portion of the second restriction element 220 is greater than the distance between plane BP and the engagement portion 212 of the first restriction portion 210 when measured in an orthogonal direction to the plane BP. The distance between plane BP and the engagement portion 212 of the first restriction portion 210 is less than the distance between plane BP and the lever 80's pivot point around axis 800C when measured in an orthogonal direction to the plane BP. Additionally as can be seen in FIG. 9A, plane TP is the plane formed by the sloped terminal bearing structure 408, which in this embodiment is parallel to the sloped terminal bearing structure 408 itself, and so for simplicity sake, the terminal bearing structure 408 may be used to refer to the plane TP. Plane TP is neither parallel nor perpendicular to plane BP. The terminal bearing structure 408 has cartridge-side terminals 400, which are in contact with the device-side terminals of the contact mechanism 70 (FIG. 2).

As shown in FIG. 7, the first cartridge-side restriction portion 210 is provided on the third face 203. The first cartridge-side restriction portion 210 is located on the +Z-axis direction side and on the +X-axis direction side of the ink supply structure 280 and the circuit board 40. The first cartridge-side restriction portion 210 is locked by the lever 80 (FIG. 2), so as to restrict the motion of the cartridge 20 in the attached state. The first cartridge-side restriction portion 210 is structured as a projection protruded in the +X-axis direction (outward) from the third face 203. The first cartridge-side restriction portion 210 is located at the position closer to the first side 290 than the second side 291 along the Z-axis direction. According to this embodiment, the first cartridge-side restriction portion 210 is located adjacent to the first side 290.

The first cartridge-side restriction portion 210 includes a first portion 212 extended in the Y-axis direction (width direction), a second portion 214 extended in the +Z-axis direction (vertically upward direction) from the first portion 212, and a third portion 215 extended in the −Z-axis direction (vertically downward direction) from the first portion 212. As described above, the +Z-axis direction (vertically upward direction) is generally the removal direction RD and is opposite the −Z-axis direction (vertically downward direction), which is generally the mounting direction SD. The first or engagement portion 212 cooperates with an engagement portion 810 of the lever 80 to restrict the motion of the cartridge 20 in the attached state. The second portion 214 is provided to lock the first portion 212 by the expected part of the lever 80 in attachment of the cartridge 20 to the holder 60.

The first portion 212 includes a first cartridge-side locking surface 211 as a first abutting part and a second cartridge-side locking surface 213 as a second abutting part. The first cartridge-side locking surface 211 faces in the +Z-axis direction. The second cartridge-side locking surface 213 faces in the +X-axis direction. The third portion 215 is in contact with the first portion 212 and the first side 290.

The cartridge 20 further includes the second cartridge-side restriction element 220 provided on the fourth face 204, a projection 260 provided on the third face 203 and a third cartridge-side restriction element 250 provided on the seventh face 207.

The second cartridge-side restriction element 220 is structured as a projection protruded in the −X-axis direction from the fourth face 204. The second cartridge-side restriction element 220 is inserted into the second device-side restriction element 620 (FIG. 3) in the form of the through hole of the holder 60. The user turns the cartridge 20 around the second cartridge-side restriction element 220 inserted in the second device-side restriction element 620 (FIG. 3) in attachment or detachment of the cartridge 20 to or from the holder 60. In other words, the second device-side restriction element 620 serves as the guide for attachment or detachment of the cartridge 20 to or from the holder 60. This facilitates the attachment and detachment of the cartridge 20 to and from the holder 60. In the attached state of the cartridge 20, the second cartridge-side restriction element 220 is locked by the second device-side restriction element 620 to restrict the motion of the cartridge 20 in the attached state. The second cartridge-side restriction element 220 is located on the +Z-axis direction side and on the −X-axis direction side of the ink supply structure 280 and the circuit board 40.

The projection 260 on the third face 203 is located on the +Z-axis direction side of the first cartridge-side restriction portion 210. According to this embodiment, the projection 260 is located at the most +Z-axis direction position (most upward position) including the second side 291 on the third face 203.

The third cartridge-side restriction element 250 is structured as a pair of projection members (restriction walls) protruded in the +X-axis direction from both Y-axis direction sides of the seventh face 207. The pair of projection members 250 receive the projection 636 (FIG. 2) inserted therebetween and, in cooperation with the projection 636, restrict the motion of the cartridge 20 in the Y-axis direction in the attached state.

Figure 11:
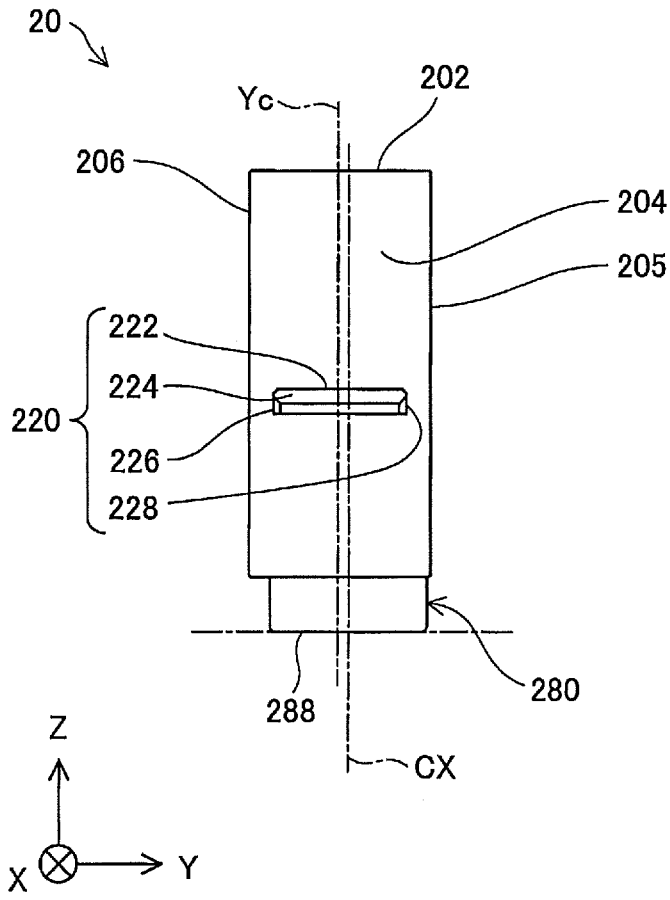
FIG. 11 is a rear view of the cartridge.

FIG. 11 is a rear view of the cartridge 20. The second cartridge-side restriction element 220 is described in detail with reference to FIG. 11. The second cartridge-side restriction element 220 includes a restriction locking surface 222 as a restriction locking element, a sloped surface 224, a first restriction side face 226 and a second restriction side face 228.

The restriction locking surface 222 faces in the +Z-axis direction and forms a horizontal face in the attached state. The restriction locking surface 222 is in contact with the second device-side restriction element 620 (FIG. 3) to serve as the pivot point of rotation when the cartridge 20 is turned to be detached from the holder 60.

The restriction locking surface 222 is locked by the second device-side restriction element 620 in the attached state, so as to restrict the motion of the cartridge 20 in the +Z-axis direction in the attached state. The restriction locking surface 222 is provided at the position intersecting the plane Yc passing through the center of the width (Y-axis direction length) of the cartridge 20 and perpendicular to this plane Yc. As shown in FIG. 5, in the attached state of the cartridge 20, the cartridge 20 receives the pressing forces Ps and Pt including the +Z-axis direction vector components from the holder 60. The restriction locking surface 222 is pressed against the second device-side restriction element 620 by these pressing forces Ps and Pt. The second device-side restriction element 620 is thus in contact with the restriction locking surface 222 in parallel with the Y-axis direction. This reduces the possibility that the cartridge 20 is tilted about the X axis in the attached state.

The sloped surface 224 is connected with the restriction locking surface 222 and is inclined to the direction including the +Z-axis direction vector component and the −X-axis direction vector component. This enables the restriction locking surface 222 to be smoothly guided to the second device-side restriction element 620 in attachment of the cartridge 20 to the holder 60.

The first restriction side face 226 forms a −Y-axis direction side face of the second cartridge-side restriction element 220. The second restriction side face 228 forms a +Y-axis direction side face of the second cartridge-side restriction element 220. The first restriction side face 226 is a plane facing in the −Y-axis direction, and the second restriction side face 228 is a plane facing in the +Y-axis direction. The first restriction side face 226 and the second restriction side face 228 are planes respectively parallel to the X-axis direction and the Z-axis direction. The first and the second restriction side faces 226 and 228 interfere with the second device-side restriction element 620 to restrict the motion of the cartridge 20 in the Y-axis direction in the attached state of the cartridge 20.

Figure 12:
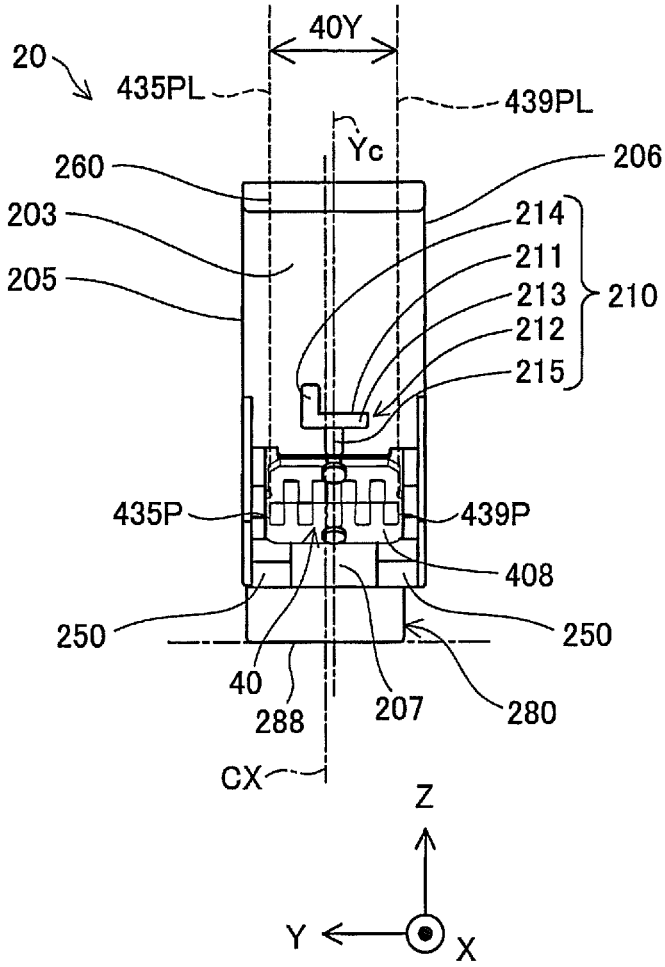
FIG. 12 is a front view of the cartridge.

FIG. 12 is a front view of the cartridge 20. The first cartridge-side restriction portion 210 is described more in detail with reference to FIG. 12. The first cartridge-side restriction portion 210 is provided at the position intersecting the plane Yc. The first cartridge-side locking surface 211 is provided at the position intersecting the plane Yc and perpendicular to this plane Yc.

The first cartridge-side locking surface 211 is located not outside but inside a range 40Y between the first outer part 435P and the second outer part 439P in the Y-axis direction (width direction), when the cartridge 20 is viewed from the third face 203-side in the −X-axis direction. According to this embodiment, the first cartridge-side restriction portion 210 including the first cartridge-side locking surface 211 is located not outside but inside the range 40Y. In other words, the first cartridge-side restriction portion 210 is located inside an area defined by a first phantom line 435PL including the first outer part 435P and a second phantom line 439PL including the second outer part 439P. The first phantom line 435PL and the second phantom line 439PL are straight lines extended in the Z-axis direction.

Figure 13:
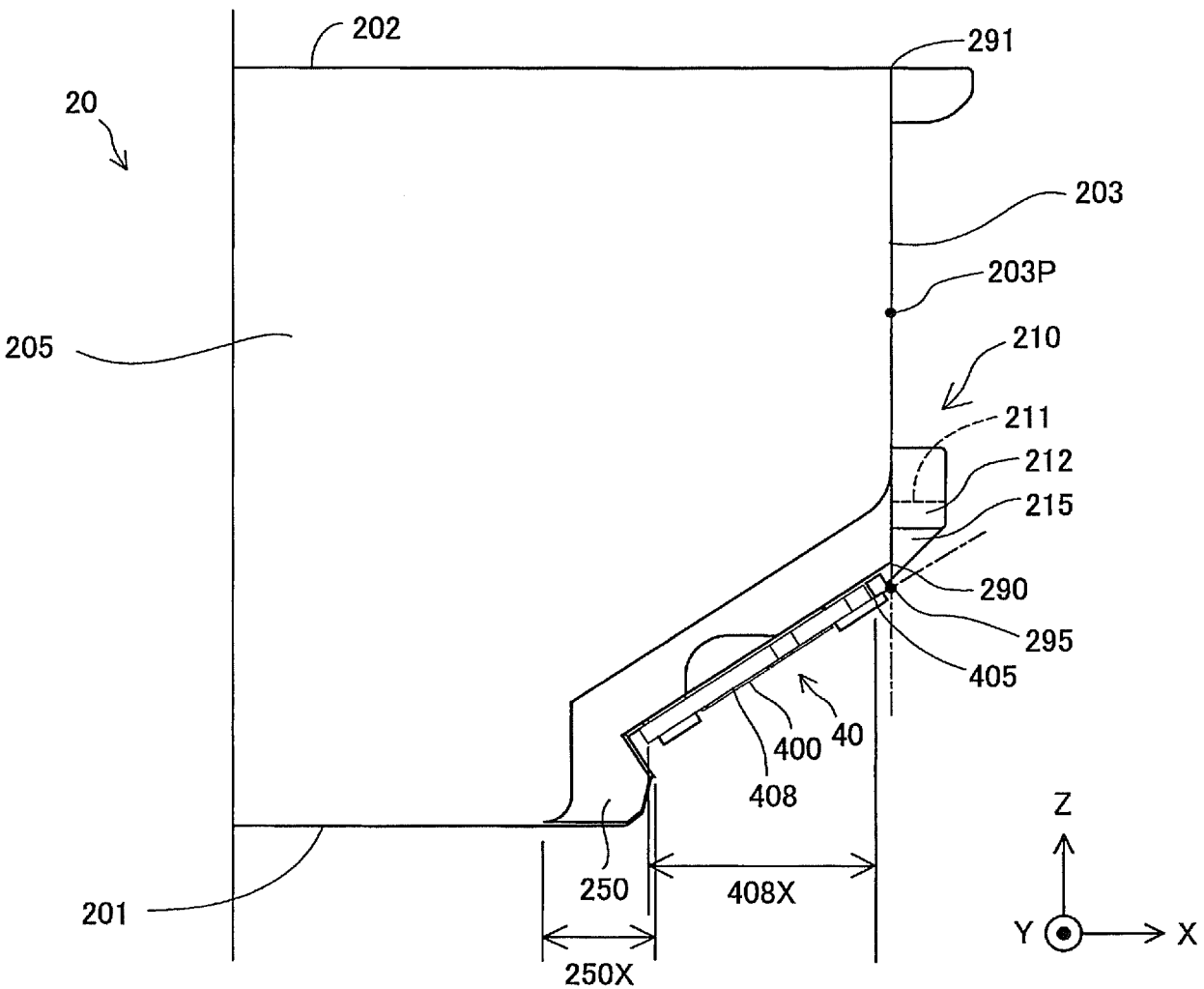
FIG. 13 is a left side view of the cartridge.

FIG. 13 is a left side view of the cartridge 20. The positional relationship of the respective members of the cartridge 20 is described with reference to FIG. 13. A part where the third face 203 intersects the sloped terminal bearing structure 408 is called "intersecting part 295". The intersecting part 295 is a line parallel to the Y-axis direction. According to this embodiment, the intersecting part 295 is located on a plane extended from the third face 203 in the −Z-axis direction. The intersecting part 295 is accordingly located on the −Z-axis direction side of the third face 203. The middle point in the Z-axis direction length on the third face 203 is called midpoint 203P.

The first cartridge-side restriction portion 210 is located close to the intersecting part 295. From another viewpoint, the first cartridge-side restriction portion 210 is located adjacent to the terminal bearing structure 408 and close to the board end 405. This means that the first cartridge-side restriction portion 210 can be sufficiently closer to the cartridge-side terminals 400. The first cartridge-side restriction portion 210 is provided preferably on a specific part of the third face 203 closer to the first side than the second side 291, i.e., the range from the midpoint 203P to the first side 290. It is especially preferable to provide the first cartridge-side restriction portion 210 at the position sufficiently close or proximate to the first side 290. As used herein, "proximate" can mean "close to," "near" or "on."

The effective part of the first cartridge-side restriction portion 210 specifically serving to restrict the position of the cartridge-side terminals 400 is the first cartridge-side locking surface 211. It is thus preferable to locate the first cartridge-side locking surface 211 as close as possible to the cartridge-side terminals 400. Omitting the third portion 215 of the first cartridge-side restriction portion 210 and locating the first portion 212 in contact with the first side 290 enables the first cartridge-side locking surface 211 to be closer to the intersecting part 295 or the board end 405.

FIG. 13 also shows an X-axis direction range 250X of the third cartridge-side restriction element 250 and an X-axis direction range 408X of the sloped terminal bearing structure 408. As clearly understood from this drawing, part of the third cartridge-side restriction element 250 overlaps with the sloped terminal bearing structure 408 in the X-axis direction, when the cartridge 20 is viewed from the first face 201-side in the +Z-axis direction.

A-4. Detailed Structure of Holder 60

A-4-1. General Structure of Holder 60

Figure 14:
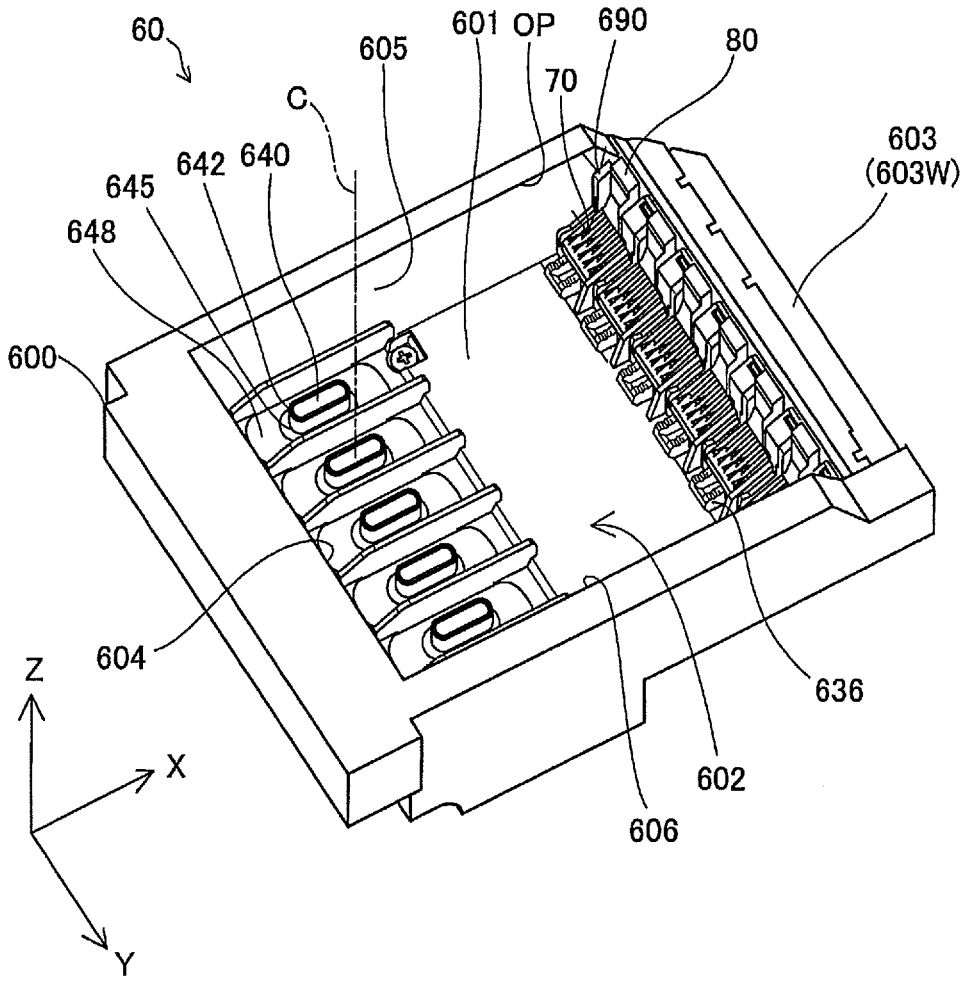
FIG. 14 is a perspective view illustrating the structure of the holder.
Figure 15:
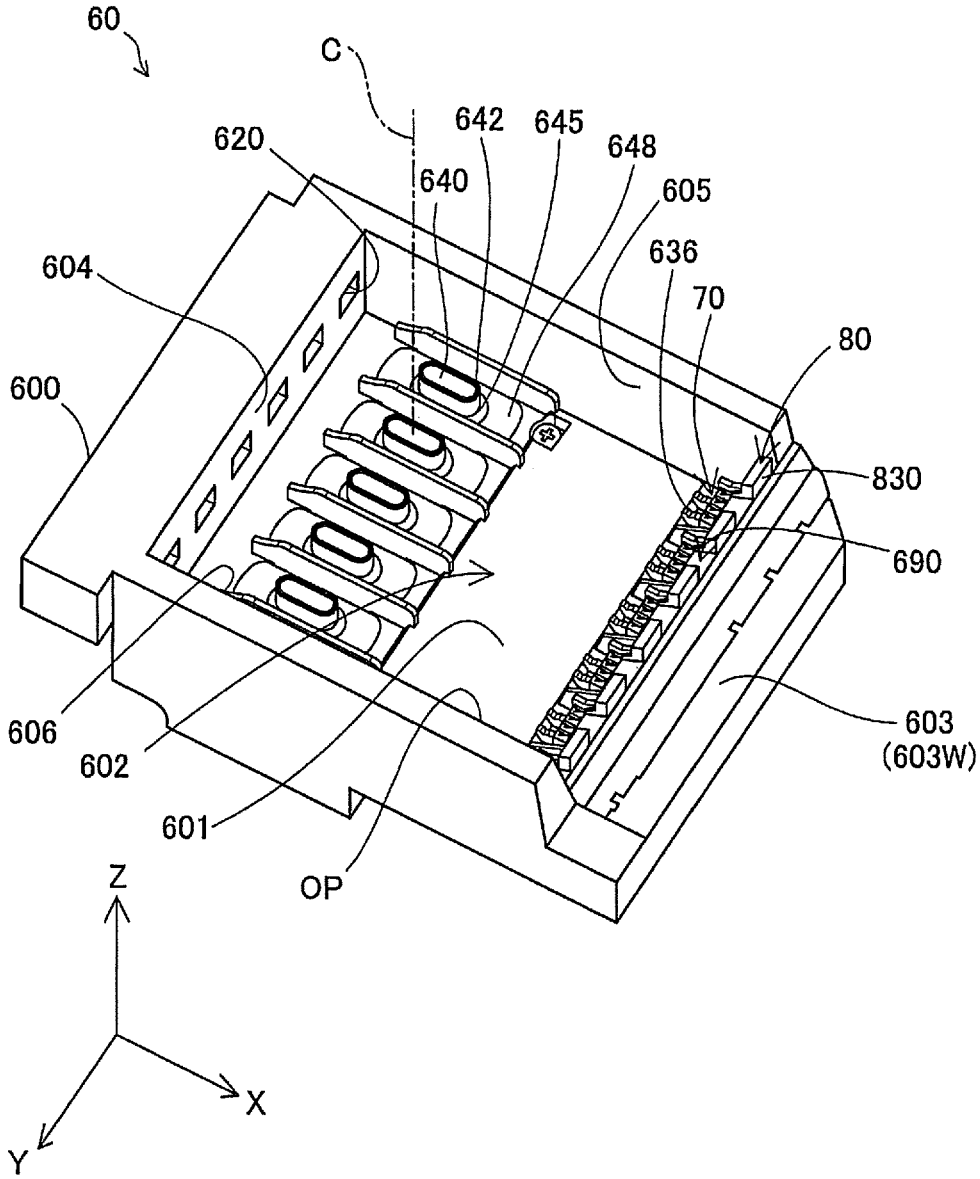
FIG. 15 is a perspective view illustrating the structure of the holder.
Figure 16:
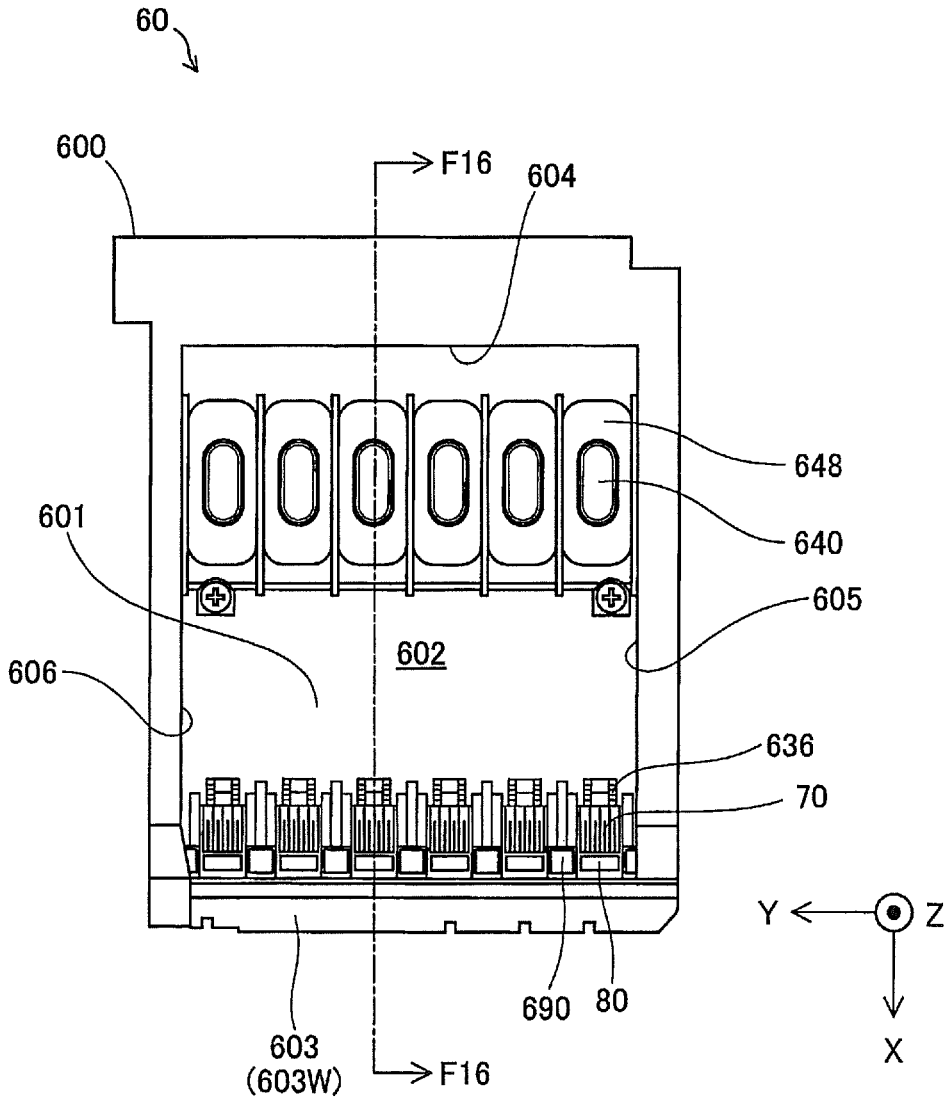
FIG. 16 is a top view illustrating the structure of the holder.
Figure 17:
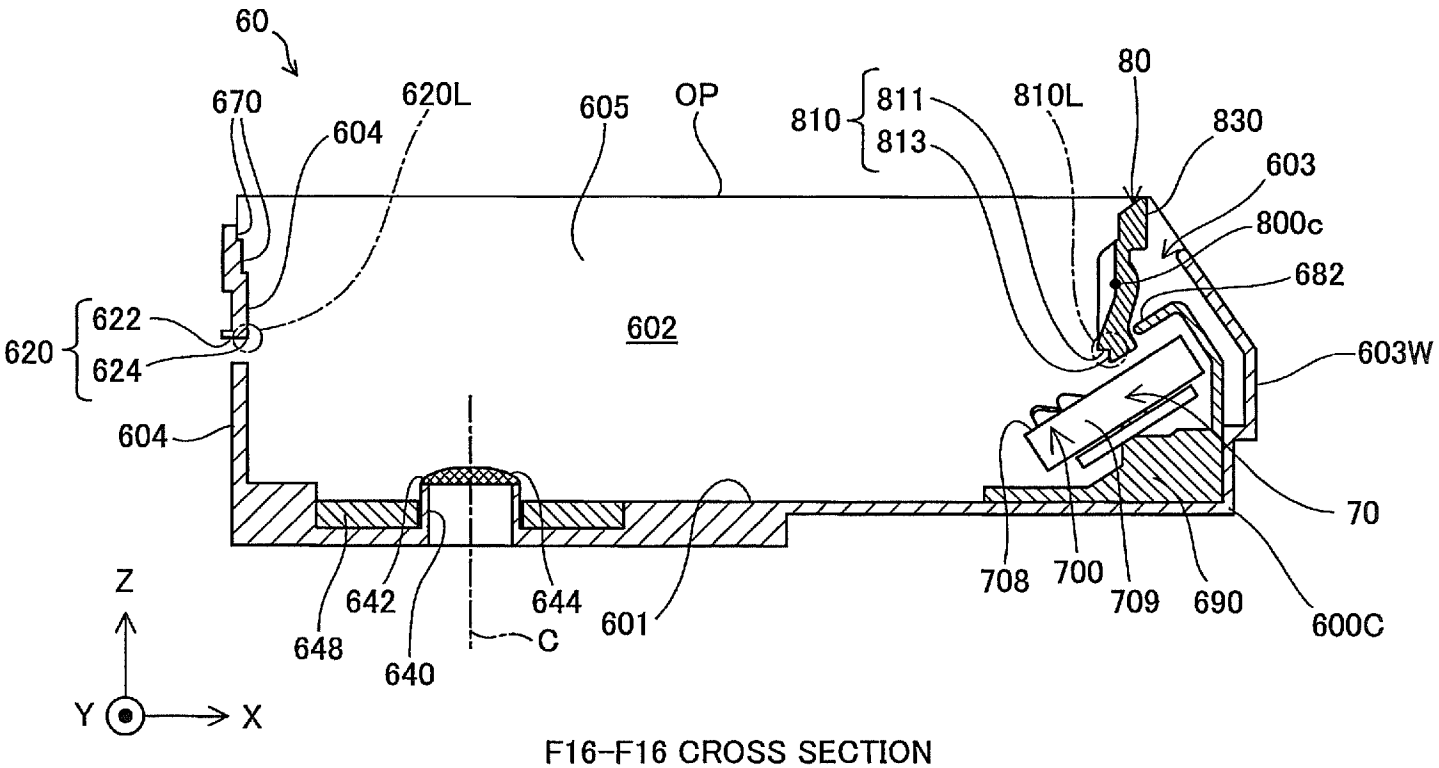
FIG. 17 is a sectional view, taken on line F16-F16 in FIG. 16.

FIGS. 14 and 15 are perspective views illustrating the structure of the holder 60. FIG. 16 is a top view illustrating the structure of the holder 60. FIG. 17 is a sectional view, taken on line F16-F16 in FIG. 16. The projection 636 shown in FIGS. 14 to 16 is omitted from the illustration of FIG. 17.

As described above, the holder 60 of the printer 50 has the five wall members 601, 603, 604, 605 and 606 to form the concave cartridge chamber 602 to receive the cartridge 20. The five wall members 601, 603, 604, 605 and 606 are collectively called "chamber-forming wall members 600". According to this embodiment, the five wall members 601, 603, 604, 605 and 606 are resin plate members and are made of a synthetic resin, more specifically modified polyphenylene ether (m-PPE).

The wall member 601 forms the bottom face of the concave cartridge chamber 602. The wall members 603, 604, 605 and 606 form the side faces of the concave cartridge chamber 602. The wall member 601, the wall member 603, the wall member 604, the wall member 605 and the wall member 606 are respectively called "device-side bottom wall member 601", "first device-side side wall member 603", "second device-side side wall member 604", "third device-side side wall member 605" and "fourth device-side side wall member 606".

Each of the printing material supply tubes 640 and each of the contact mechanisms 70 including the device-side terminals are arrayed in the X-axis direction on the wall member 601. The printing material supply tube 640 is located on the side of the wall member 604, and the contact mechanism 70 is located on the side of the wall member 603. In other words, the printing material supply tube 640 is provided at the position closer to the wall member 604 than the wall member 603. The contact mechanism 70 is provided at the position closer to the wall member 603 than the printing material supply tube 640.

The elastic member 648 is provided around the printing material supply tube 640 on the wall member 601. As described above with reference to FIG. 5, the elastic member 648 seals the periphery of the ink supply structure 280 the cartridge 20 and thereby prevents leakage of ink from the ink supply structure 280 to the periphery in the attached state of the cartridge 20 to the holder 60. The elastic member 648 generates the pressing force Ps in the direction of pressing back the ink supply structure 280 of the cartridge 20 (in the +Z-axis direction) in the attached state of the cartridge 20 to the holder 60 (FIG. 5).

As shown in FIGS. 14 to 16, holder 60 has an opening OP on the upper side opposed to the wall member 601 across the cartridge chamber 602. The cartridge 20 passes through the opening Op when the cartridge 20 is attached to or detached from the holder 60.

The wall member 603 is vertically-angled relative to the wall member 601 on the +X-axis direction side of the wall member 601. According to this embodiment, the most +X-axis direction side of the wall member 603 forms an outer wall 603W. In the use attitude of the printer 50, the outer wall 603W forms the front face of the holder 60. The outer wall 603W is extended in the direction of the array of the plurality of cartridges 20 (Y-axis direction). A lever 80 used for attachment and detachment of the cartridge 20 is provided on the wall member 603. A lever 80 is fixed in a rotatable manner to the wall member 603 via a retainer 690. In other words, lever 80 is fixed to the retainer 690 forming part of the wall member 603. An axis of rotation of the lever 80 is parallel to the Y-axis direction.

The retainer 690 is provided at a corner section (device-side corner section) 600C (FIG. 17) where the side wall member 603 intersects the bottom wall member 601.

As shown in FIG. 5, the operating member 830 is provided on the +Z-axis direction end of the lever 80. When the user presses this operating member 830 from the +X-axis direction side toward the −X-axis direction side (i.e., when the user applies the operating force Pr to the operating member 830), the lever 80 is turned counterclockwise (seen from the +Y-axis direction) about the axis of rotation. The lever 80 is accordingly rotated on the XZ plane parallel to the X-axis direction and the Z-axis direction.

The lever 80 is provided as a separate member from the chamber-forming wall members 601, 603, 604, 605 and 606. The lever 80 is made of a synthetic resin, more specifically polyacetal (POM) according to this embodiment. The lever 80 has a certain level of rigidity sufficient to lock the cartridge 20. More specifically, the lever 80 preferably has rigidity that causes no substantial deformation of the lever 80 by a force (for example, force of 14.4 N) applied from the cartridge 20 in the attached state. For example, the deformation of the lever 80 by application of an external force of 14.4N from the cartridge 20 is preferably not greater than about 0.5 mm. The lever 80 preferably does not have any elastically deformable portion. This reduces the possibility that the lever 80 is significantly deformed by the force applied from the cartridge 20 in the attached state of the cartridge 20 and ensures the stable electrical connection between the cartridge-side terminals 400 and the device-side terminals of the contact mechanism 70. Providing the separate lever 80 from the chamber-forming wall members 601, 603, 604, 605 and 606 advantageously increases the degree of freedom in selection of the material for the lever 80.

Referring back to FIGS. 14 to 17, the wall member 604 is vertically-angled relative to the wall member 601 on the −X-axis direction side of the wall member 601. The wall member 604 is opposed to the wall member 603 across the cartridge chamber 602. According to this embodiment, the wall member 604 forms the rear face of the holder 60 in the use attitude of the printer 50. The wall member 604 is extended in the direction of the array of the plurality of cartridges 20 (Y-axis direction). The second device-side restriction element 620 is provided on the wall member 604. The second device-side restriction element 620 is a through hole passing through the X-axis direction (FIG. 17). According to another embodiment, the second device-side restriction element 620 may be a recess open to the cartridge chamber 602.

As described above with reference to FIG. 5, the second device-side restriction element 620 is configured to engage with the second cartridge-side restriction element 220. The second device-side restriction element 620 serves as a guide for attachment and detachment of the cartridge 20 to and from the holder 60. The second device-side restriction element 620 locks the second cartridge-side restriction element 220 in the attached state of the cartridge 20 to the holder 60. More specifically, the second device-side restriction element 620 locks the second cartridge-side restriction element 220 at the second locking position 620L located on the +Z-axis direction side and on the −X-axis direction side of the printing material supply tube 640. According to this embodiment, the second device-side restriction element 620 is structured as a through hole having the size to receive the second cartridge-side restriction element 220 and has a device-side locking surface 622. The device-side locking surface 622 is a plane facing in the −Z-axis direction and locks the restriction locking surface 222 of the second cartridge-side restriction element 220 (FIG. 11). A +X-axis direction end 624 of the device-side locking surface 622 is in contact with the second cartridge-side restriction element 220 and accordingly serves as the pivot point of rotation for detachment of the cartridge 20 from the holder 60.

As shown in FIG. 17, the second device-side side wall member 604 of the holder 60 has a space 670 provided on the +Z-axis direction side of the second device-side restriction element 620. The space 670 provides a room to allow rotation of the cartridge 20 about the vicinity of the second device-side restriction element 620 as the pivot point of rotation when the cartridge 20 is attached to or detached from the holder 60. According to this embodiment, the space 670 is formed by steps recessed in the −X-axis direction stepwise in the +Z-axis direction from the second device-side side wall member 604. According to another embodiment, the space 670 may be formed by a sloped surface of the wall member 604 lowered in the −X-axis direction gradually in the +Z-axis direction.

As shown in FIGS. 14 to 16, the wall member 605 is vertically-angled relative to the wall member 601 on the −Y-axis direction side of the wall member 601. According to this embodiment, the wall member 605 forms the right side face of the holder 60 in the use attitude of the printer 50. The wall member 605 is connected with the wall members 603 and 604. The wall member 605 is extended in the X-axis direction and crosses the direction of the array of the plurality of cartridges 20 (Y-axis direction).

The wall member 606 is vertically-angled relative to the wall member 601 on the +Y-axis direction side of the wall member 601. The wall member 606 is opposed to the wall member 605 across the cartridge chamber 602. According to this embodiment, the wall member 606 forms the left side face of the holder 60 in the use attitude of the printer 50. The wall member 606 is connected with the wall members 603 and 604. The wall member 606 is extended in the X-axis direction and crosses the direction of the array of the plurality of cartridges 20 (Y-axis direction).

According to the positional relationships of the wall members 601 and 603 to 606 described above, the wall member 601 is perpendicular to the Z-axis direction; the wall member 603 and the wall member 604 are opposed to each other in the X-axis direction; the wall member 605 and the wall member 606 are opposed to each other in the Y-axis direction; and the wall member 601 and the opening OP are opposed to each other in the Z-axis direction.

The contact mechanism 70 is provided at the corner section 600C where the wall member 601 intersects the wall member 603 of the holder 60. The contact mechanism 70 is located at the position closer to the wall member 603 than the printing material supply tube 640. The contact mechanism 70 includes a plurality of device-side terminals corresponding to and in contact with the respective terminals 431 to 439 of the cartridge-side terminals 400 (FIG. 10), and a terminal base on which the plurality of device-side terminals are located.

A-4-2. Detailed Structure of Contact Mechanism 70

Figure 18:
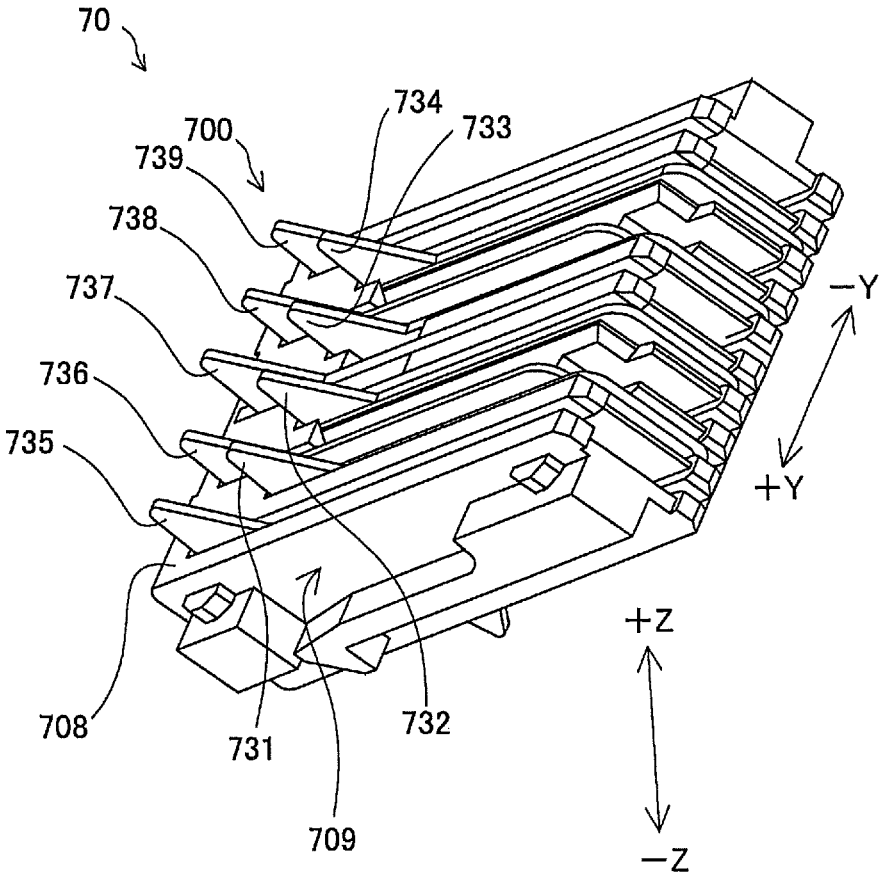
FIG. 18 is a perspective view of a contact mechanism.

FIG. 18 is a perspective view of the contact mechanism 70, which is detached from the holder 60.

The contact mechanism 70 includes a terminal base 709 and device-side terminals or contact forming members 731 to 739 located on the terminal base 709. Each of the device-side terminals 731 to 739 is an elastic member having electrical conductivity and has a protruded portion from a device-side sloped surface 708, which is displaced by an external force. The device-side terminals 731 to 739 generate the pressing or elastic force Pt in the direction of pressing back the circuit board 40 of the cartridge 20 (direction including the +Z-axis direction vector component and the −X-axis direction vector component) in the attached state of the cartridge 20 to the holder 60 (FIG. 5). The elastic force Pt is generated as a reaction force when the cartridge 20 presses the device-side terminals 731 to 739 protruded from the device-side sloped surface 708 toward the device-side sloped surface 708. The resulting vector component of the elastic force PT generated by the device-side terminals 731 to 739 urges the cartridge 20 in the removal direction RD, which is the direction opposite the mounting direction SD as described above.

The nine device-side terminals 731 to 739 are provided at the positions corresponding to the nine cartridge-side terminals 431 to 439. The device-side terminal 731 is called "attachment detection terminal (third terminal) 731". The device-side terminal 732 is called "reset terminal 732". The device-side terminal 733 is called "clock terminal 733". The device-side terminal 734 is called "attachment detection terminal (fourth terminal) 734". The device-side terminal 735 is called "attachment detection terminal (first terminal) 735". The device-side terminal 736 is called "power terminal 736". The device-side terminal 737 is called "ground terminal 737". The device-side terminal 738 is called "data terminal 738". The device-side terminal 739 is called "attachment detection terminal (second terminal) 739". For differentiation from the cartridge-side terminals, the word "device-side" may be prefixed to each name. For example, the "ground terminal 737" may be called "device-side ground terminal 737". The nine device-side terminals 731 to 739 are collectively called device-side terminals 700.

The nine device-side terminals 731 to 739 are arrayed in a first device-side terminal line and a second device-side terminal line having different positions in the Z-axis direction. The first device-side terminal line includes the five device-side terminals 735 to 739, and the second device-side terminal line includes the four device-side terminals 731 to 734. The first device-side terminal line is located on the −Z-axis direction side of the second device-side terminal line. The number of the device-side terminals is not limited to nine but may be varied to any desired number greater than nine or less than nine according to the structure of the circuit board 40.

Among the nine device-side terminals 731 to 739, the device-side ground terminal 737 located on the substantial center in the Y-axis direction is electrically connected with a ground line (not shown). The height of the device-side ground terminal 737 protruded from the device-side sloped surface 708 is greater than the height of the other device-side terminals 731 to 736, 738 and 739. The device-side ground terminal 737 is accordingly in contact with the circuit board 40 of the cartridge 20 prior to the other device-side terminals 731 to 736, 738 and 739.

According to this embodiment, in order to accelerate assembling the printer, the device-side terminals 731 to 739 are located on the terminal base 709 and are unitized to the contact mechanism 70, which is incorporated in the holder 60. The unitized contact mechanism 70 using the terminal base 709 is, however, not essential. According to another embodiment, a suitable structure for receiving the device-side terminals 731 to 739 may be formed integrally with the bottom wall member 601 or the outer wall 603W of the holder 60, and the device-side terminals 731 to 739 may be incorporated in the structure. The terminal base 709 is accordingly not essential.

A-4-3. Detailed Structure of Lever 80

Figure 19:
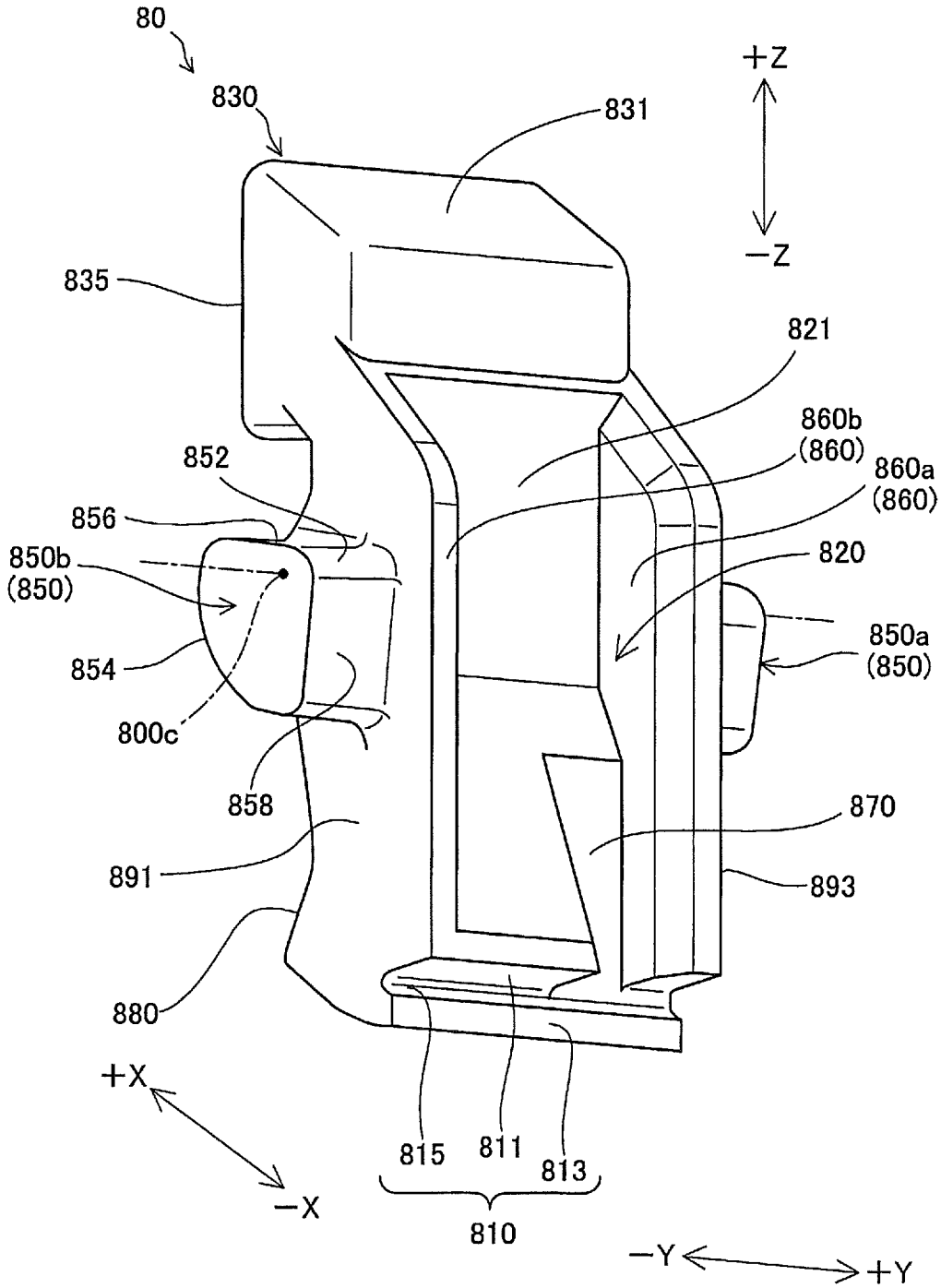
FIG. 19 is a perspective view illustrating the appearance of a lever.
Figure 20:
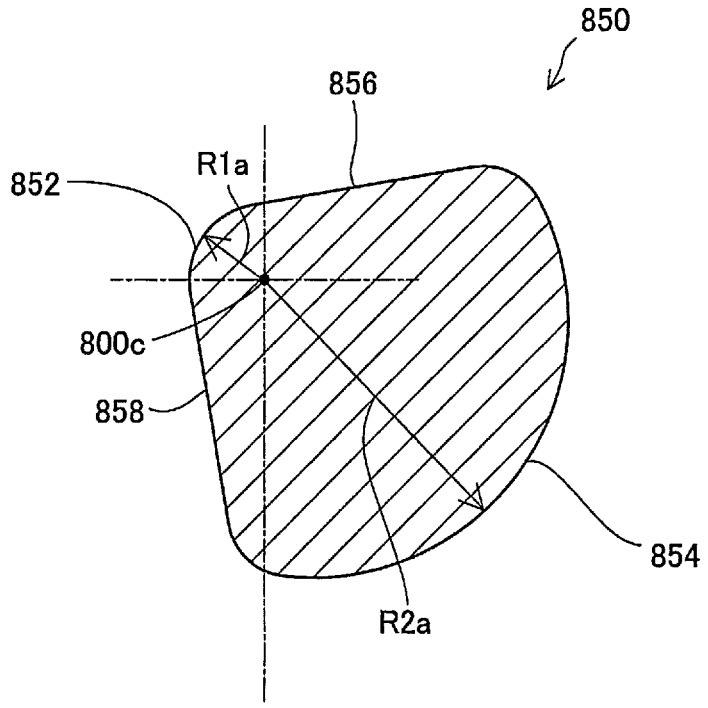
FIG. 20 illustrates a cross section of a shaft body of the lever taken on a plane parallel to the X axis and the Z axis.
Figure 21:
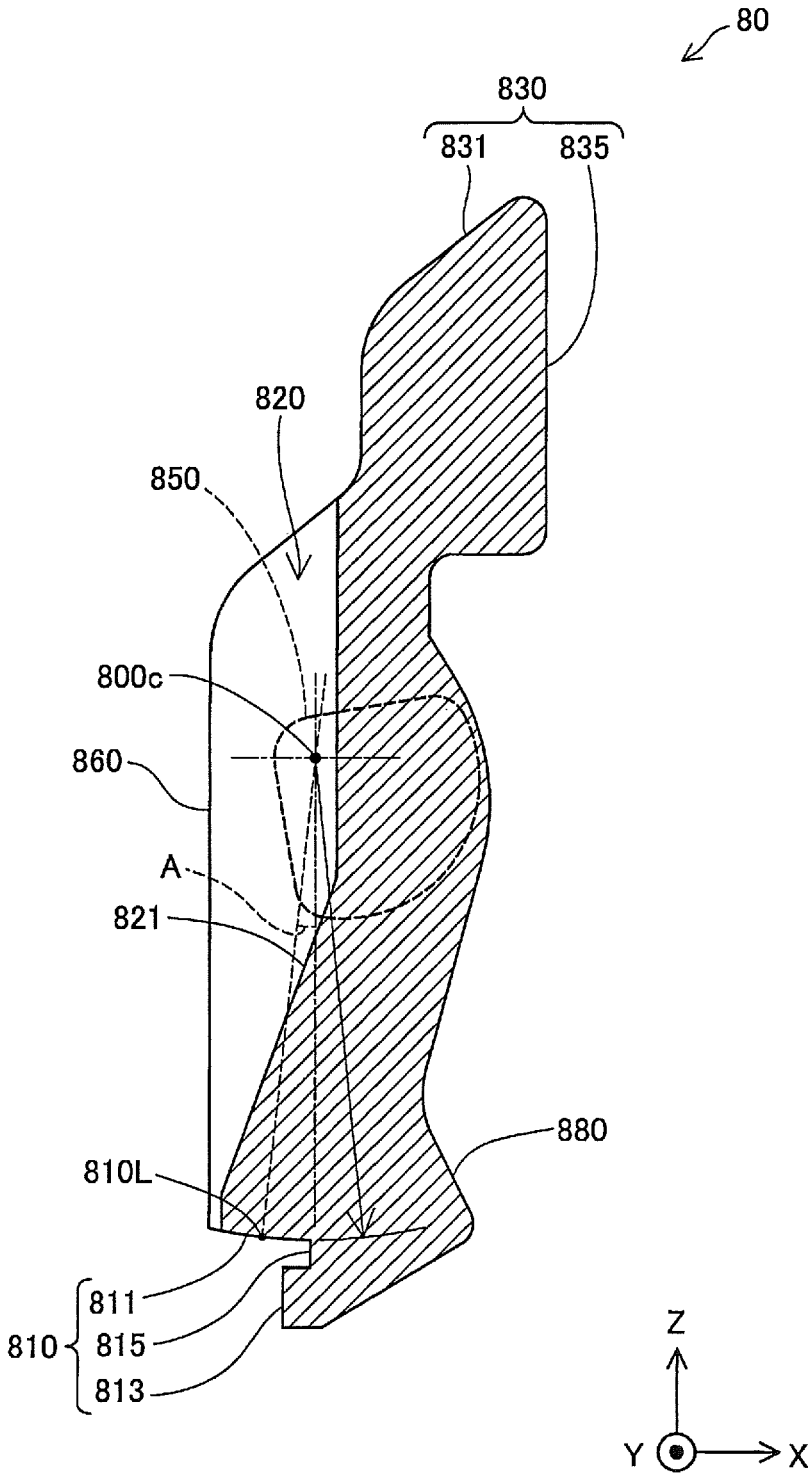
FIG. 21 is a sectional view of the lever.

FIG. 19 is a perspective view illustrating the appearance of the lever 80. FIG. 20 illustrates a cross section of a shaft body 850 taken on the plane parallel to the X axis and the Z axis (XZ plane, plane perpendicular to the Y axis). FIG. 21 illustrates a cross section of the lever 80 taken on the plane that passes through the central region in the width direction (Y-axis direction) of the lever 80 and is parallel to the X axis and the Z axis (XZ plane, plane perpendicular to the Y axis). FIG. 21 shows the cross section of the lever 80 in the state that the cartridge 20 is properly attached at the designed attachment position of the holder 60.

As shown in FIGS. 19 and 21, the lever 80 includes the operating member 830, a pair of shaft bodies 850, a guide member 820, and the engagement portion 810. The lever 80 has the operating member 830 on one end (+Z-axis direction end) and the engagement portion 810 on the other side (−Z-axis direction end). The lever 80 has an axis of rotation 800*c* between the operating member 830 and the first device-side restriction member 810. In other words, the lever 80 pivots around the axis of rotation 800*c* at the position between the operating member 830 and the engagement portion 810.

The operating member 830 of the lever 80 receives the external force applied by the user. As shown in FIG. 21, the operating member 830 is provided at the +Z-axis direction end of the lever 80. The operating member 830 is located on the +Z-axis direction side of the axis of rotation 800*c* in the attached state of the cartridge 20 to the holder 60. The operating member 830 is located on the +Z-axis direction side of the first device-side side wall member 603 of the holder 60 (FIG. 15).

The operating member 830 has an operation surface 835 and an operating-member opposed surface 831. The operation surface 835 receives the external force (force Pr shown in FIG. 5) applied by the user from the +X-axis direction side to the −X-axis direction side for detachment of the cartridge 20 from the holder 60. The operating-member opposed surface 831 is a face opposed to the cartridge 20 in the attached state of the cartridge 20 to the holder 60.

As shown in FIG. 19, the pair of shaft bodies 850 are provided at the substantially middle position between the ends of the lever 80. The pair of shaft bodies 850 define the axis of rotation 800*c* of the lever 80. The axis of rotation 800*c* is parallel to the Y-axis direction (direction of the array of the cartridges 20). One shaft body 850*a* of the pair of shaft bodies 850 (called "first shaft body 850*a*") is protruded in the +Y-axis direction from an outer surface 893 on the +Y-axis direction side of the lever 80. The other shaft body 850*b* of the pair of shaft bodies 850 (called "second shaft body 850*b*") is protruded in the −Y-axis direction from an outer surface 891 on the −Y-axis direction side of the lever 80. The outer surfaces 891 and 893 are also called side faces 891 and 893. The pair of shaft bodies 850 provided on the lever 80 readily define the axis of rotation 800*c* by using a retainer as described later.

According to this embodiment, each of the shaft bodies 850 has an inner arc-shaped surface 852, an outer arc-shaped surface 854, and radial side faces 856 and 858. The respective faces 852, 854, 856 and 858 form the circumferential surface of the shaft body 850. The inner arc-shaped surface 852 and the outer arc-shaped surface 854 are respectively called "first curved surface 852" and "second curved surface 854". The centers of the inner arc-shaped surface 852 and the outer arc-shaped surface 854 correspond to the axis of rotation 800*c*. The inner arc-shaped surface 852 is located at the position closer to the second device-side side wall member 604 than (i.e., on the −X-axis direction side of) the outer arc-shaped surface 854.

As shown in FIG. 20, the inner arc-shaped surface 852 forms an arc of radius R1*a* about the axis of rotation 800*c* on the cross section parallel to the X axis and the Z axis. The outer arc-shaped surface 854 forms an arc of radius R2*a* about the axis of rotation 800*c* on the cross section parallel to the X axis and the Z axis. The radius R1*a* is smaller than the radius R2*a*. As described above, each shaft body 850 has the concentric inner arc-shaped surface 852 and outer arc-shaped surface 854, which is located at the position closer to the second device-side side wall member 604 than the outer arc-shaped surface 854, as part of the circumferential surface. The axis of rotation 800*c* can thus be located at the closer position to the cartridge 20 in the cartridge chamber 602 without interfering with the cartridge 20. This enables the engagement portion 212 of the first restriction portion 210 of the cartridge 20 to be locked by the engagement portion 810, while reducing a deviation from the first locking position 810L. If the axis of rotation 800*c* were located at the distant position from the cartridge 20, any shift of the lever 80 from the attachment position designed for the correctly mounted state of the cartridge 20 causes a significant displacement of the engagement portion 810 in the Z-axis direction. Locating the axis of rotation 800*c* at the closer position from the cartridge 20 advantageously reduces the displacement of the engagement portion 810 in the Z-axis direction when the lever 80 is shifted from the standard attitude in the state of the cartridge 20 properly attached at the designed attachment position. Namely such positioning enables the cartridge 20 to be locked by the engagement portion 810 with the less deviation from the first locking position 810L. Setting the greater radius R2*a* of the outer arc-shaped surface 854 than the radius R1*a* of the inner arc-shaped surface 852 advantageously prevents the strength degradation of the shaft body 850. The "locking position (first locking position) 810L" means the position where a first device-side locking surface 811 (first part of the engagement portion 810) abuts the first cartridge-side locking surface 211 (first abutting part of the first cartridge-side restriction portion 210) when the cartridge 20 is attached at the attachment position set as the ideal designed position.

The engagement portion 810 serves to lock the cartridge 20 in the attached state and restrict the motion of the cartridge 20. As shown in FIG. 21, the engagement portion 810 is provided on the −Z-axis direction end of the lever 80. The engagement portion 810 is located on the −Z-axis direction side of the axis of rotation 800*c* in the attached state of the cartridge 20 to the holder 60.

As shown in FIG. 21, the engagement portion 810 locks the first cartridge-side restriction portion 210 (FIG. 5) by two parts. The engagement portion 810 includes the first device-side locking surface 811 as the first part (the first device-side restriction element), a groove 815 and a second device-side locking surface 813 as the second part (the second device-side restriction element). According to this embodiment, the two device-side locking surfaces 811 and 813 of the engagement portion 810 are located to intersect each other.

The first device-side locking surface 811 is a curved surface in an arc shape around the axis of rotation 800*c*. The first device-side locking surface 811 accordingly has the arc shape around the axis of rotation 800*c* on the cross section parallel to the X axis and the Z axis (i.e., cross section parallel to the XZ plane, cross section perpendicular to the Y axis). For attachment of the cartridge 20 to the holder 60, this structure enables the first device-side locking surface 811 to be smoothly moved to the locking position 810L and lock the cartridge 20. For detachment of the cartridge 20 from the holder 60, this structure enables the first device-side locking surface 811 to smoothly unlock the cartridge 20. This structure accordingly ensures smooth attachment and detachment of the cartridge 20 to and from the holder 60.

At the locking position (first locking position) 810L, the first device-side locking surface 811 is close to the axis of rotation 800*c* in the X-axis direction. In other words, at the locking position (first locking position) 810L, the first device-side locking surface 811 is located approximately beneath the axis of rotation 800*c* according to this embodiment. More specifically, at the locking position (first locking position) 810L, the first device-side locking surface 811 is located on the slightly −X-axis direction side of the axis of rotation 800*c*. At the locking position 810L, the first device-side locking surface 811 accordingly defines a plane intersecting at an approximately right angle the +Z-axis direction force which the cartridge 20 in the attached state receives from the device-side terminals 700 and the elastic member 648. According to this embodiment, the plane in contact with the first device-side locking surface 811 as the curved surface is a substantially horizontal plane at the locking position 810L. This reduces the possibility of releasing the engagement between the first cartridge-side locking surface 211 and the first device-side locking surface 811 while the cartridge 20 is mounted in the printer. The first locking position 810L in the X-axis direction is thus preferably the position close to the axis of rotation 800*c* and on the −X-axis direction side of the axis of rotation 800*c*. This makes the plane in contact with the first device-side locking surface 811 substantially horizontal and prevents application of the +X-axis direction force from the cartridge 20 in the attached state to the first device-side locking surface 811. Locating the first locking position 810L close to the axis of rotation 800*c* in the X-axis direction advantageously reduces a deviation of the locking position in the Z-axis direction even when the actual locking position of the first cartridge-side locking surface 211 and the first device-side locking surface 811 is slightly deviated from the first locking position 810L. In other words, this reduces the deviation of the cartridge 20 in the Z-axis direction relative to the holder 60 and ensures the good electrical connection of the cartridge-side terminals 400 with the device-side terminals 700. For example, on the cross section of the lever 80 taken on the plane parallel to the X axis and the Z axis, the first locking position 810L should be located, such that an angle A between the straight line passing through the axis of rotation 800*c* and parallel to the Z-axis direction and the straight line connecting the axis of rotation 800*c* with the first locking position 810L is preferably not greater than 15 degrees, more preferably not greater than 10 degrees, and further preferably not greater than 5 degrees. The angle A is also preferably not less than 1 degree.

As shown in FIG. 19, the guide member 820 is provided between the operating member 830 and the engagement portion 810 to be extended from the +Z-axis direction end to the −Z-axis direction end. The guide member 820 serves to guide the first cartridge-side restriction portion 210 (shown in FIG. 12) to the engagement portion 810, while restricting the motion of the cartridge 20 in the Y-axis direction in the course of attachment of the cartridge 20 to the holder 60. The cartridge 20 can thus be properly attached at the designed attachment position.

The guide member 820 is a recess formed by a guide bottom wall 821 provided along the Y-axis direction and a pair of guide walls 860 being vertically-angled toward the −X-axis direction from the guide bottom wall 821. The guide bottom wall 821 and the pair of guide walls 860 readily form the recess to receive the first cartridge-side restriction portion 210 structured as the projection. The pair of guide walls 860 include a first guide wall 860*a* provided on the +Y-axis direction side and a second guide wall 860*b* provided on the −Y-axis direction side. The shaft body 850*a* is located on the outer surface 893 of the first guide wall 860*a*, whilst the shaft body 850*b* is located on the outer surface 891 of the second guide wall 860*b*.

The space between the two guide walls 860*a* and 860*b*, i.e., the distance between the inner surfaces of the two guide walls 860*a* and 860*b*, is less than the Y-axis direction length of the cartridge 20 but is greater than the Y-axis direction length of the first cartridge-side restriction portion 210 (as can be seen in FIG. 12). For attachment of the cartridge 20 to the holder 60, the first cartridge-side restriction portion 210 is received by the guide member 820 and is readily and securely guided to the engagement portion 810, while the pair of guide walls 860*a* and 860*b* restrict the motion of the cartridge 20 in the Y-axis direction and the guide bottom wall 821 restricts the motion of the cartridge 20 in the Z-axis direction.

One part of the guide bottom wall 821 on the side of the engagement portion 810 has a groove 870 configured to receive the second portion 214 of the first cartridge-side restriction portion 210 (FIG. 12). The groove 870 is recessed from the surface of the guide bottom wall 821 in the +X-axis direction. The groove 870 is extended from the middle in the +Z-axis direction of the guide bottom wall 821 to its −Z-axis direction end.

The lever 80 set on the holder 60 is configured to move the first device-side locking surface 811 to the first locking position 810L by its dead weight. The lever 80 is tilted to locate the first device-side locking surface 811 on the −X-axis direction side of the axis of rotation 800*c* (FIG. 21), when the shaft bodies 850 are retained by the retainer 690. According to one embodiment, the lever 80 may be tilted by locating the center of gravity of the lever 80 on the −Z-axis direction side and on the −X-axis direction side of the axis of rotation 800*c*. According to another embodiment, the lever 80 may be tilted by locating the center of gravity of the lever 80 on the +Z-axis direction side and on the +X-axis direction side of the axis of rotation 800*c*.

A-4-4. Detailed Structure of Retainer 690

Figure 22:
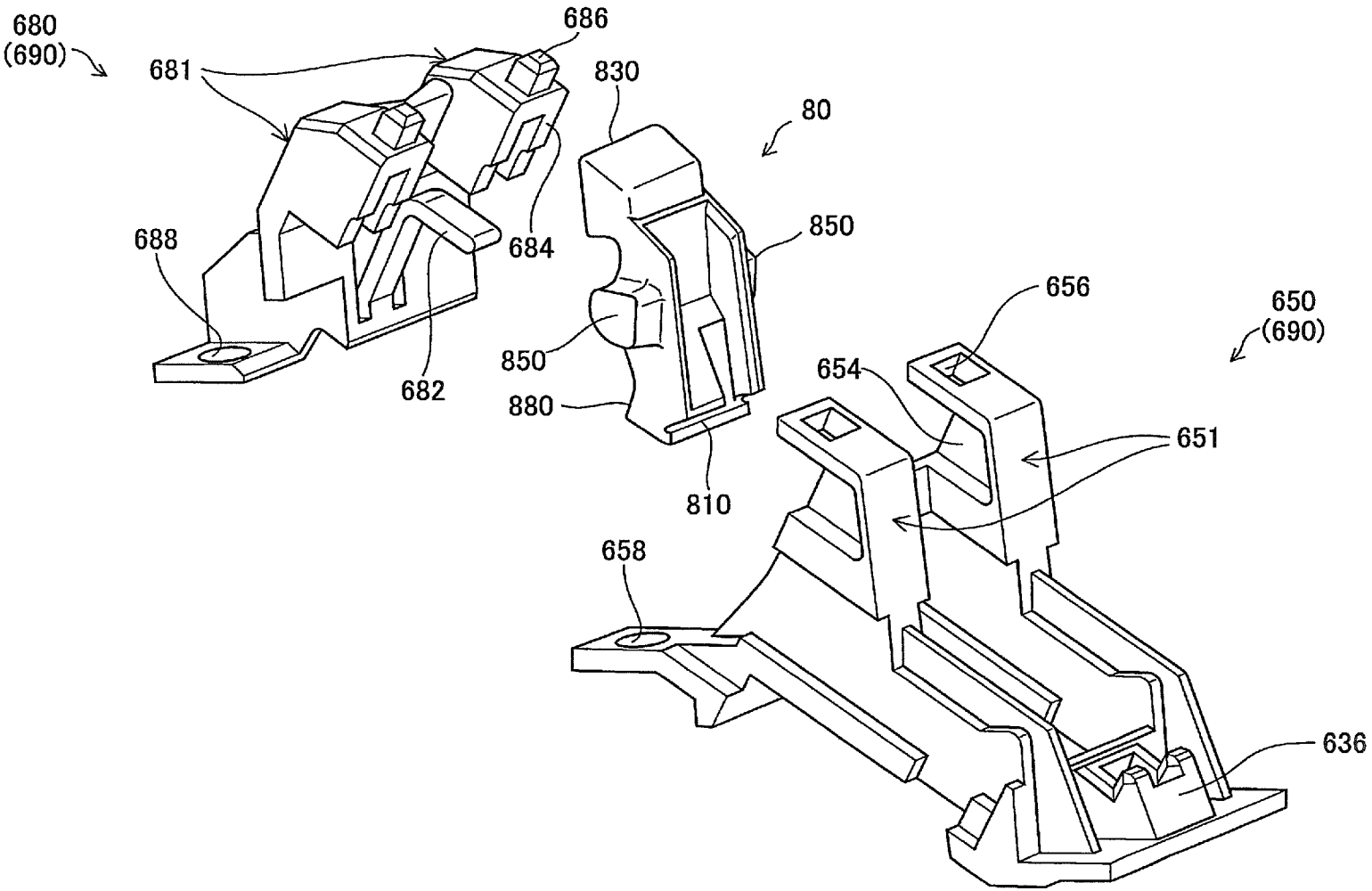
FIG. 22 is an exploded perspective view of a retainer and a perspective view of the lever.

FIG. 22 is an exploded perspective view of the retainer 690 and a perspective view of the lever 80. The lever 80 is retained by the retainer 690, so as to be attached to the holder 60 in a rotatable manner. FIG. 22 shows partial structure of the retainer 690 to retain the lever 80. The retainer 690 is structured by a combination of a first retainer member 650 and a second retainer member 680. The retainer 690 is made of a synthetic resin, more specifically ABS resin according to this embodiment.

The first retainer member 650 has a pair of standing portions 651 and a through hole 658. According to this embodiment, the first retainer member 650 also has the projection 636 serving as the third device-side restriction element.

The pair of standing portions 651 of the first retainer member 650 are arranged across a space for receiving the lever 80. Each of the standing portions 651 has a bearing element 654 to receive the shaft body 850 of the lever 80. According to this embodiment, each of the standing portions 651 also has an engagement hole 656 serving to engage the second retainer member 680.

The second retainer member 680 has a pair of standing portions 681 and a through hole 688. According to this embodiment, the second retainer member 680 also has an elastic member 682.

The pair of standing portions 681 of the second retainer member 680 are arranged across the same space as that between the pair of standing portions 651 of the first retainer member 650. Each of the standing portions 681 has a block surface 684 to block the bearing element 654, in order to prevent the shaft body 850 of the lever 80 from being unintentionally uncoupled from the bearing element 654. According to this embodiment, each of the standing portions 681 also has an engagement projection 686 to be fit in the engagement hole 656 of the first retainer member 650.

For attachment of the lever 80 to the holder 60, the lever 80 is located between the pair of standing portions 651 by setting the respective shaft bodies 850 of the lever 80 into the corresponding bearing elements 654 of the pair of standing portions 651 of the first retainer member 650. Subsequently the two retainer members 650 and 680 are assembled, so that the bearing elements 654 with the shaft bodies 850 of the lever 80 fit therein are blocked by the corresponding block surfaces 684 of the second retainer member 680. The first and second retainer members 650 and 680 are then fixed to the wall of the holder 60, for example, with screws set in the through holes 658 and 688. This attaches the lever 80 to the holder 60 in a rotatable manner.

Figure 23:
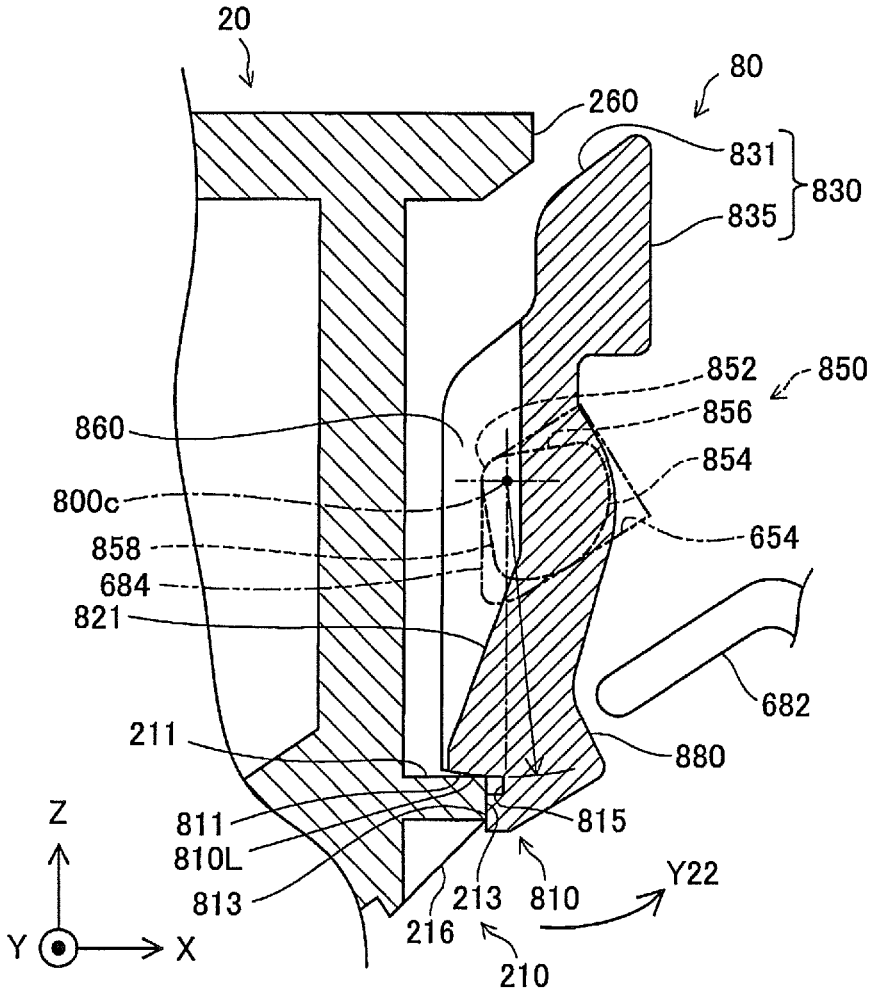
FIG. 23 is a sectional view showing the structure of the periphery of the lever in an attached state of the cartridge to the holder.

FIG. 23 is a sectional view showing the structure of the periphery of the lever 80 in the attached state of the cartridge 20 to the holder 60. The relationship between the shaft body 852 of the lever 80 and the bearing element 654 of the first retainer member 650 is described with reference to FIG. 23. FIG. 23 shows the cross section of the lever 80 locking the cartridge 20 taken on the plane passing through the first device-side locking surface 811 and parallel to the X axis and the Z axis. The broken line in FIG. 23 shows the projected shape of the shaft body 850 of the lever 80, and the two-dot chain line shows the projected shape of the bearing element 654 and the block surface 684.

As clearly understood from FIG. 23, the axis of rotation 800*c* of the lever 80 is positioned through the contact of the inner arc-shaped surface 852 and the outer arc-shaped surface 854 of the shaft body 850 with the bearing element 654. Turning the lever 80 counterclockwise (seen from the +Y-axis direction) causes the radial side face 856 of the shaft body 850 to abut the bearing element 654. This restricts further counterclockwise rotation of the lever 80 (seen from the +Y-axis direction). Turning the lever 80 clockwise (seen from the +Y-axis direction) causes the radial side face 858 of the shaft body 850 to abut the block surface 684. This restricts further clockwise rotation of the lever 80 (seen from the +Y-axis direction). This ensures stable rotation of the lever 80 and keeps the cartridge 20 at the designed attachment position in the stable state.

During rotation of the lever 80, the elastic member 682 abuts an engagement rear face 880 of the lever 80 located on the −Z-axis direction side of the axis of rotation 800*c*. The elastic member 682 accordingly limits the rotatable range of the lever 80 during attachment and detachment of the cartridge 20 to and from the holder 60. In attachment of the cartridge 20 to the holder 60, the elastic member 682 abuts the engagement rear face 880 of the lever 80 and is elastically deformed, so as to press the engagement rear face 880 in the direction including the −X-axis direction vector component. This ensures the movement of the engagement portion 810 of the lever 80 to the locking position (first locking position) 810L.

A-5. Attachment and Detachment of Cartridge 20 to and from Holder 60

FIGS. 24 to 27 show the procedure for attachment or mounting of the cartridge 20 to the holder 60 (attachment procedure). FIGS. 24 to 27 are sectional views corresponding to FIGS. 5 and 17 and are arranged in time series in this order.

Figure 24:
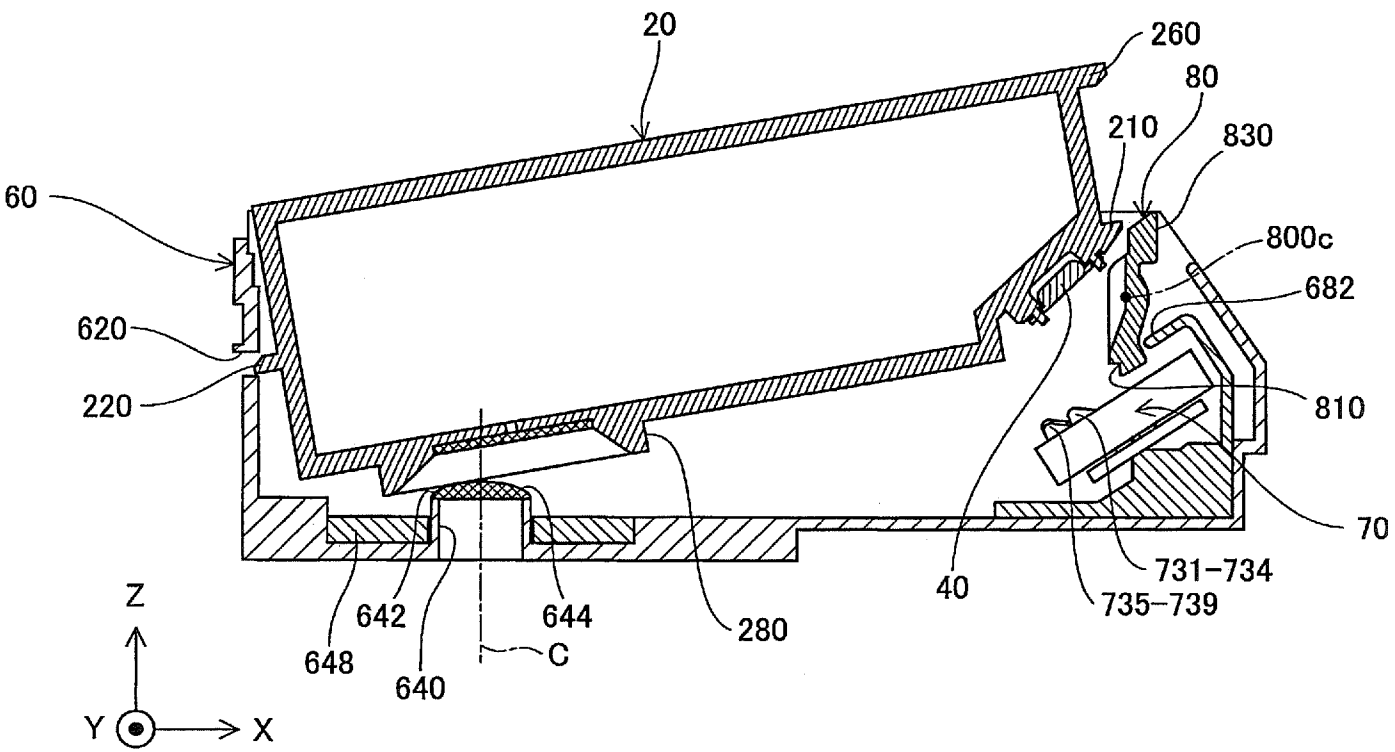
FIG. 24 shows the procedure for attachment of the cartridge to the holder.

For attachment of the cartridge 20 to the holder 60, the procedure first inserts the cartridge 20 through the top face of the holder 60 as shown in FIG. 24. The procedure then moves the cartridge 20 in the −Z axis direction or mounting direction to make the second cartridge-side restriction element 220-side of the cartridge 20 enter first into the holder 60 and inserts the second cartridge-side restriction element 220 into the second device-side restriction element 620. In the state of FIG. 24, the first cartridge-side restriction portion 210 of the cartridge 20 is located on the +Z-axis direction side of the engagement portion 810 of the lever 80 in the holder 60.

The cartridge 20 is pivoted clockwise (seen from the +Y-axis direction) about the second cartridge-side restriction element 220, which is inserted in the second device-side restriction element 620, as the pivot point of rotation from the state of FIG. 24, so that the third face 203-side of the cartridge 20 is moved toward the bottom wall member 601 of the holder 60. As shown in FIG. 25, the first cartridge-side restriction portion 210 then moves in the −Z-axis direction, while the motion of the cartridge 20 in the Y-axis direction and in the X-axis direction is restricted by the guide member 820 of the lever 80, i.e., the pair of guide walls 860*a* and 860*b*, and by the guide bottom wall 821 shown in FIG. 19.

Figure 26:
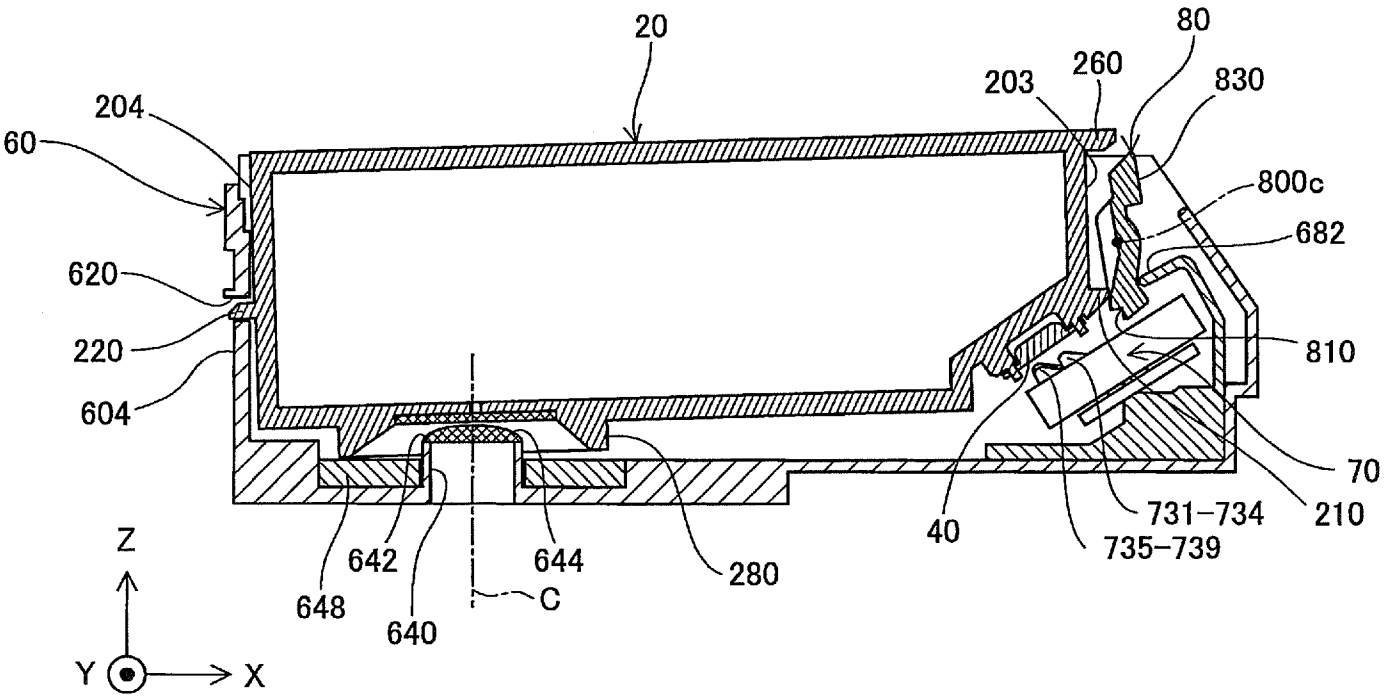
FIG. 26 shows the procedure for attachment of the cartridge to the holder.

When the cartridge 20 is further turned from the state of FIG. 25 to press in its third face 203-side, the first cartridge-side restriction portion 210 is further pressed in the −Z-axis direction. As shown in FIG. 26, the lever 80 is then pressed in the −X-axis direction by the first cartridge-side restriction portion 210 to turn counterclockwise (seen from the +Y-axis direction). The lever 80 abuts the elastic member 682 and receives the pressing force from the elastic member 682 in the direction to press back the lever 80 clockwise (seen from the +Y-axis direction). This pressing force is an external force including a −X-axis direction vector component. The rotatable range of the lever 80 is accordingly limited by the elastic member 682. This state of FIG. 26 where the lever 80 abuts the elastic member 682 and is pressed by the elastic member 682 maintains until the cartridge 20 is further pressed in and the first cartridge-side restriction portion 210 rides over the guide member 820 of the lever 80.

Figure 27:
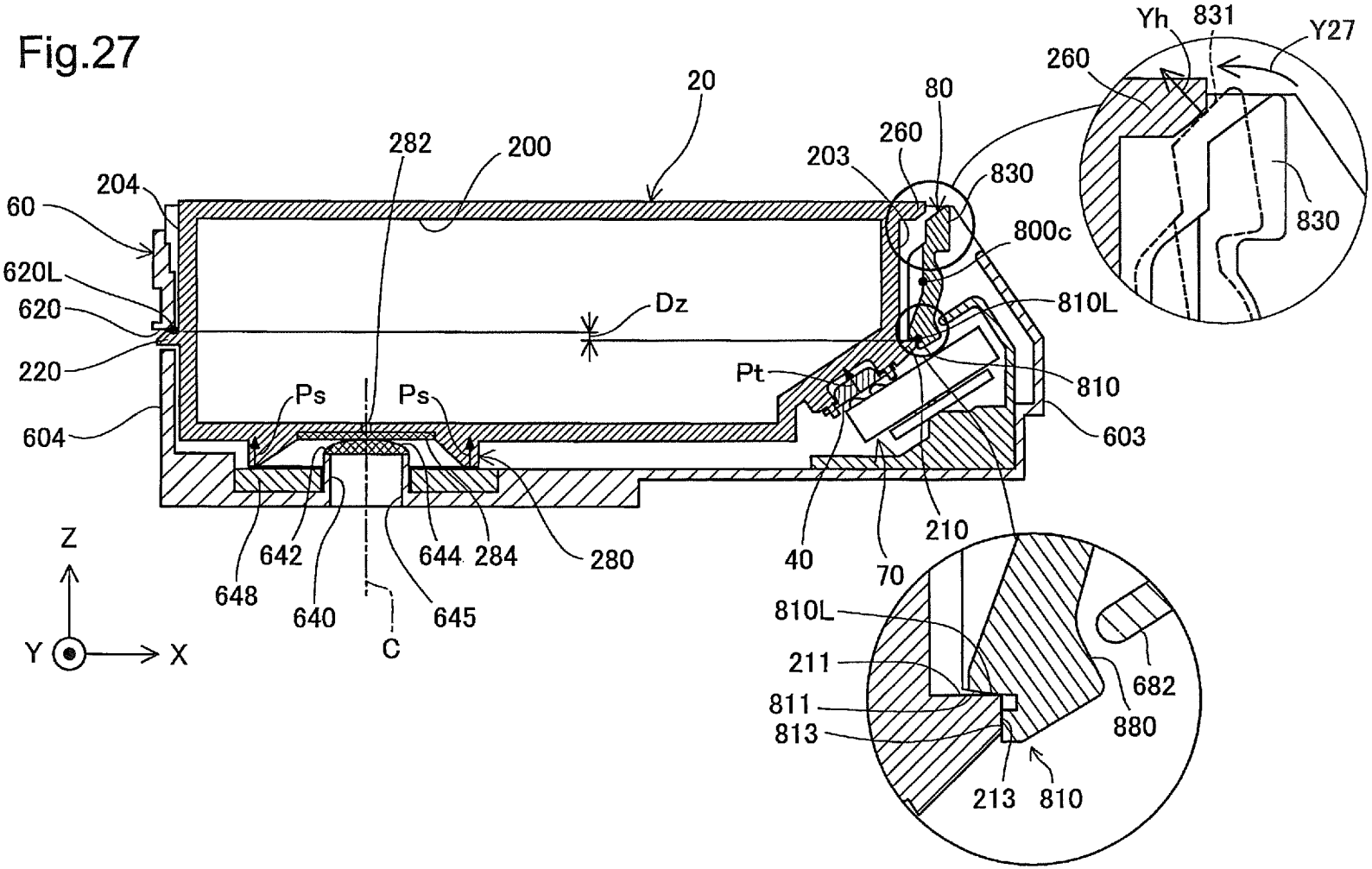
FIG. 27 shows the procedure for attachment of the cartridge to the holder.
Figure 27A:
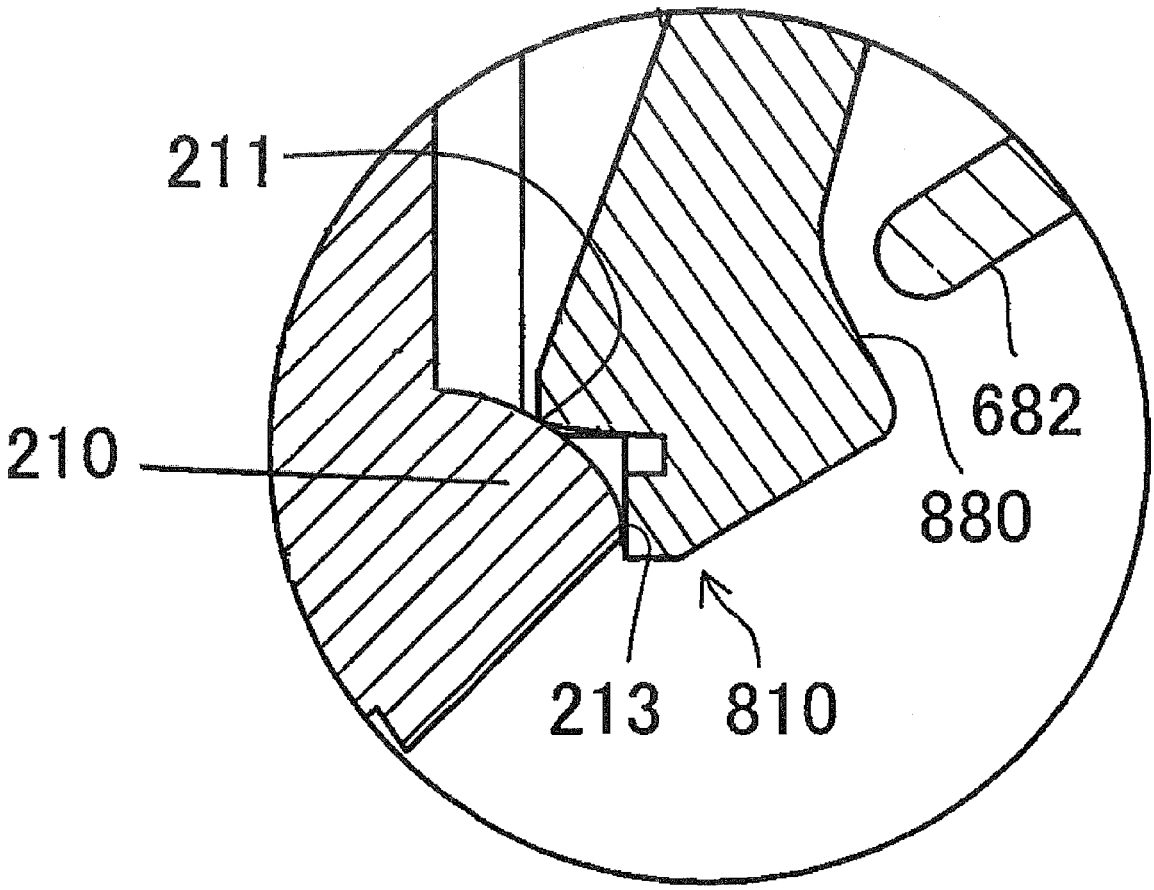
FIG. 27A is a close-up view of the cartridge attached to the holder.
Figure 27B:
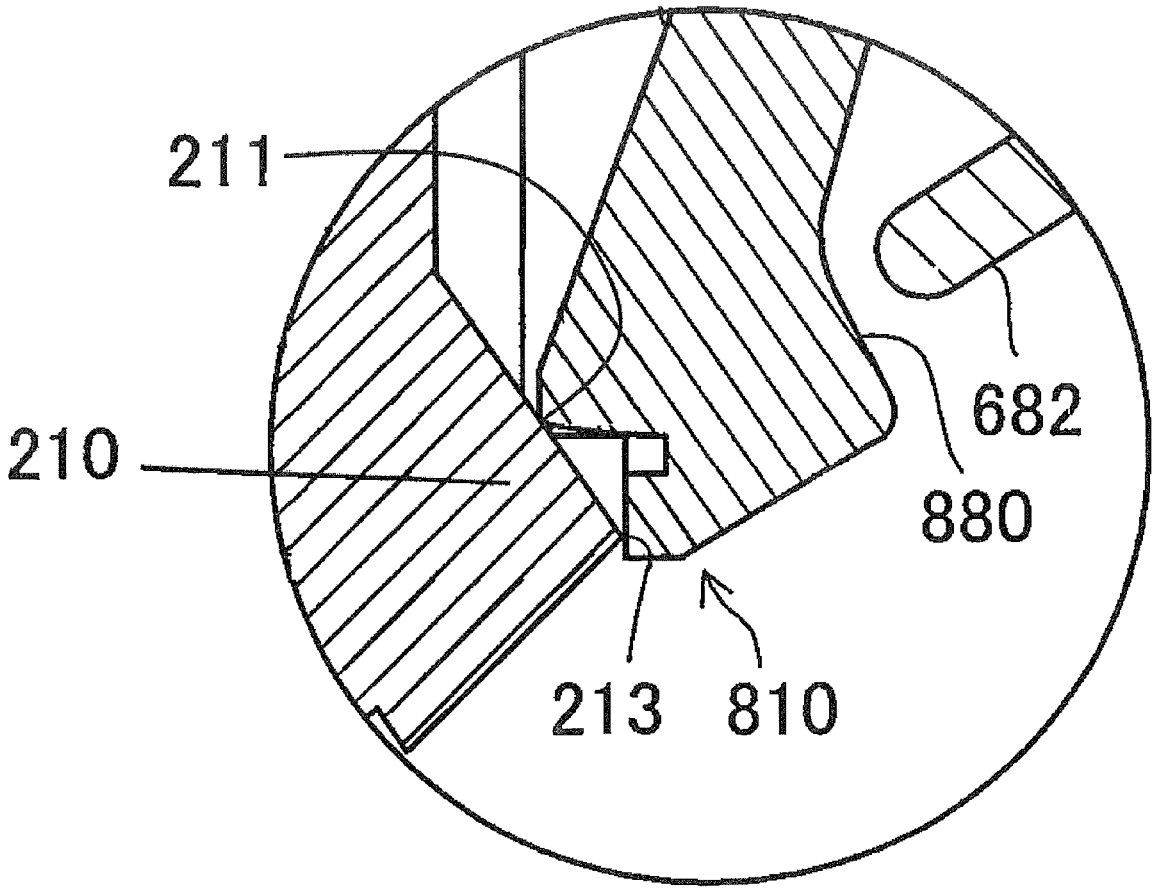
FIG. 27B is a close-up view of the cartridge attached to the holder.

When the cartridge 20 is further turned from the state of FIG. 26 to press in its third face 203-side, the first cartridge-side restriction portion 210 eventually rides over the guide member 820 of the lever 80. The lever 80 is then turned to move the first cartridge-side restriction portion 210 in the −X-axis direction as shown in FIG. 27. The engagement portion 810 accordingly moves to the first locking position 810L and locks the first cartridge-side restriction portion 210 at the first locking position 810L. More specifically, as shown by the lower right close-up view, the first device-side locking surface 811 (first part) of the engagement portion 810 abuts the first cartridge-side locking surface 211 (first abutting part) of the first cartridge-side restriction portion 210, so as to restrict the motion of the cartridge 20 in the +Z-axis direction. The second device-side locking surface 813 (second part) of the engagement portion 810 also abuts the second cartridge-side locking surface 213 (second abutting part) of the first cartridge-side restriction portion 210, so as to restrict the motion of the cartridge 20 in the +X-axis direction. Although the first cartridge-side locking surface 211 and second cartridge-side locking surface 213 are shown in the close-up view of FIG. 27 as being two separate substantially orthogonal surfaces, as can be seen in FIG. 27A, the first portion 212 of the first restriction portion 210 can be formed with a curved surface so that the first cartridge-side locking surface 211 and second cartridge-side locking surface 213 are configured as separate sections of the same surface. Alternatively, as can be seen in FIG. 27B, the first portion 212 of the first restriction portion 210 can be formed with a flat slanted surface or other shape so that the first cartridge-side locking surface 211 and second cartridge-side locking surface 213 are configured as separate sections of the same surface. As part of the mounting, the ink supply structure 280 of the cartridge 20 is then connected with the printing material supply tube 640, while the second cartridge-side restriction element 220 engages with the second device-side restriction element 620 and the first cartridge-side restriction portion 210 engages with the engagement portion 810. This completes the attachment of the cartridge 20 to the holder 60. The proper attachment of the cartridge 20 at the designed attachment position makes electrical connection between the cartridge-side terminals 400 and the device-side terminals 700, so as to allow signal transmission between the cartridge 20 and the printer 50.

According to this embodiment, as shown in FIGS. 23 and 27, the elastic member 682 is configured not to abut the lever 80 and thereby not to apply an external force to the lever 80 in the attached state of the cartridge 20 to the holder 60. This reduces the possibility of plastic deformation of the lever 80 by external force and the possibility of deviation of the engagement portion 810 from the first locking position 810L. This accordingly ensures stable electrical connection between the cartridge-side terminals 400 and the device-side terminals 700.

According to another embodiment, the elastic member 682 may be designed to abut the lever 80 and thereby apply a force to the lever 80 in the direction including the −X-axis direction vector component in the attached state of the cartridge 20 to the holder 60. In this application, the elastic member 682 continuously applies the force to the lever 80 in the direction including the −X-axis direction vector component, irrespective of the position of the lever 80. This moves the engagement portion 810 with sufficient force to the first locking position 810L for attachment of the cartridge 20 to the holder 60. This gives the hard click to inform the user of locking the cartridge 20 by the engagement portion 810.

According to another embodiment, the elastic member 682 may be omitted. This application decreases the total number of parts.

The procedure of detachment of the cartridge 20 from the holder 60 is described. For detachment of the cartridge 20 from the holder 60, the user presses the operating member 830 in the −X-axis direction. In other words, the user applies the external force Pr (FIG. 5) to the operating member 830 in the direction including the −X-axis direction vector component. The lever 80 then moves the engagement portion 810 around the axis of rotation 800*c* in the direction including the +X-axis direction vector component. Simultaneously the first cartridge-side locking surface 211 rotates and moves in the direction of arrow Y22 shown in FIG. 23. This disengages the first cartridge-side restriction portion 210 from the engagement portion 810 and eliminates the restriction on the motion of the third face 203-side of the cartridge 20 in the +Z-axis direction. Eliminating the restriction on the motion of the cartridge 20 in the +Z-axis direction causes the third face 203-side of the cartridge 20 to move in the +Z-axis direction by the pressing force Pt from the contact mechanism 70. This moves the cartridge 20 from the state of FIG. 27 to the state of FIG. 26. The cartridge 20 is further turned counterclockwise (seen from the +Y-axis direction) about the second cartridge-side restriction element 220 inserted in the second device-side restriction element 620 as the pivot point of rotation, in order to pull away the third face 203-side of the cartridge 20 from the bottom wall member 601 of the holder 60. This moves the cartridge 20 from the state of FIG. 26 to the state of FIG. 25 and further to the state of FIG. 24. The user may apply force to the projection 260 in the direction including the −X-axis direction vector component, in order to turn the cartridge 20. This operation turns the third face 203-side of the cartridge 20 counterclockwise (seen from the +Y-axis direction) and moves the third face 203-side of the cartridge 20 in the +Z-axis direction. The user holds the third face 203-side of the cartridge 20 and pulls away the second cartridge-side restriction element 220 from the second device-side restriction element 620, so as to remove the cartridge 20 from the holder 60.

As shown in the close-up view of FIG. 27, the operating member 830 of the lever 80 includes the operating-member opposed surface 831. For removal of the cartridge 20 in the attached state from the holder 60, when the user presses the operating member 830, the operating-member opposed surface 831 is in contact with the projection 260. The operating-member opposed surface 831 is inclined in a direction including a −X-axis direction vector component and a +Z-axis direction vector component. Turning the lever 80 about the axis of rotation 800*c* in the direction of arrow Y27 causes the operating-member opposed surface 831 to be in contact with the projection 260 and presses the projection 260 in a direction Yh including the −X-axis direction vector component and the +Z-axis direction vector component. This facilitates detachment of the cartridge 20 from the holder 60. Even when the cartridge 20 is stuck by some part of the holder 60 and is not moved in the +Z-axis direction through the travel of the first cartridge-side locking surface 211 from the first locking position 810L in the +X-axis direction, the third face 203-side of the cartridge 20 can be moved in the +Z-axis direction by using the operating-member opposed surface 831 and the projection 260.

A-6. Attachment Detection Method Using Attachment Detection Terminals

Figure 28:
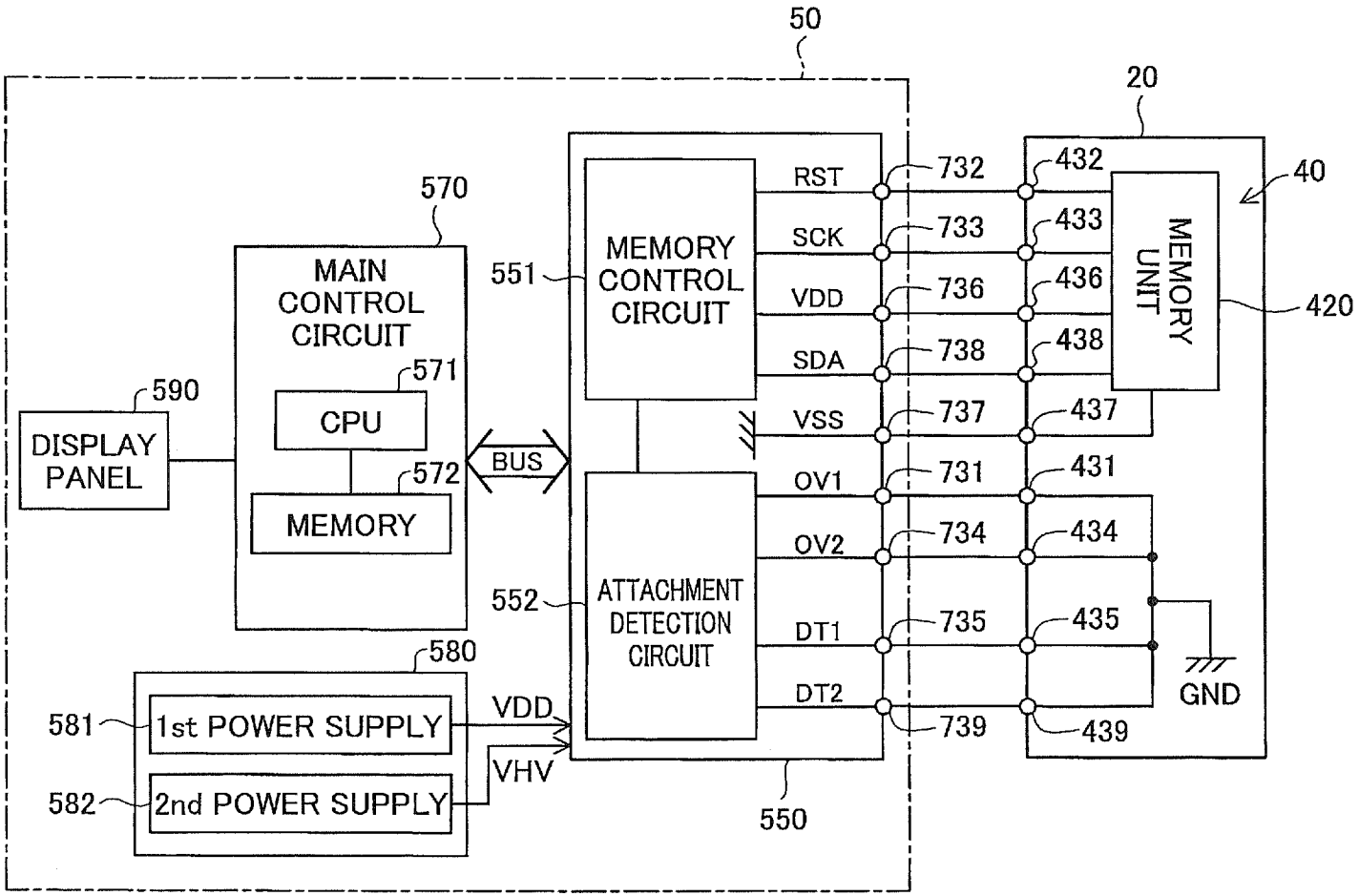
FIG. 28 is a block diagram illustrating the electrical structure.

FIG. 28 is a block diagram illustrating the electrical structure of the circuit board 40 of the cartridge 20 and the printer 50 according to the first embodiment. The printer 50 includes a display panel 590, a power circuit 580, a main control circuit 570 and a sub-control circuit 550. The display panel 590 serves as a display unit to notify the user of various information, for example, the operating condition of the printer 50 and the attachment state of the cartridge 20. The display panel 590 may be provided on an operation unit (not shown) visible from outside of the printer 50. The power circuit 580 includes a first power supply 581 to generate a first power-supply voltage VDD and a second power supply 582 to generate a second power-supply voltage VHV. The first power-supply voltage VDD is the ordinary power-supply voltage (e.g., rated voltage of 3.3 V) used for logic circuits. The second power-supply voltage VHV is the high voltage (e.g., rated voltage of 42 V) used to drive the head 540 (FIG. 2) for ink ejection. These voltages VDD and VHV are supplied to the sub-control circuit 550, while being supplied to the other circuits as needed basis. The main control circuit 570 includes a CPU 571 and a memory 572. The sub-control circuit 550 includes a memory control circuit 551 and an attachment detection circuit 552. The circuit structure including the main control circuit 570 and the sub-control circuit 550 is called "control circuit".

Among the nine terminals provided on the circuit board 40 of the cartridge 20 (FIG. 10), the reset terminal 432, the clock terminal 433, the power terminal 436, the ground terminal 437 and the data terminal 438 are electrically connected with the memory unit 420. The memory unit 420 is a nonvolatile memory without an address terminal. In the memory unit 420, a memory cell to be accessed is determined, based on the pulse number of clock signal SCK input from the clock terminal 433 and command data input from the data terminal 438. The memory unit 420 receives data from the data terminal 438 or sends data to the data terminal 438, in synchronism with the clock signal SCK. The clock terminal 433 is used to supply the clock signal SCK from the sub-control circuit 350 to the memory unit 420. The printer 50 applies the power-supply voltage (for example, rated voltage of 3.3 V) for driving the memory unit 420 and the ground voltage (0 V) respectively to the power terminal 436 and to the ground terminal 437. The power-supply voltage for driving the memory unit 420 may be the first power-supply voltage VDD directly applied by the printer 50 or may be generated from the first power-supply voltage VDD to be lower than the first power-supply voltage VDD. The data terminal 438 is used for transmission of data signal SDA between the sub-control circuit 550 and the memory unit 420. The reset terminal 432 is used to supply reset signal RST from the sub-control circuit 550 to the memory unit 420. The four attachment detection terminals 431, 434, 435 and 439 are interconnected by wiring in the circuit board 40 of the cartridge 20 (FIG. 3) and are all grounded. For example, the attachment detection terminals 431, 434, 435 and 439 are connected with the ground terminal 437 to be grounded. According to another embodiment, the attachment detection terminals 431, 434, 435 and 439 may be grounded by any connection path without the ground terminal 437. As clearly understood from this description, the attachment detection terminals 431, 434, 435 and 439 may be connected with part of the memory terminals (or memory unit 420), but is preferably not connected with any memory terminals other than the ground terminal 437 or the memory unit 420. Non-connection of the attachment detection terminals with the memory terminal or the memory unit results in application of no signal or voltage other than an attachment check signal to the attachment detection terminals and thus ensures the accurate attachment detection. The four attachment detection terminals 431, 434, 435 and 439 are interconnected by wiring in the illustrated example of FIG. 28, but part of the connection path may be replaced by a resistance.

In FIG. 28, path names SCK, VDD, SDA, RST, OV1, OV2, DT1 and DT2 are assigned to the respective connection paths connecting the device-side terminals 731 to 739 with the cartridge-side terminals 431 to 439 of the circuit board 40. The signal names are used for the path names with respect to the connection paths to the memory unit 420.

Figure 29:
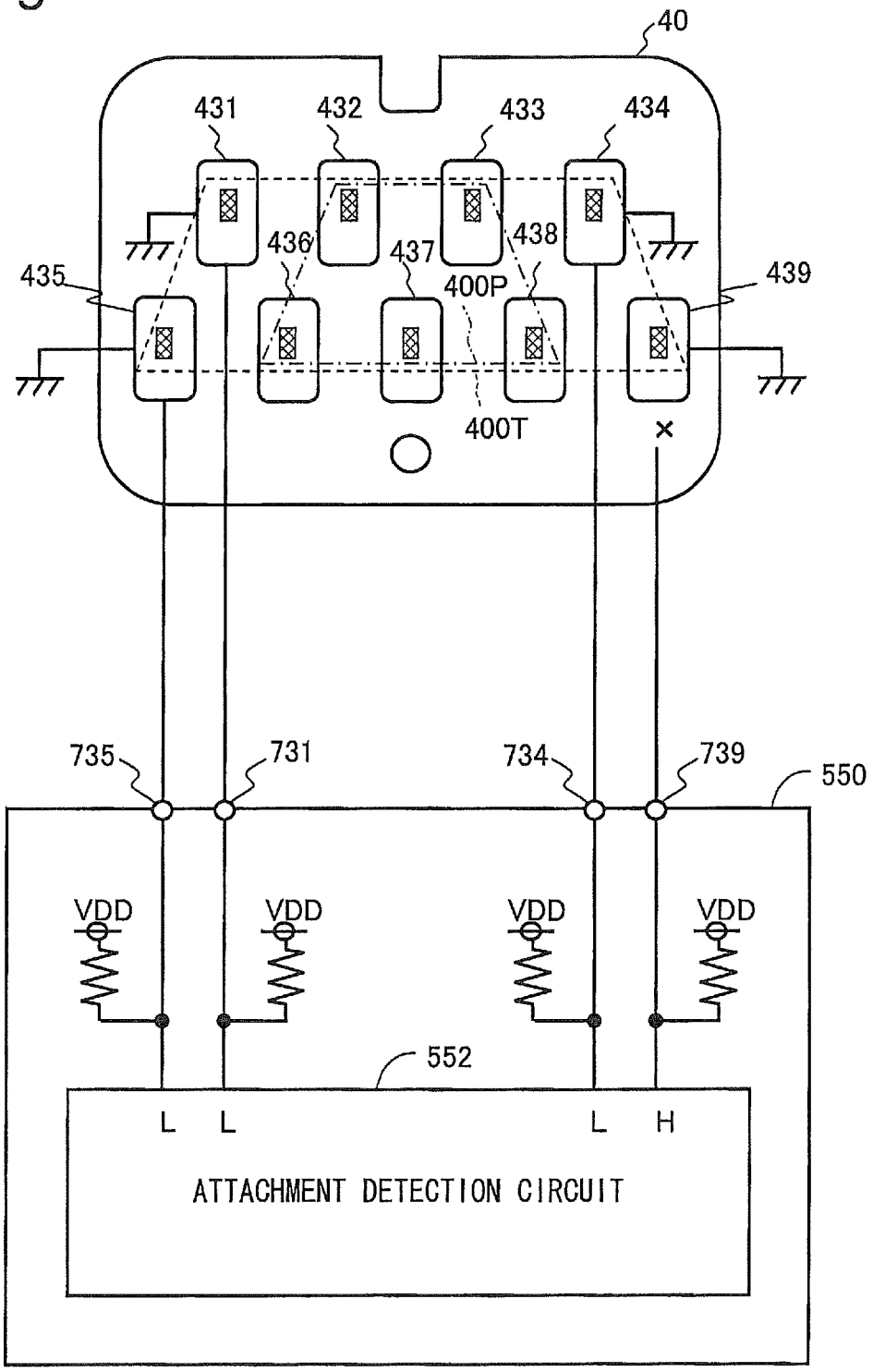
FIG. 29 illustrates the connection between the circuit board and an attachment detection circuit.

FIG. 29 illustrates the connection between the circuit board 40 and the attachment detection circuit 552. The four attachment detection terminals 431, 434, 435 and 439 of the circuit board 40 are connected with the attachment detection circuit 552 via the corresponding device-side terminals 731, 734, 735 and 739. The four attachment detection terminals 431, 434, 435 and 439 of the circuit board 40 are grounded. The connection paths between the device-side terminals 731, 734, 735 and 739 and the attachment detection circuit 552 are respectively connected to the power-supply voltage VDD (rated voltage of 3.3 V) in the sub-control circuit 550 via pull-up resistance.

In the illustrated example of FIG. 29, the three terminals 431, 434 and 435 of the four attachment detection terminals 431, 434, 435 and 439 on the circuit board 40 have good connection with the corresponding device-side terminals 731, 734 and 735. The attachment detection terminal 439, however, has poor connection with the corresponding device-side terminal 739. The voltage level of the connection paths for the three device-side terminals 731, 734 and 735 in the good connection state is L level (ground voltage level), whilst the voltage level of the connection path for the device-side terminal 739 in the poor connection state is H level (power-supply voltage VDD level). The attachment detection circuit 552 may check the voltage levels of these connection paths, so as to identify the good/poor connection state with respect to each of the four attachment detection terminals 731, 734, 735 and 739.

The contact portions cp of the four attachment detection terminals 431, 434, 435 and 439 on the circuit board 40 are located outside a first area 400P, which includes the contact portions cp of the memory terminals 432, 433, 436, 437 and 438. The contact portions cp of the four attachment detection terminals 431, 434, 435 and 439 are located at four corners of a quadrilateral second area 400T, which includes the first area 400P. The first area 400P is preferably a smallest possible quadrilateral including the contact portions cp of the five memory terminals 432, 433, 436, 437 and 438. The second area 400T is preferably a smallest possible quadrilateral including all the contact portions cp of the cartridge-side terminals 431 to 439.

In the state of good contact for all the four attachment detection terminals 431, 434, 435 and 439, the cartridge 20 has no significant tilt and ensures the good contact for the memory terminals 432, 433, 436, 437 and 438. In the state of poor contact for any one or more of the four attachment detection terminals 431, 434, 435 and 439, on the other hand, the cartridge 20 has a significant tilt and may cause the poor contact for any one or more of the memory terminals 432, 433, 436, 437 and 438. According to a preferable embodiment, in the state of poor contact for any one or more of the four attachment detection terminals 431, 434, 435 and 439, the attachment detection circuit 552 displays information (character string or image) indicating the failed attachment on the display panel 390 to notify the user of the failed attachment.

The contact portions cp of the attachment detection terminals 431, 434, 435 and 439 are arranged at the four corners surrounding the first area 400P including the contact portions cp of the memory terminals 432, 433, 436, 437 and 438, because of the following reason. In the attached state of the cartridge 20 to the holder 60, there is a certain margin for tilting the cartridge 20, so that the circuit board 40 of the cartridge 20 may be inclined relative to the contact mechanism 70 of the holder 60. For example, tilting the cartridge 20 to make the terminals 431 to 434 (more specifically their contact portions) in the upper line R2 (FIG. 10A) on the circuit board 40 more distant from the contact mechanism 70 than the terminals 435 to 439 (more specifically their contact portions) in the lower line R1 (FIG. 10A) may result in the poor contact for any of the terminals 431 to 434 in the upper line R2. Tilting the cartridge 20 to make the terminals 435 to 439 (more specifically their contact portions) in the lower line R1 on the circuit board 40 more distant from the contact mechanism 70 than the terminals 431 to 434 (more specifically their contact portions) in the upper line R2 may result in the poor contact for any the terminals 435 to 439 in the lower line R1. Tilting the cartridge 20 to make the left edge of the circuit board 40 (FIG. 10A) more distant from the contact mechanism 70 than the right edge may result in the poor contact for any of the terminals 431, 432, 435, 436 and 437 on the left side of the circuit board 40. Tilting the cartridge 20 to make the right edge of the circuit board 40 more distant from the contact mechanism 70 than the left edge may result in the poor contact for any of the terminals 433, 434, 437, 438 and 439 on the right side of the circuit board 40. The poor contact may cause an error in reading data from the memory unit 420 or in writing data into the memory unit 420. Checking the contact portions cp of all the four attachment detection terminals 431, 434, 435 and 439, which are arranged at the four corners outside the first area 400P including the contact portions cp of the memory terminals 432, 433, 436, 437 and 438, for the good/poor contact advantageously prevents the poor contact and a resulting access error in the memory unit 420 due to such tilting of the cartridge 20.

A-7. Advantageous Effects of Embodiment

Certain of the advantageous effects of this embodiment compared with the structures disclosed in U.S. Publication No. 2005/0151811, and U.S. Pat. No. 6,276,780 mentioned previously.

In the printing material supply system 10 according to this embodiment, the lever 80 is provided on the holder 60, and the first cartridge-side restriction portion 210 is provided on the cartridge 20. The cartridge-side restriction portion 210 is located on the −Z-axis direction side of the axis of rotation 800*c* of the lever 80. The engagement member for engaging with the holder is not located at the position between the axis of rotation and the operating member of the lever, unlike the structures in U.S. Publication No. 2005/0151811 in which the lever is integral with the cartridge. There is accordingly no need to make a relatively large distance between the lever and the cartridge side face. The structure of the embodiment accordingly shortens the distance between the lever 80 and the third face 203 of the cartridge 20, i.e., the dimension in the X-axis direction, while shortening the length of the lever, i.e., the dimension in the Z-axis direction. This allows significant size reduction of the printer 50 and the whole printing material supply system 10, as well as size reduction of packaging for transportation and distribution of the cartridges 20, which advantageously reduces the transportation cost and the parts cost. This advantageous effect is not achieved by simply providing the lever on the printer holder instead of the cartridge as described in U.S. Pat. No. 6,276,780. This advantageous effect is achieved by providing the axis of rotation 800*c* of the lever 80 between the operating member 830 and the engagement portion 810 and locating the cartridge-side restriction portion 210 on the −Z-axis direction side of the axis of rotation 800*c* of the lever 80.

The printing material supply system 10 according to the embodiment includes the relatively short lever 80 and the first cartridge-side restriction portion 210 of the small size and the simple structure (e.g., projection). This increases the rigidity of the lever 80 and the first cartridge-side restriction portion 210, compared with the structures described in U.S. Publication No. 2005/0151811, and allows the relatively high-rigidity material to be selected for the lever 80 and the first cartridge-side restriction portion 210 (cartridge 20). This results in significantly reducing the possibility of plastic deformation or creep deformation of the lever 80 and the first cartridge-side restriction portion 210. In the attached state, the cartridge 20 can be kept at the proper position in the holder 60, which maintains the normal or good contact between the cartridge-side terminals 431 to 439 and the device-side terminals 731 to 739 and reduces the poor continuity. Since the first cartridge-side restriction portion 210 of this embodiment has the small size and the simple structure, no special care to prevent plastic deformation of the lever is required in packaging for transportation and distribution of the cartridges 20, especially in vacuum packaging, unlike the cartridges of U.S. Publication No. 2005/0151811. This improves the user's convenience. Providing the projection as the first cartridge-side restriction portion 210 as described in the embodiment is especially preferable for this advantageous effect.

In the printing material supply system 10 according to the embodiment, the cartridge-side restriction portion 210 is located on the −Z-axis direction side of the axis of rotation 800*c* of the lever 80. As described previously, the device-side terminals 731 to 739 generate the pressing force Pt in the direction of pressing back the circuit board 40 (i.e., in the direction including the +Z-axis direction vector component and the −X-axis direction vector component) in the attached state of the cartridge 20. This pressing force Pt is expected to move the cartridge 20 in the +Z-axis direction in the attached state. In the printing material supply system 10 of the embodiment, however, the axis of rotation 800*c* of the lever 80 is located on the −Z-axis direction side of the first cartridge-side restriction portion 210, so that the lever 80 restricts the motion of the cartridge 20 from the +Z-axis direction side to the −Z-axis direction side.

According to this embodiment, the first cartridge-side restriction portion 210 is located on the −Z-axis direction side and on the −X-axis direction side of the axis of rotation 800*c* of the lever 80. When the cartridge 20 moves in the +Z-axis direction, rotational moment arises on the lever 80 as shown by arrow M in FIG. 5. This moment acts to cause the first cartridge-side restriction portion 210 to be strongly pressed in the −X-axis direction by the engagement portion 810. This moment also acts to move the engagement portion 810 of the lever 80 in accordance with moving the cartridge 20 in the −X-axis direction by the X-axis direction vector component of the pressing force Pt. The cartridge 20 in the attached state accordingly receives the force to be pressed against the device-side bottom wall member 601 and the second devise-side side wall member 604. This structure of the embodiment prevents the cartridge 20 from being unintentionally uncoupled from the holder 60, thus maintaining the normal or good contact between the cartridge-side terminals 431 to 439 and the device-side terminals 731 to 739 and reducing the possibility of poor continuity.

As shown in FIG. 27, the first cartridge-side restriction portion 210 includes the first cartridge-side locking surface 211 that abuts the first part 811 of the engagement portion 810 to restrict the motion of the cartridge 20 in the +Z-axis direction, and the second cartridge-side locking surface 213 that abuts the second part 812 of the engagement portion 810 to restrict the motion of the cartridge 20 in the +X-axis direction. This ensures production of the rotational moment as shown by the arrow M in FIG. 5 and more effectively reduces the possibility of poor continuity between the cartridge-side terminals 431 to 439 and the device-side terminals 731 to 739.

As shown in FIG. 12, according to this embodiment, the first cartridge-side restriction portion 210 has the second portion 214. The first cartridge-side restriction portion 210 reduces the possibility that the first cartridge-side restriction portion 210 is locked at the position on the −Z-axis direction side of the engagement portion 810 in attachment of the cartridge 20 to the holder 60. In the course of attachment of the cartridge 20 to the holder 60, the user may press the cartridge 20 deeper in the −Z-axis direction into the holder 60 than the state of FIG. 27. Even in this case, the second portion 214 of the first cartridge-side restriction portion 210 abuts the second device-side locking surface 813 of the lever 80, so as to prevent the first cartridge-side restriction portion 210 from being located on the −Z-axis direction side of the engagement portion 810. This reduces the possibility that the first cartridge-side restriction portion 210 is locked by the engagement portion 810 at the unintended locking position.

A-7-2. Reduction of Effects of External Force in Attached State of Cartridge

Figure 30:
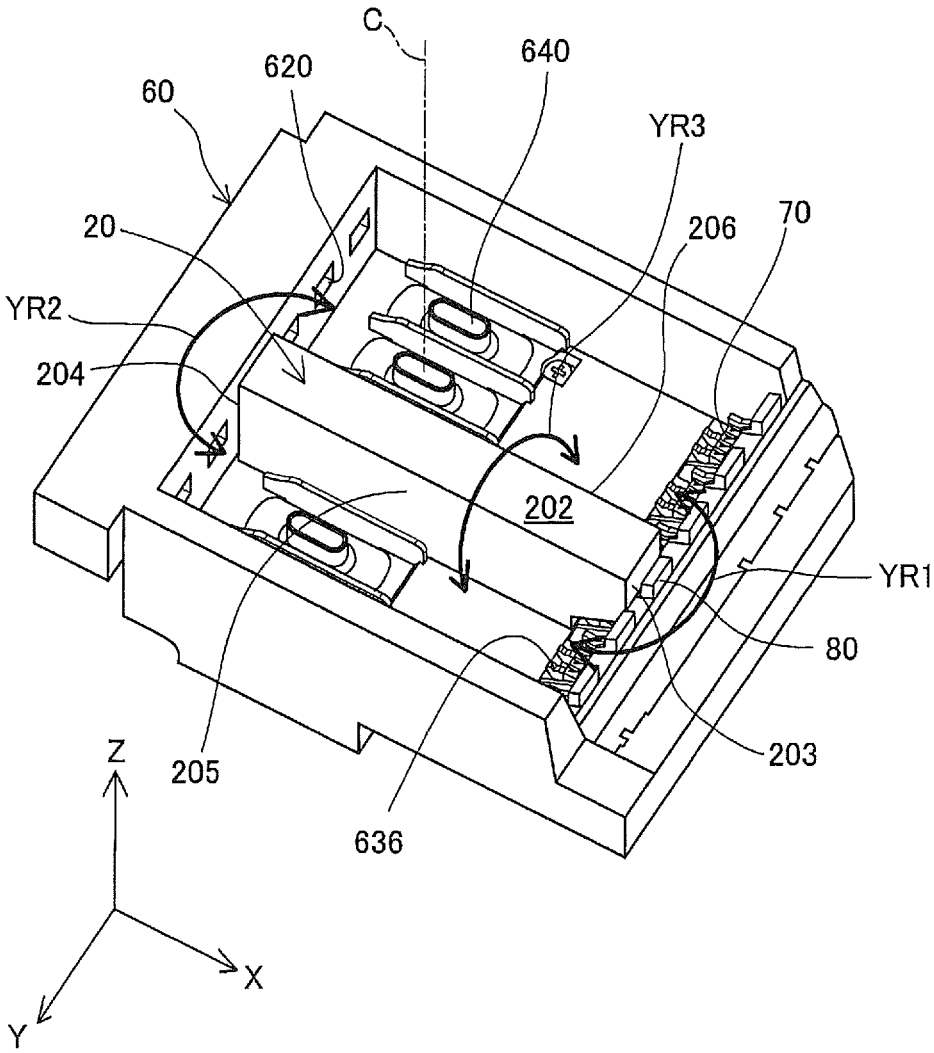
FIG. 30 shows the external force applied to the cartridge in the attached state.

FIG. 30 shows the external force applied to the cartridge 20 in the attached or mounted state. During printing operation of the printer 50, the holder 60 and the cartridge 20 move reciprocally in the main scanning direction (Y-axis direction or width direction of the cartridge 20). The cartridge 20 accordingly receives external force (inertial force) during acceleration and deceleration of the holder 60 in the width direction. The cartridge 20 receiving the external force may turn about the ink supply structure 280 (FIG. 27) and the printing material supply tube 640 in the rotating direction including the width direction vector component (Y-axis direction vector component). More specifically, the third face 203-side of the cartridge 20 may turn in the direction of arrow YR1, while the fourth face 204-side of the cartridge 20 may turn in the direction of arrow YR2. The second face 202-side of the cartridge 20 may also turn in the direction of arrow YR3. The direction of arrow YR1 and the direction of arrow YR2 are the rotating direction about the Z axis, which includes the Y-axis direction vector component (width direction vector component). The direction of arrow YR3 is the rotating direction about the X axis, which includes the Y-axis direction vector component (width direction vector component).

Moving the cartridge 20 in the direction of arrow YR3 causes either the fifth face 205 or the sixth face 206 of the cartridge 20 to be pulled up in the +Z-axis direction. As described previously, however, such motion of the cartridge 20 in the +Z-axis direction is restricted by the lever 80. According to this embodiment, the first cartridge-side restriction portion 210 is close to the intersecting part 295 as shown in FIG. 13. In other words, the first cartridge-side restriction portion 210 is close to the board end 405 of the circuit board 40. The first cartridge-side restriction portion 210 is arranged as close as possible to the cartridge-side terminals 400. Since the first cartridge-side restriction portion 210 is locked by the lever 80, the periphery of the first cartridge-side restriction portion 210 has substantially no position shift by the external force. Providing the cartridge-side terminals 400 at the location of extremely small position shift effectively prevents the positional misalignment of the respective terminals 431 to 439 of the cartridge-side terminals 400 relative to the holder 60, thus maintaining the stable electrical connection between the cartridge-side terminals 400 and the device-side terminals 700. In order to ensure this advantageous effect, it is preferable to locate at least part of the first cartridge-side restriction portion 210 (specifically the first cartridge-side locking surface 211) between the first outer part 435P and the second outer part 439P (FIG. 10A) in the Y-axis direction (width direction) (when the cartridge 20 is viewed from the third face 203-side in the −X-axis direction).

As shown in FIG. 7, according to this embodiment, the corner section 265 of the cartridge 20 has the step (seventh face) 207 extended in the +Z-axis direction from the first face 201. The seventh face 207 is located on the −X-axis direction side and on the −Z-axis direction side of the sloped surface (eighth face) 208. The seventh face 207 has the third cartridge-side restriction element 250. As shown in FIG. 2 and FIGS. 14 to 16, the holder 60 has the third device-side restriction element (projection) 636. The third cartridge-side restriction element 250 is in contact with the projection 636. This further restricts the motion of the third face 203-side of the cartridge 20 in the width direction about the printing material supply tube 640 and the ink supply structure 280. The third cartridge-restriction element 250 is structured preferably as the pair of projection members protruded from the seventh face 207 in the +X-axis direction to receive the projection 636 therebetween as described in the embodiment. This simple structure effectively restricts the motion of the third face 203-side of the cartridge 20 in the width direction about the printing material supply tube 640 and the ink supply structure 280.

As shown in FIG. 13, according to this embodiment, the terminal bearing structure 408 of the circuit board 40 and the third cartridge-side restriction element 250 are arranged to partly overlap each other in the X-axis direction (when the cartridge 20 is viewed from the first face 201-side in the +Z-axis direction). This further effectively restricts the motion of the cartridge 20 in the direction of arrow YR1 and thereby prevents the motion (deviation) of the cartridge-side terminals 400 relative to the holder 60.

In the above description, the external force in the width direction applied to the cartridge 20 is the inertial force produced by the movement of the cartridge 20 in the main scanning direction. The external force applied to the cartridge 20 is, however, not restricted to such inertial force. For example, in the off-carriage type printer, the print head moves in the main scanning direction, but the cartridge 20 is attached to the stationary holder and so does not move in the main scanning direction. In the off-carriage type printer, however, the cartridge 20 may receive an external force. More specifically, an external force (inertial force) may be applied to the cartridge 20 due to, for example, vibration arising from the movement of the print head in the main scanning direction.

A-7.-3. Reduction of Tilting of Cartridge 20 in Attached State

As shown in FIG. 12, according to this embodiment, the first cartridge-side restriction portion 210 is provided to intersect the plane Yc passing through the center of the width (Y-axis direction length) of the cartridge 20. As shown in FIG. 5, the cartridge 20 in the attached state receives the pressing forces Ps and Pt including the +Z-axis direction vector component from the holder 60. These pressing forces Ps and Pt press the first cartridge-side restriction portion 210 against the engagement portion 810 of the lever 80. Even when the cartridge 20 in the attached state is shaken about the X axis or the Z axis by the external force, the first cartridge-side restriction portion 210 hardly moves in the vicinity of the position intersecting the plane Yc.

The first cartridge-side restriction portion 210 is located close to the intersecting part 295, i.e., close to the board end 405. Providing the first cartridge-side restriction portion 210, which moves very little at the position very close to the cartridge-side terminals 400 ensures a stable electrical connection between the cartridge-side terminals 400 and the contact mechanism 70.

The effective part of the first cartridge-side restriction portion 210 specifically serving to restrict the position of the cartridge-side terminals 400 is the first cartridge-side locking surface 211. It is thus preferable to locate the first cartridge-side locking surface 211 as close as possible to the cartridge-side terminals 400. Omitting the third portion 215 of the first cartridge-side restriction portion 210 and locating the first portion 212 in contact with the first side 290 enable the first cartridge-side locking surface 211 to be closer to the intersecting part 295 or the board end 405. This further ensures the stable electrical connection between the cartridge-side terminals 400 and the contact mechanism 70.

According to this embodiment, as shown in FIG. 10, among the contact portions cp of the respective cartridge-side terminals 400, the ground terminal 437 having the contact portion cp on the center in the Y-axis direction is provided at the position intersecting the plane Yc. The contact portions cp of the other terminals 431 to 436, 438 and 439 are arranged to be symmetrical with respect to the line of intersection of the plane Yc and the ground terminal 437 as the axis. The plane Yc has especially little motion, since the position of the first cartridge-side restriction portion 210 is fixed. The cartridge-side terminals 400 are provided on the plane Yc of little motion or its neighborhood. In addition to providing the first cartridge-side restriction portion 210 at the position very close to the cartridge-side terminals 400, locating the cartridge-side terminals 400 on the plane Yc or its neighborhood further ensures the stable electrical connection between the cartridge-side terminals 400 and the contact mechanism 70.

A-7-4. Fine Adjustment of Tilted Cartridge 20 in Attached State

According to this embodiment, the first cartridge-side restriction portion 210 (more specifically, the first cartridge-side locking surface 211) is located not outside but inside the range 40Y in the Y-axis direction between the first outer part 435P located on the most +Y-axis direction side of the cartridge-side terminals 400 and the second outer part 439P located on the most −Y-axis direction side of the cartridge-side terminals 400. After the cartridge 20 is attached to the holder 60, the cartridge-side terminals 400 receive the force of +Z-axis direction vector component from the device-side terminals 700, so as to finely adjust the tilt of the cartridge 20 or more specifically the direction of the sloped terminal bearing structure 408, on which the cartridge-side terminals 400 are provided. The manufacturing error may vary the positions of the respective device-side terminals 731 to 739 from the device-side sloped surface 708 or the horizontality of the first cartridge-side locking surface 211 of the first cartridge-side restriction portion 210. Even in such cases, the fine adjustment of the direction of the sloped terminal bearing structure 408 ensures the stable electrical connection between the cartridge-side terminals 400 and the device-side terminals 700.

Figure 31:
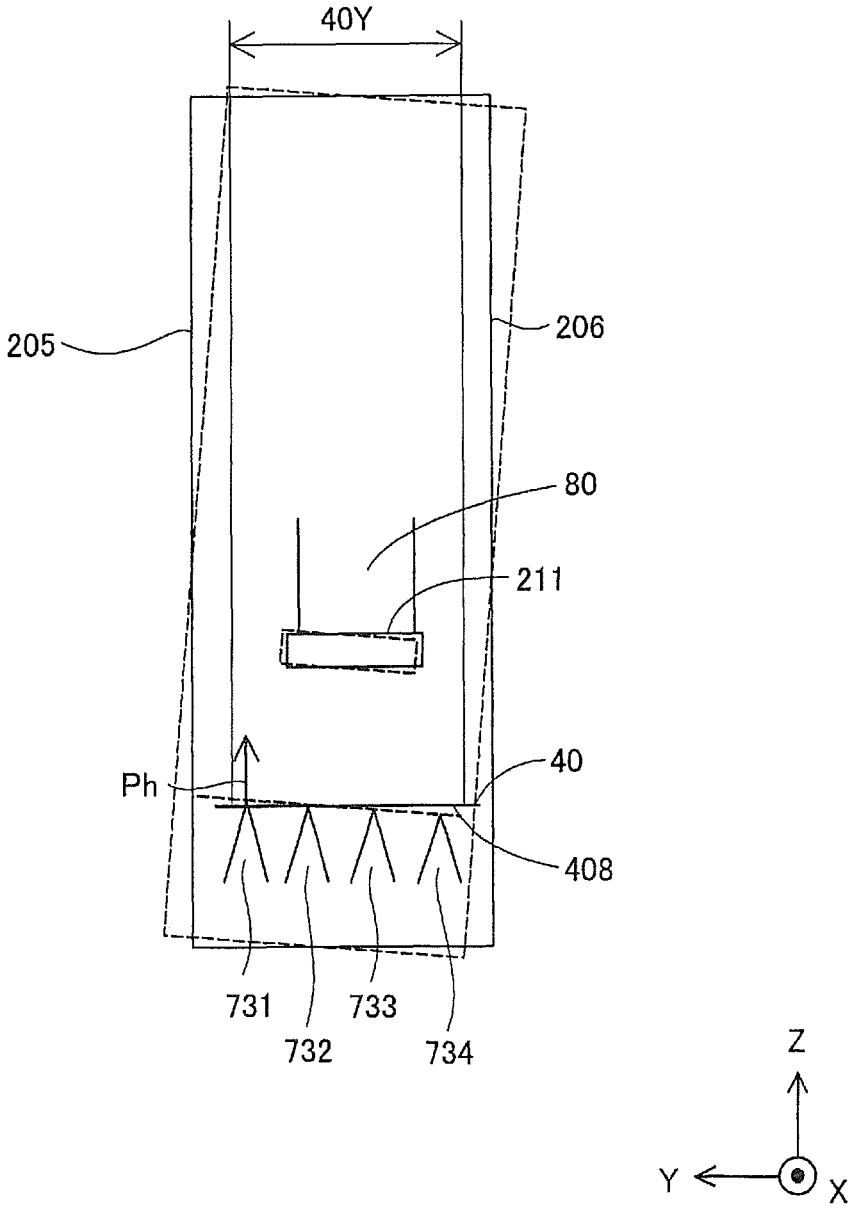
FIG. 31 shows fine adjustment of the direction of a sloped surface.

FIG. 31 shows fine adjustment of the direction of the sloped terminal bearing structure 408. The position of the cartridge 20 after fine adjustment of the attitude of the cartridge 20 is shown by the broken line. In this example, the attachment detection terminal 731 of the device-side terminals 700 protrudes from the device-side sloped surface 708 (FIG. 18) in the +Z-axis direction more than the designed amount. In this case, the sloped terminal bearing structure 408 receives force Ph in a direction including the +Z-axis direction vector component from the attachment detection terminal 731. Locating the first cartridge-side locking surface 211 within the range 40Y allows more rotation of the cartridge 20 about the X axis. In other words, application of the force Ph to the sloped terminal bearing structure 408 enables fine adjustment of the attitude of the cartridge 20. In the illustrated example of FIG.

31, the attitude of the cartridge 20 is finely adjusted to be tilted toward the sixth face 206-side.

A-7-5. Advantageous Effects of Second Cartridge-Side Restriction Element 220

The cartridge 20 has the second cartridge-side restriction element 220 on the fourth face 204 (FIG. 27), which serves to restrict the motion of the cartridge 20 from its +X-axis direction sides in the +Z-axis direction. This further ensures the stable electrical connection between the cartridge-side terminals 400 and the device-side terminals 700.

According to this embodiment, the second cartridge-side restriction element 220 is the projection protruded from the fourth face 204 in the −X-axis direction. The second cartridge-side restriction element 220 is inserted into the second device-side restriction element 620 (FIG. 3) in the form of the through hole of the holder 60. The user turns the cartridge 20 about the vicinity of the second cartridge-side restriction element 220 inserted in the second device-side restriction element 620 (FIG. 3) for attachment and detachment of the cartridge 20 to and from the holder 60. The second device-side restriction element 620 accordingly serves as the guide for attachment and detachment of the cartridge 20 to and from the holder 60. This structure facilitates attachment and detachment of the cartridge 20 to and from the holder 60. The second cartridge-side restriction element 220 in the form of the projection can be readily provided on the fourth face 204 of the cartridge 20.

A-7-6. Advantageous Effects of Projection 260

As shown in FIG. 27, according to this embodiment, the cartridge 20 has the projection 260 on the +Z-axis direction side of the first cartridge-side restriction portion 210 on the third face 203. For detachment of the cartridge 20 from the holder 60, applying the force to the operating member 830 of the lever 80 from the +X-axis direction side to the −X-axis direction side causes the operating member 830 to be in contact with the projection 260 and press the projection 260 in the direction Yh including the +Z-axis direction vector component. The projection 260 accordingly receives the force of +Z-axis direction vector component. This facilitates detachment of the cartridge 20 from the holder 60 by using the operating member 830. Even when the cartridge 20 is stuck by some part of the holder 60 and is not moved in the +Z-axis direction through the travel of the first cartridge-side locking surface 211 from the first locking position 810L in the +X-axis direction, the third face 203-side of the cartridge 20 can be moved in the +Z-axis direction by using the projection 260.

Although the external force is directly applied from the operating member 830 to the projection 260 according to the embodiment, the external force may not be applied from the operating member 830 to the projection 260. Turning the operating member 830 disengages the engagement portion 810 from the first cartridge-side restriction portion 210 and eliminates the restriction on the motion of the third face 203-side of the cartridge 20 in the +Z-axis direction. Eliminating the restriction on the motion of the cartridge 20 in the +Z-axis direction causes the third face 203-side of the cartridge 20 to move in the +Z-axis direction by the pressing force Pt from the contact mechanism 70. The projection 260 of the cartridge 20 simultaneously moves in the direction Yh. The user holds the periphery of the projection 260 moving in the direction Yh and readily detaches the cartridge 20 from the holder 60. Providing the projection 260 improves the operability for detachment of the cartridge 20 from the holder 60 even without direct application of the external force from the operating member 830 to the projection 260.

A-7-7. Advantageous Effects of Position of Ink supply structure 280

As shown in FIG. 27, according to this embodiment, the ink supply structure 280 is provided at the position closer to the fourth face 204 than the third face 203 on the first face 201. The distance between the outer surface of the ink supply structure 280 and the third face 203 in the X-axis direction is accordingly greater than the distance between the outer surface of the ink supply structure 280 and the fourth face 204. The cartridge-side terminals 400 are provided on the sloped terminal bearing structure 408 adjacent to the third face 203. In other words, the ink supply structure 280 is provided at the position away from the cartridge-side terminals 400. This reduces the possibility that ink adheres to the cartridge-side terminals 400 and prevents the poor contact between the cartridge-side terminals 400 and the device-side terminals 700.

A-7-8. Advantageous Effects of Ground Terminal 437

According to this embodiment, as shown in FIG. 10A, among the contact portions cp of the cartridge-side terminals 400, the ground terminal 437 having the contact portion cp on the center in the Y-axis direction is provided at the position intersecting the plane Yc passing through the center of the width (Y-axis direction length) of the cartridge 20. The ground terminal 437 is configured to be in contact with the contact mechanism 70 prior to the other cartridge-side terminals 431 to 436, 438 and 439 in the course of attachment of the cartridge 20 to the holder 60. The pressing force first applied from the holder 60 to the circuit board 40 is thus generated on the substantial center of the width or the Y-axis direction length of the cartridge 20. This prevents the pressing force applied to the circuit board 40 from acting to tilt the cartridge 20 in the Y-axis direction and thereby enables the attachment of the cartridge 20 at the designed attachment position. Such contact of the ground terminal 437 with the contact mechanism 70 of the holder 60 prior to the other cartridge-side terminals 431 to 436, 438 and 439 advantageously prevents or reduces the high voltage-induced troubles and failures by the grounding function of the ground terminal 437, even when an unexpected high voltage is applied to the cartridge 20.

A-7-9. Advantageous Effects of Shape of First Device-Side Locking Surface 811

As shown in FIG. 21, the first device-side locking surface 811 is the curved surface in the arc shape about the axis of rotation 800*c* on the cross section parallel to the X axis and the Z axis. This ensures the smooth operations for attachment and detachment of the cartridge 20 to and from the holder 60. Forming the first device-side locking surface 811 as the curved surface decreases the press-back amount in the +Z-axis direction by the elastic member 648 (FIG. 27) in the course of attachment of the cartridge 20 to the holder 60. This ensures the good electrical contact between the cartridge-side terminals 400 and the device-side terminals 700.

Figure 32A:
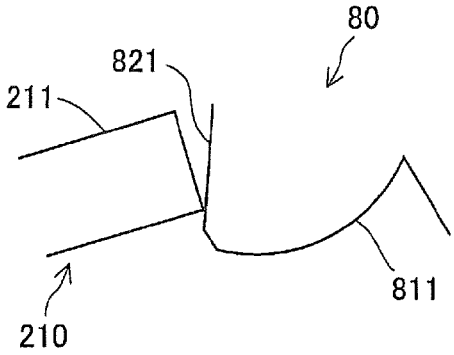
FIGS. 32A to 32F show one example of advantageous effect.
Figure 32D:
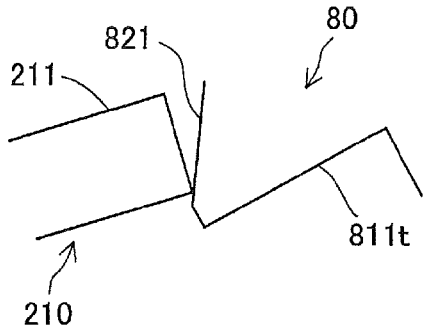
Figure 32B:
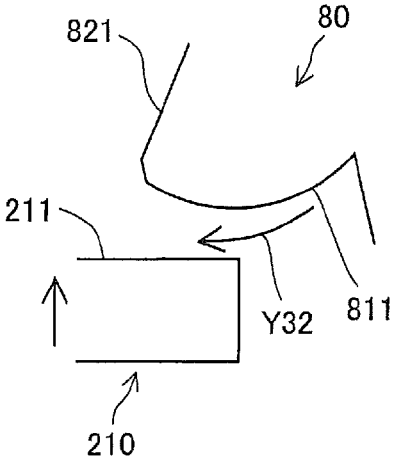
Figure 32E:
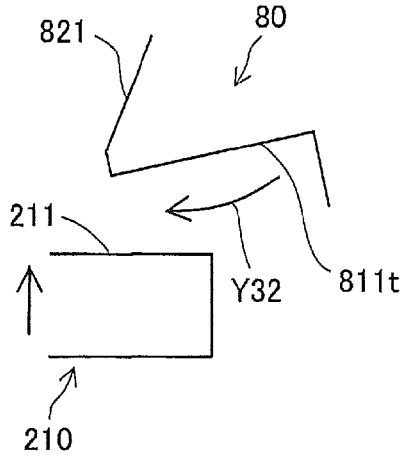
Figure 32C:
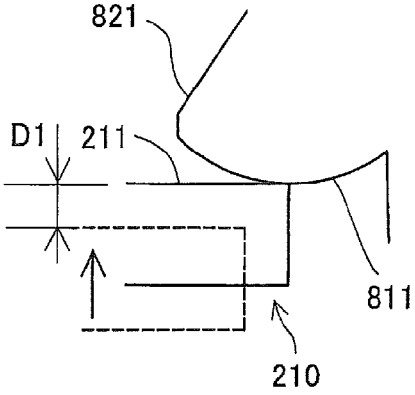
Figure 32F:
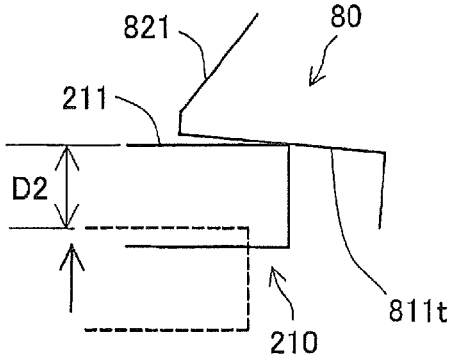

One example of such advantageous effect is described with reference to FIGS. 32A to 32F. The vertical direction of FIGS. 32A to 32F corresponds to the Z-axis direction; the upward direction of the drawings corresponds to the +Z-axis direction and the downward direction corresponds to the −Z-axis direction which directions are opposite each other. FIGS. 32A to 32C show attachment of a cartridge using the first device-side locking surface 811 formed as the curved surface and are arranged in time series in this order. FIGS. 32D to 32F show attachment of a cartridge using a first device-side locking surface 811*t* formed as a plane and are arranged in times series in this order.

As shown in FIG. 32A, for attachment of the cartridge 20 to the holder 60, the first cartridge-side restriction portion 210 moves in the −Z-axis direction while abutting the guide bottom wall 821. As shown in FIG. 32B, when the first cartridge-side restriction portion 210 moves through the guide bottom wall 821 further in the −Z axis direction, the first device-side locking surface 811 moves in the direction of arrow Y32. When the user strongly presses the cartridge 20 in the −Z-axis direction, the first cartridge-side restriction portion 210 is located on the −Z-axis direction side of the first device-side locking surface 811. When the user loses hold of the cartridge 20, the cartridge 20 is pressed upward in the +Z-axis direction by the pressing forces Ps and Pt of the elastic member 648 and the device-side terminals 700. As shown in FIG. 32C, the pressed-up amount of the first cartridge-side restriction portion 210 of the cartridge 20 is D1 when the first device-side locking surface 811 is formed as the curved surface.

As shown in FIGS. 32D to 32F, when the first device-side locking surface 811*t* is formed as the plane, the pressed-up amount of the first cartridge-side restriction portion 210 is D2, which is greater than D1.

In the attached state of the cartridge 20, the first device-side locking surface 811 formed as the curved surface can be located on the more −Z-axis direction side than the first device-side locking surface 811*t* formed as the plane. This reduces the pressed-up amount of the first cartridge-side restriction portion 210.

According to this embodiment, the first device-side locking surface 811 located at the preset or first locking position 810L is close to the axis of rotation 800*c* in the X-axis direction (FIG. 21). This reduces the moving distance of the first device-side locking surface 811 in the Z-axis direction even when the actual locking position is deviated in the X-axis direction from the first locking position 810L. This accordingly prevents deviation of the cartridge 20 in the Z-axis direction relative to the holder 60.

B. Additional Embodiment

Figure 33:
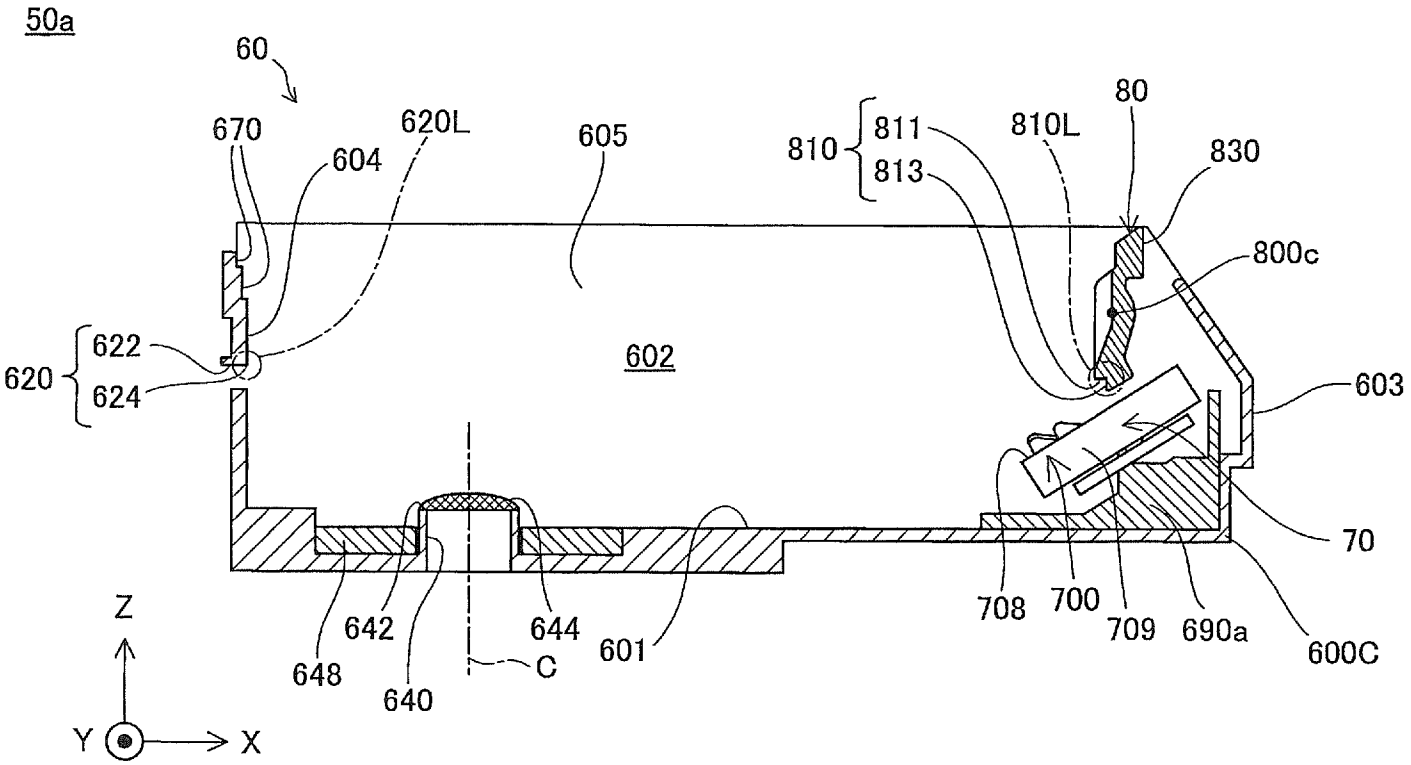
FIG. 33 illustrates a printer according to a second embodiment.

FIG. 33 illustrates a printer 50*a* according to a second embodiment. FIG. 33 shows the cross section corresponding to the cross section of FIG. 17 according to the first embodiment. The difference from the printer 50 of the first embodiment is that a retainer 690*a* does not have the elastic member 682. Otherwise the printer 50*a* of the second embodiment has the same structure as that of the printer 50 of the first embodiment. The like elements are expressed by the like symbols and are not specifically explained here. The cartridge 20 attached to the printer 50*a* has the same structure as the cartridge 20 attached to the printer 50 of the first embodiment.

As shown in FIG. 33, the retainer 690*a* does not have an elastic member to press the lever 80 in the direction including the −X-axis direction vector component. The lever 80 is, however, designed to locate its first device-side locking surface 811 at the first locking position 810L by its dead weight, so that the first cartridge-side locking surface 211 of the cartridge 20 is locked by the first device-side locking surface 811 of the lever 80.

The printer 50*a* of the second embodiment has the similar advantageous effects to those of the printer 60 of the first embodiment. Additionally, the structure of the retainer 690 without an elastic member reduces the possible damage or breakage of the retainer 690 and decreases the total number of parts to reduce the manufacturing cost of the printer 50*a*.

C. Third Embodiment

Figure 34:
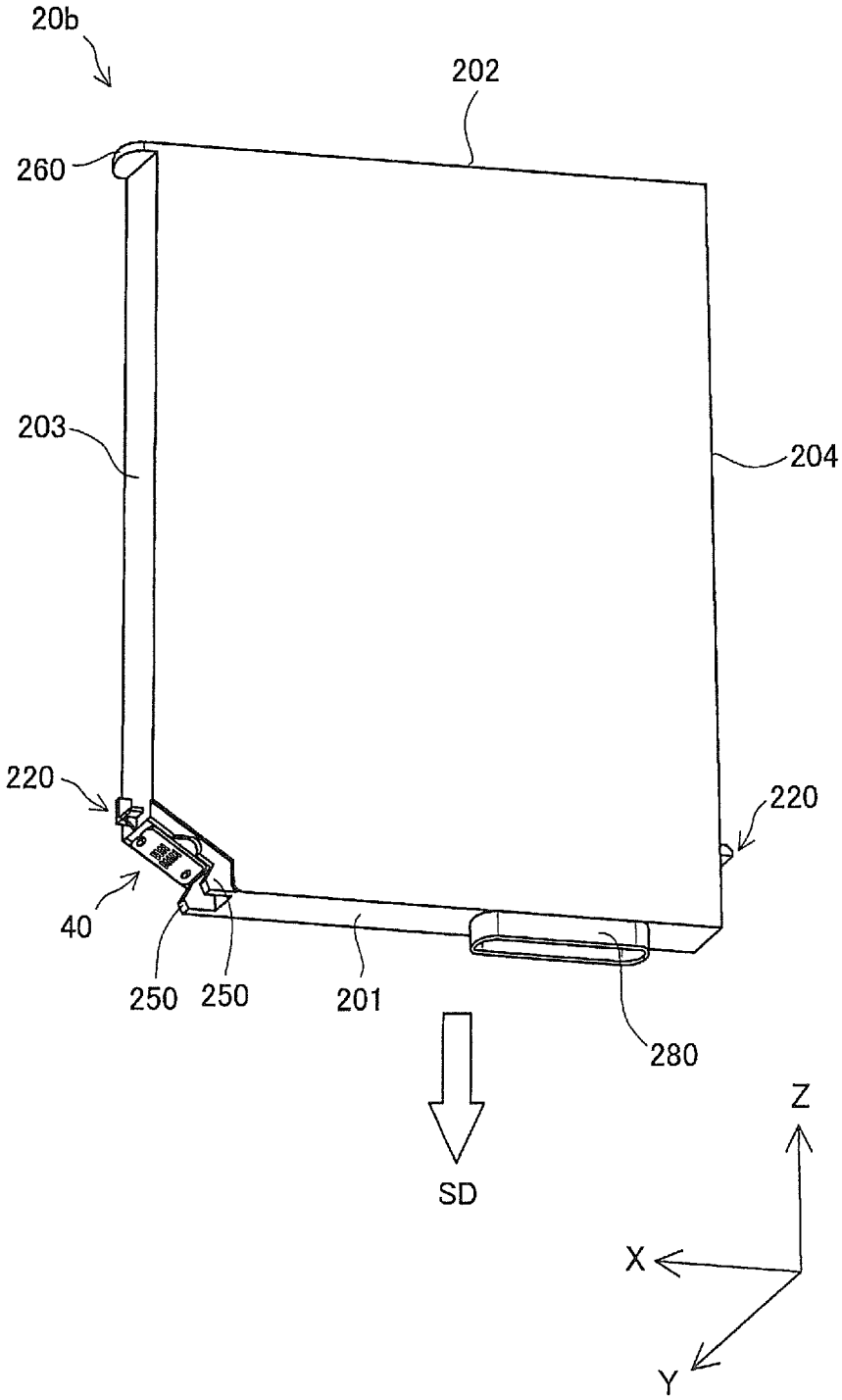
FIG. 34 is a perspective view illustrating the appearance of a cartridge according to a third embodiment.

FIG. 34 is a perspective view illustrating the appearance of a cartridge 20*b* according to a third embodiment. The difference from the cartridge 20 of the first embodiment (FIG. 7) is the size of the cartridge 20*b*. Otherwise the cartridge 20*b* of the third embodiment has the same structure as that of the cartridge 20 of the first embodiment. The like elements are expressed by the like symbols and are not specifically explained here. A printer of the third embodiment is adopted for the cartridge 20*b* but has the same structure as that of the holder 60 and the respective members (for example, lever 80) provided on the holder 60 of the first embodiment.

The cartridge 20*b* has the greater dimensions than those of the cartridge 20 of the first embodiment and is capable of containing a greater amount of ink. The cartridge 20*b* is attachable to a cartridge mounting structure of a large inkjet printer that is capable of printing large paper (e.g., sizes A2 to A0). The cartridge 20*b* is attached to the cartridge mounting structure of the large inkjet printer in the −Z-axis direction as the mounting direction SD. According to this embodiment, the −Z-axis direction is the horizontal direction. In the attached state of the cartridge 20*b* to the cartridge mounting structure, the X-axis direction is the vertical direction. More specifically, the +X-axis direction is the vertically upward direction, and the −X-axis direction is the vertically downward direction.

D. Modifications of Cartridge Structure

Figure 35A:
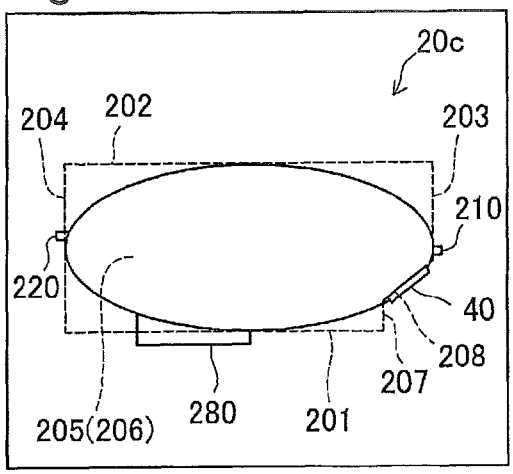
FIGS. 35A to 35H are conceptual diagrams showing cartridge outer shapes according to other embodiments.
Figure 35D:
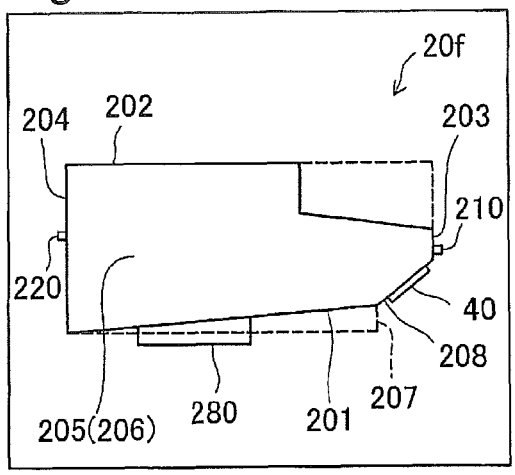
Figure 35B:
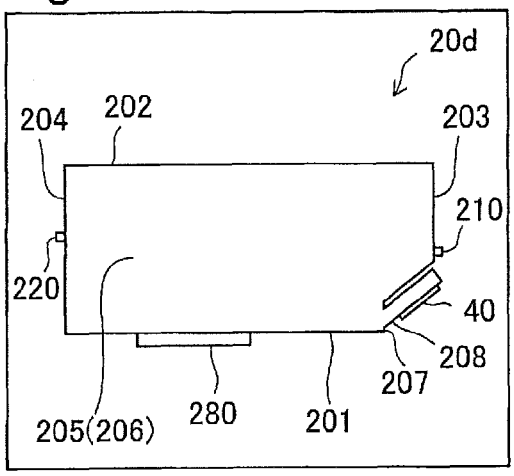
Figure 35E:
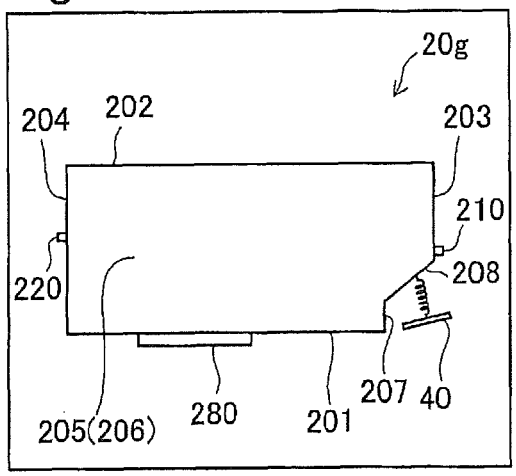
Figure 35C:
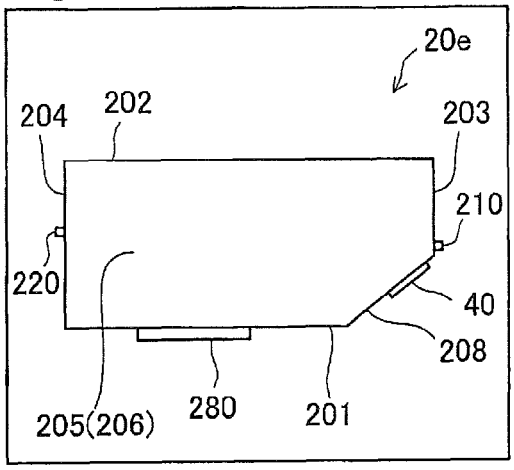
Figure 35F:
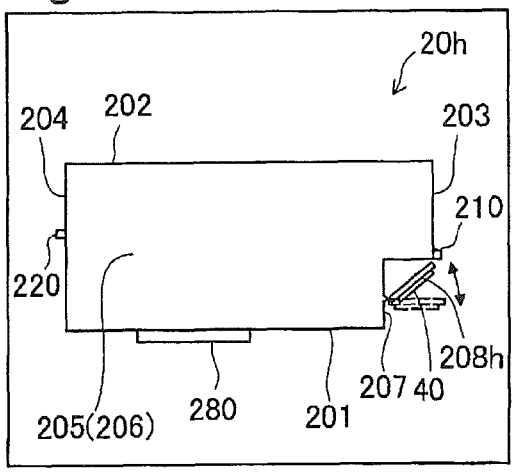
Figure 35G:
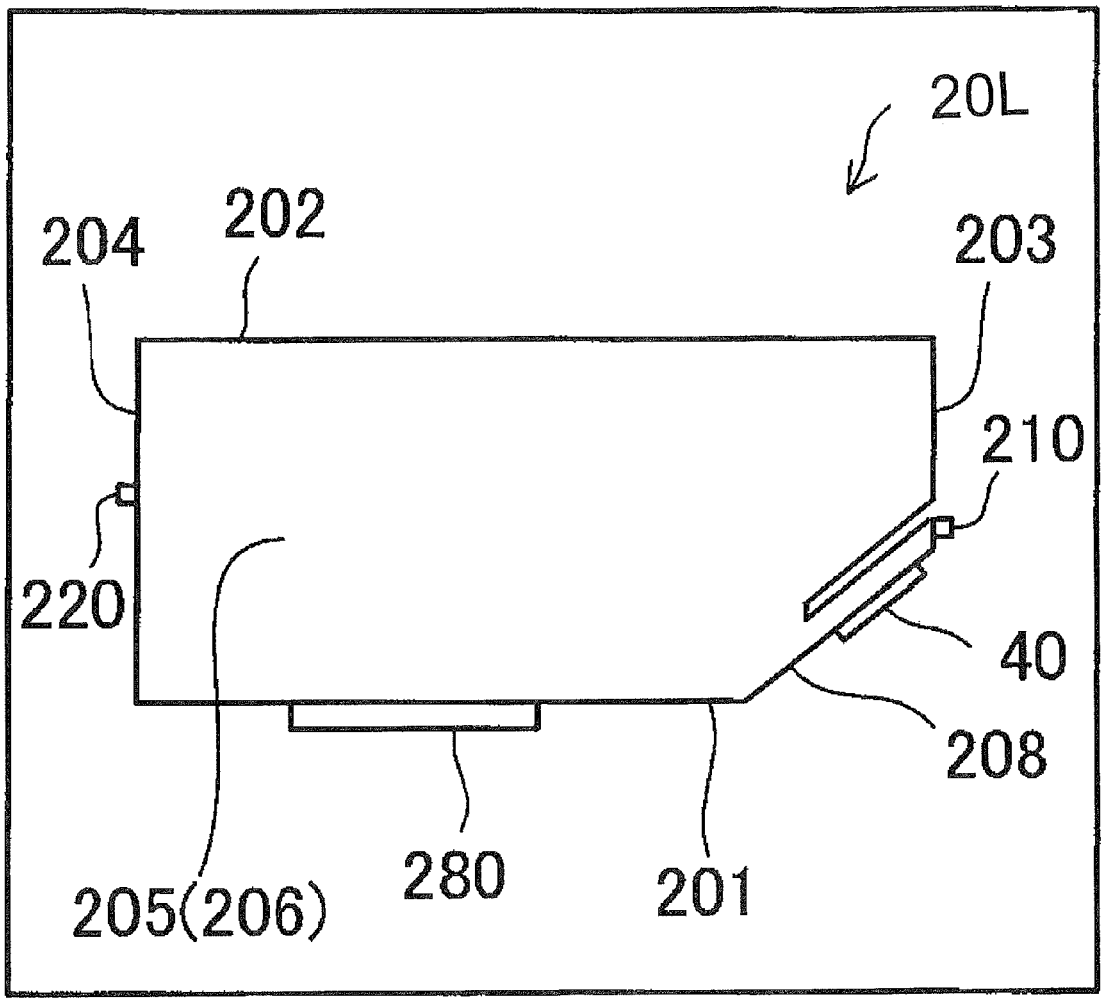
Figure 35H:
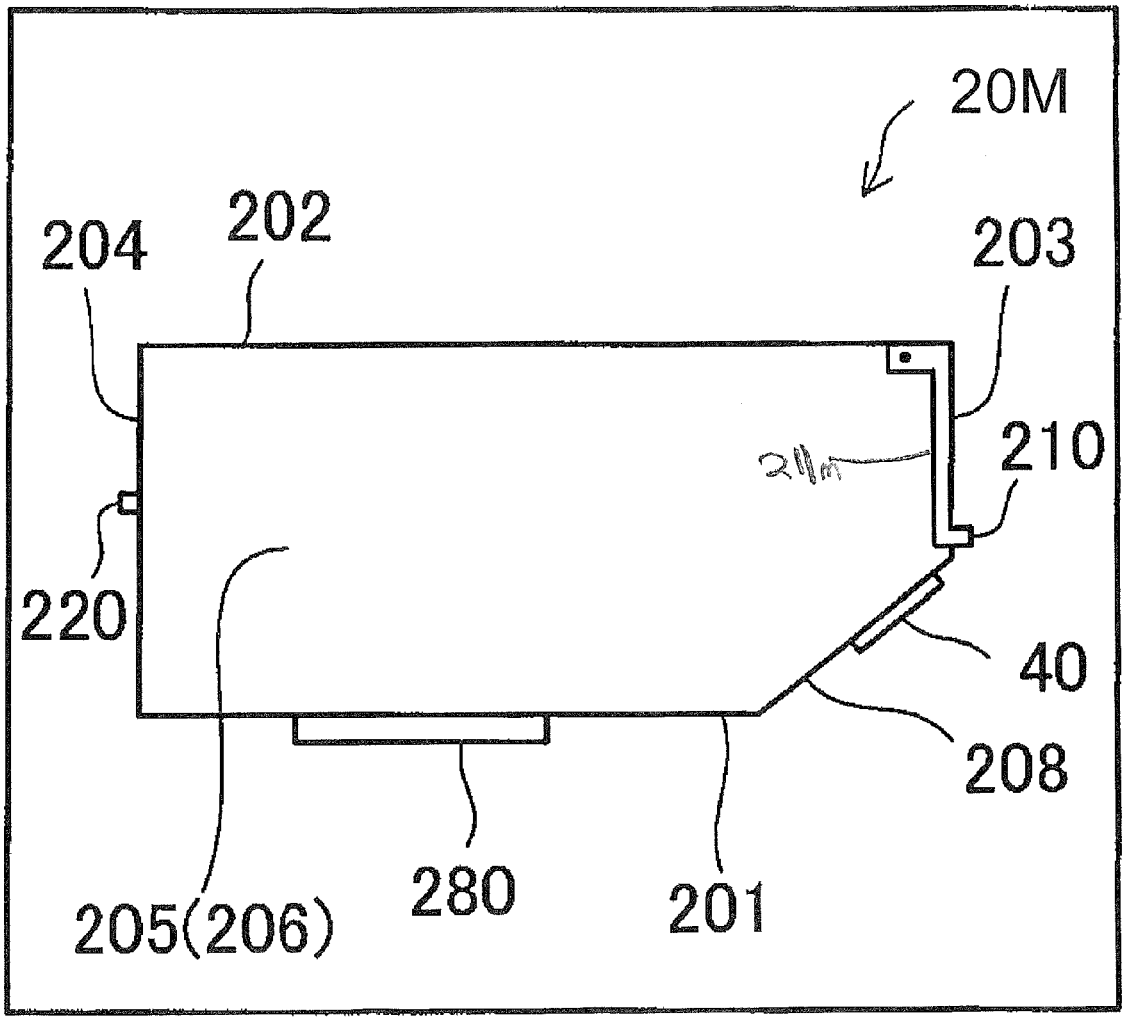
Figure 36:
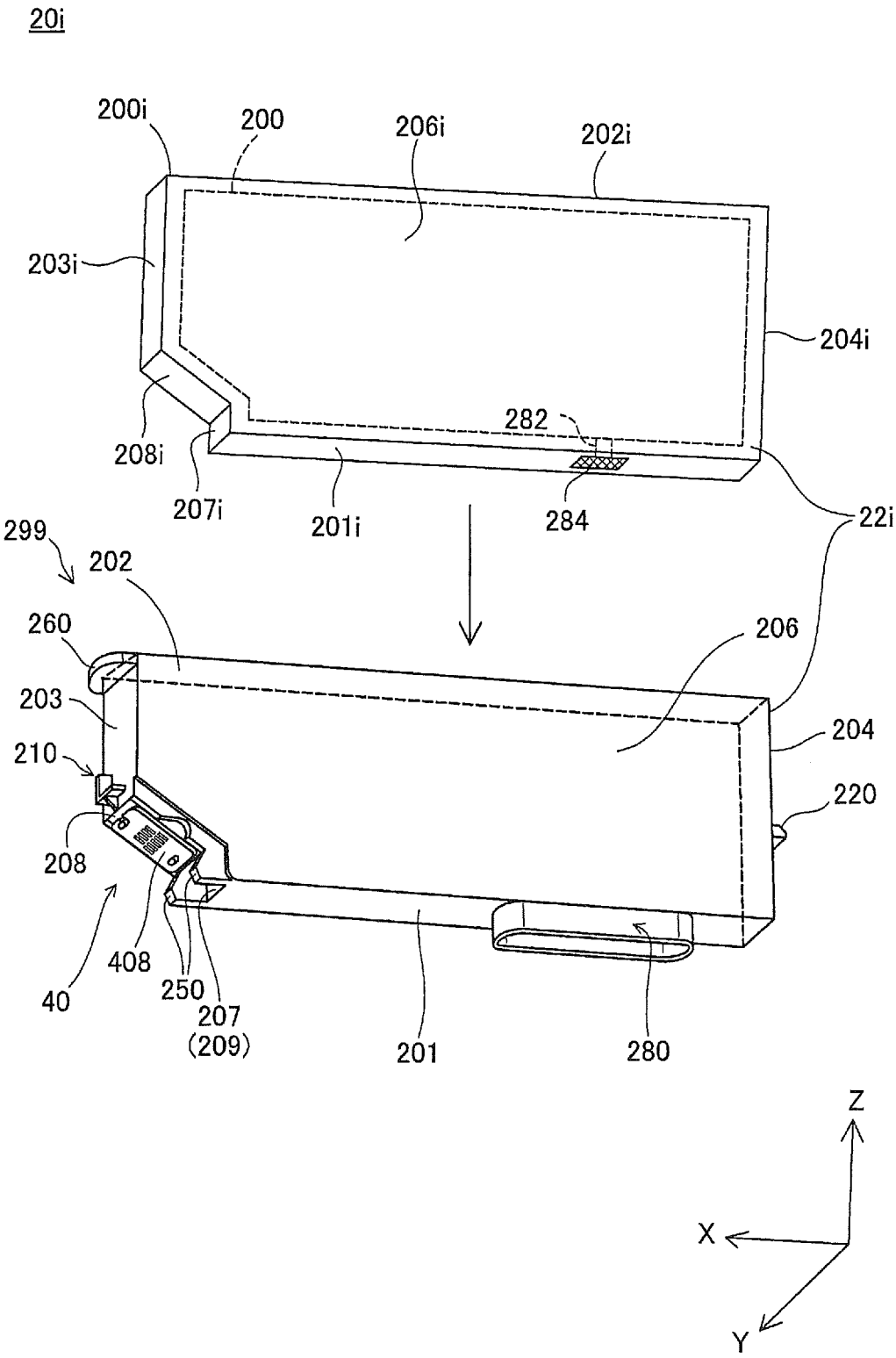
FIG. 36 is a perspective view illustrating the structure of a cartridge with an adapter according to one embodiment.
Figure 37:
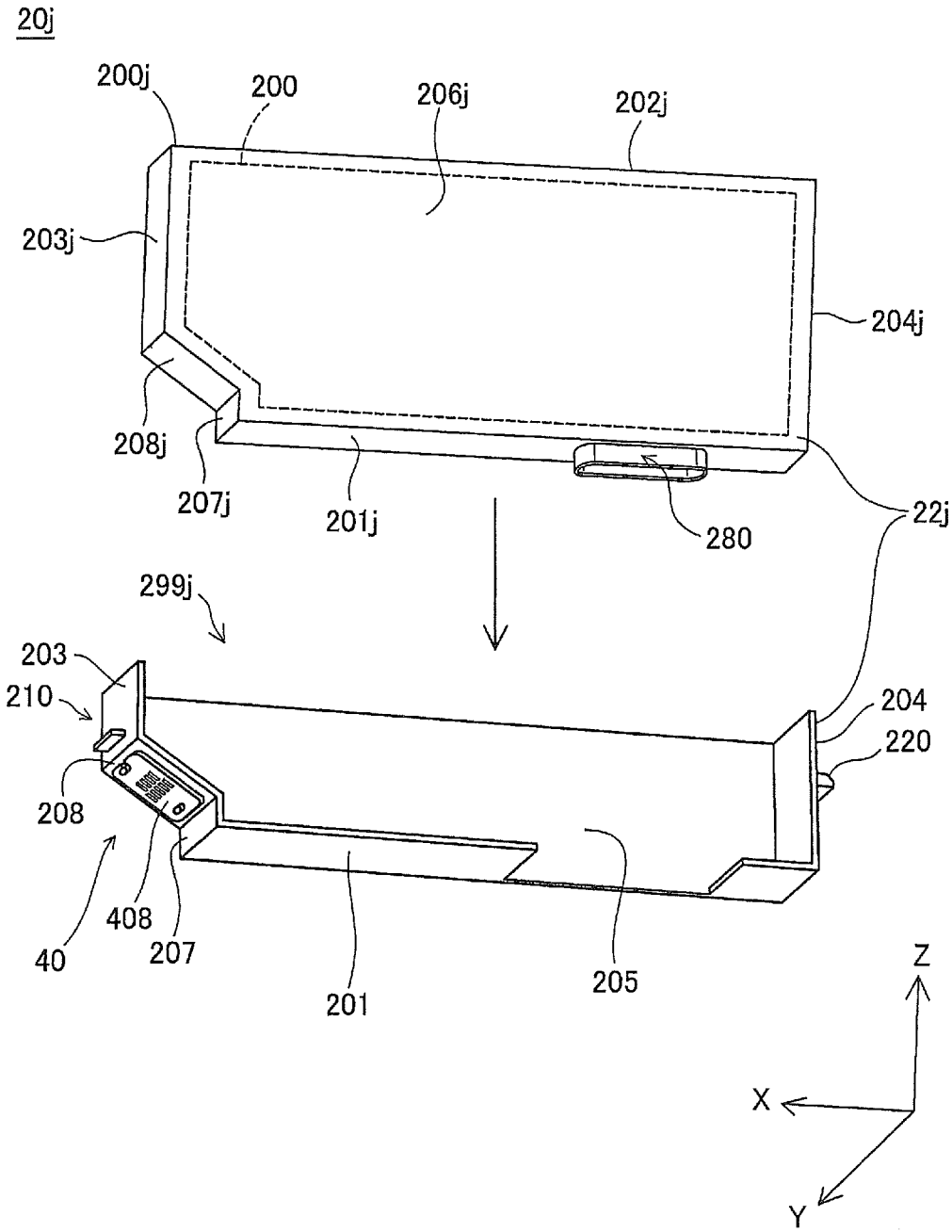
FIG. 37 is a perspective view illustrating the structure of a cartridge with an adapter according to another embodiment.

FIGS. 35 to 37 show modifications of cartridge structure. These cartridges are designed for the printer having the same structure as that of the printer 50 according to the first embodiment. The like elements of these cartridges to those of the cartridge 20 of the first embodiment are expressed by the like symbols.

D-1. Modifications of Cartridge Outer Shape

FIGS. 35A to 35H are conceptual diagrams showing cartridge outer shapes according to other embodiments. A cartridge 20*c* shown in FIG. 35A has a housing of an elliptical or oval side face. The cartridge 20*c* has the first cartridge-side restriction portion 210 and the circuit board 40 provided on the front face. The ink supply structure 280 is formed on the bottom face of the cartridge 20*c*, and the second cartridge-side restriction element 220 is provided on the rear face of the cartridge 20*c*. This cartridge 20*c* has a fixed width, when the cartridge 20*c* is seen from its front face side. This cartridge 20*c* is compatible with the cartridge 20 shown in FIG. 7, as long as the first and second cartridge-side restriction elements 210 and 220, the circuit board 40 and the ink supply structure 280 are structured to be connectable with the corresponding parts in the printer 50.

A cartridge 20*d* shown in FIG. 35B has an approximate rectangular parallelepiped shape like the cartridge 20 shown in FIG. 7. The large difference from the cartridge 20 of FIG. 7 is that the eighth face 208 is not continuous from the lower end of the third face 203. Cartridge 20L shown in FIG. 35G is similar in shape and design to cartridge 20*d* with the placement of the first cartridge-side restriction element 210 provided closer to the terminal bearing structure 408. Cartridges 20*e* and 20*f* shown in FIGS. 35C and 35D have no seventh face, which is included in the cartridge 20 of FIG. 7. A cartridge 20*g* shown in FIG. 35E has the circuit board 40 mounted on the eighth face 208 by means of a spring. A cartridge 20*h* shown in FIG. 35F has a hinged or otherwise movable face 208*h*, in place of the eighth face 208, and the circuit board 40 mounted on the movable face 208*h*. These cartridge 20*c* to 20*g* are also compatible with the cartridge 20 shown in FIG. 7, as long as the first and second cartridge-side restriction elements 210 and 220, the circuit board 40 and the ink supply structure 280 are structured to be connectable with the corresponding parts in the printer 50. A cartridge 20*m* shown in FIG. 35H has an elongated member 211*m* which is connected at one end to the first cartridge-side restriction element 210 and at the other end to the top of the cartridge 202 via a hinge or other pivotable mechanism.

As clearly understood from the examples shown in FIGS. 35A to 35H, there are various other modifications of cartridge outer shape. In the case of the cartridge having the outer shape other than the approximate rectangular parallelepiped, as shown by the broken lines in FIGS. 35A and 35D, the six faces of the rectangular parallelepiped, i.e., the bottom face 201 (first face), the top face 202 (second face), the front face 203 (third face), the rear face 204 (fourth face), the left side face 205 (fifth face) and the right side face 206 (sixth face) can be virtually assumed. In the specification hereof, the terms "face" and "plane" mean a virtual plane or the non-existent (imaginary) plane as shown in FIG. 35A or 35D and the actual plane as shown in FIGS. 7 and 8. The terms "face" and "plane" include both planar surfaces and curved surfaces.

D-2. Cartridge with Adapter

FIG. 36 is a perspective view illustrating the structure of a cartridge 20*i* with an adapter according to one embodiment. This cartridge 20*i* is separable into a container assembly 200*i* including the ink chamber 200 and an adapter 299 which can then be mated together for mounting into the holder of the printing apparatus. After the printing material in the ink chamber 200 is used up, the user replaces the container assembly 200*i* with a new one or refills the printing material into the container assembly 200*i*. The adapter 299 is reusable. This cartridge 20*i* is compatible with the cartridge 20 of the first embodiment shown in FIG. 7.

A housing 22*i* for the cartridge 20*i* is structured as a combination of a housing for the container assembly 200*i* and a housing for the adapter 299*i*. The container assembly 200*i* includes the ink chamber 200 configured to contain ink, the printing material flow path 282 configured to supply ink or printing material to the ink supply structure and the resin foam 284. The container assembly 200*i* has a second face 202*i* corresponding to the second face 202 of the cartridge 20*i*. The container assembly 200*i* also has a first face 201*i*, a third face 203*i*, a fourth face 204*i*, a fifth face (not shown), a sixth face 206*i*, a seventh face 207*i* and an eighth face 208*i* respectively corresponding to the first face 201 and the third to the eighth faces 203 to 208 of the cartridge 20*i*. The first face 201*i* and the second face 202*i* are opposed to each other in the Z-axis direction; the first face 201*i* is located on the −Z-axis direction side and the second face 202*i* is located on the +Z-axis direction side. The third face 203*i* and the fourth face 204*i* are opposed to each other in the X-axis direction; the third face 203*i* is located on the +X-axis direction side and the fourth face 204*i* is located on the −X-axis direction side. The fifth face (not shown) and the sixth face 206*i* are opposed to each other in the Y-axis direction; the fifth face (not shown) is located on the −Y-axis direction side and the sixth face 206*i* is located on the +Y-axis direction side. The seventh face 207*i* and the eighth face 208*i* form the connection faces of connecting the first face 201*i* with the third face 203*i*. The seventh face 207*i* is perpendicular to the first face 201*i* and forms a plane parallel to the Y axis and the Z axis (YZ plane). The seventh face 207*i* as the step is vertically-angled relative to the first face 201*i*. The seventh face 207*i* is accordingly extended from the first face 201*i* in the +Z-axis direction. The seventh face 207*i* is located on the −X-axis direction side and on the −Z-axis direction side of the eighth face 208*i*. The eighth face 208*i* connects the seventh face 207*i* with the third face 203*i* and is a sloped surface inclined in the direction including a +X-axis direction vector component and a −Z-axis direction vector component. The eighth face 208*i* is inclined to the first face 201*i* and the third face 203*i* and is perpendicular to the fifth face (not shown) and the sixth face 206*i*. In other words, the eighth face 208*i* is inclined to the XY plane and the YZ plane and is perpendicular to the XZ plane.

The adapter 299 has the faces corresponding to the first face 201, the third face 203, the fourth face 204, the fifth face 205, the sixth face 206, the seventh face 207 and the eighth face 208 of the cartridge 20*i*. The face of the adapter 299 corresponding to the second face 202 of the cartridge 20*i* is an opening. The adapter 299 has an inner space to receive the container assembly 200*i*. The first face 201 of the adapter 200 has the ink supply structure 280. Otherwise the cartridge 20*i* has the similar structure to that of the cartridge 20 of the first embodiment shown in FIG. 7 with our without some variations. The first cartridge-side restriction portion 210 can be on the adapter 299 as shown in FIG. 36 or on the container assembly 200*i* (not shown). Similarly, circuit board 40 can be can be on the adapter 299 as shown in FIG. 36 or on the container assembly 200*i* (not shown). The positioning of restriction portion 210 and circuit board 40 need not both be on the cartridge 20*i* or adapter 299, rather one can be on cartridge 20*i* and the other can be on adapter 299. The cartridge 20*i* may thus be structured as the combination of the container assembly 200*i* and the adapter 299 as described above.

FIG. 37 is a perspective view illustrating the structure of a cartridge 20*j* with an adapter according to another embodiment. This cartridge 20*j* is separable to a container assembly 200*j* including the ink chamber 200 and an adapter 299*j* which can then be mated together for mounting into the holder of the printing apparatus. After the printing material in the ink chamber 200 is used up, the user may replace the container assembly 200*j* with a new one or refill the printing material into the container assembly 200*j*. The adapter 299 is reusable. This cartridge 20*j* is compatible with the cartridge 20 of the first embodiment shown in FIG. 7.

A housing 22*j* for the cartridge 20*j* is structured as a combination of a housing for the container assembly 200*j* and a housing for the adapter 299*j*. The container assembly 200*j* includes the ink chamber 200 configured to contain ink and the ink supply structure 280. The container assembly 200*j* has a second face 202*j* and a sixth face 206*j* respectively corresponding to the second face 202 and the sixth face 206 of the cartridge 20*j*. The container assembly 200*j* also has a first face 201*j*, a third face 203*j*, a fourth face 204*j*, a fifth face (not shown), a seventh face 207*j* and an eighth face 208*j* respectively corresponding to the first face 201, the third face 203, the fourth face 204, the fifth face 205, the seventh face 207 and the eighth face 208 of the cartridge 20*j*. The first face 201*j* and the second face 202*j* are opposed to each other in the Z-axis direction; the first face 201*j* is located on the −Z-axis direction side and the second face 202*j* is located on the +Z-axis direction side. The third face 203*j* and the fourth face 204*j* are opposed to each other in the X-axis direction; the third face 203*j* is located on the +X-axis direction side and the fourth face 204*j* is located on the −X-axis direction side. The fifth face (not shown) and the sixth face 206*j* are opposed to each other in the Y-axis direction; the fifth face (not shown) is located on the −Y-axis direction side and the sixth face 206*j* is located on the +Y-axis direction side. The seventh face 207*j* and the eighth face 208*j* form the connection faces of connecting the first face 201*j* with the third face 203*j*. The seventh face 207*j* is perpendicular to the first face 201*j* and forms a plane parallel to the Y axis and the Z axis (YZ plane). The seventh face 207*j* as the step is vertically-angled relative to the first face 201*j*. The seventh face 207*j* is accordingly extended from the first face 201*j* in the +Z-axis direction. The seventh face 207*j* is located on the −X-axis direction side and on the −Z-axis direction side of the eighth face 208*j*. The eighth face 208*j* connects the seventh face 207*j* with the third face 203*j* and is a sloped surface inclined in the direction including a +X-axis direction vector component and a −Z-axis direction vector component. The eighth face 208*j* is inclined to the first face 201*j* and the third face 203*j* and is perpendicular to the fifth face (not shown) and the sixth face 206*j*. In other words, the eighth face 208*j* is inclined to the XY plane and the YZ plane and is perpendicular to the XZ plane.

The adapter 299*j* has the faces corresponding to the first face 201, the third face 203, the fourth face 204 and the fifth face 205 of the cartridge 20*j*. The faces of the adapter 299*j* forming the second face 202 and the sixth face 206 of the cartridge 20*j* are openings. The adapter 299*j* has an inner space to receive the container assembly 200*j*. The adapter 299*j* also has an opening in part of the first face 201. The ink supply structure 280 provided in the container assembly 200*j* is exposed on the opening provided on the first face 201 of the adapter 299*j* and is connected with the printing material supply tube 640 (FIG. 2). The cartridge 20*j* has a first cartridge-side restriction portion 210 of the simpler structure than that of the first embodiment (FIG. 7) but may have the first cartridge-side restriction portion 210 of the same structure as that of the first embodiment (FIG. 7). Alternatively, the first cartridge-side restriction portion 210 can be a part of the adapter 299*j* as shown in FIG. 36 or a part of the container assembly 200*j* (not shown). Similarly, circuit board 40 can be on the adapter 299*j* as shown in FIG. 36 or on the container assembly 200*j* (not shown). The positioning of restriction portion 210 and circuit board 40 need not both be on the cartridge 20*j* or adapter 299*j*, rather one can be on cartridge 20*j* and the other can be on adapter 299*j*. The cartridge 20*j* has the third face 203 and the fourth face 204 of the lower heights (shorter Z-axis direction lengths) than those of the third face 203 and the fourth face 204 of the first embodiment but may have the third face 203 and the fourth face 204 of the same heights (same Z-axis direction lengths) as those of the first embodiment. The cartridge 20*j* does not have the projection 260 but may have the projection 260 like the first embodiment. Otherwise the cartridge 20*j* has the similar structure to that of the cartridge 20 of the first embodiment shown in FIG. 7 with or without some variations. The cartridge 20*j* may thus be structured by the combination of the container assembly 200*j* and the adapter 299*j* as described above.

Figure 38:
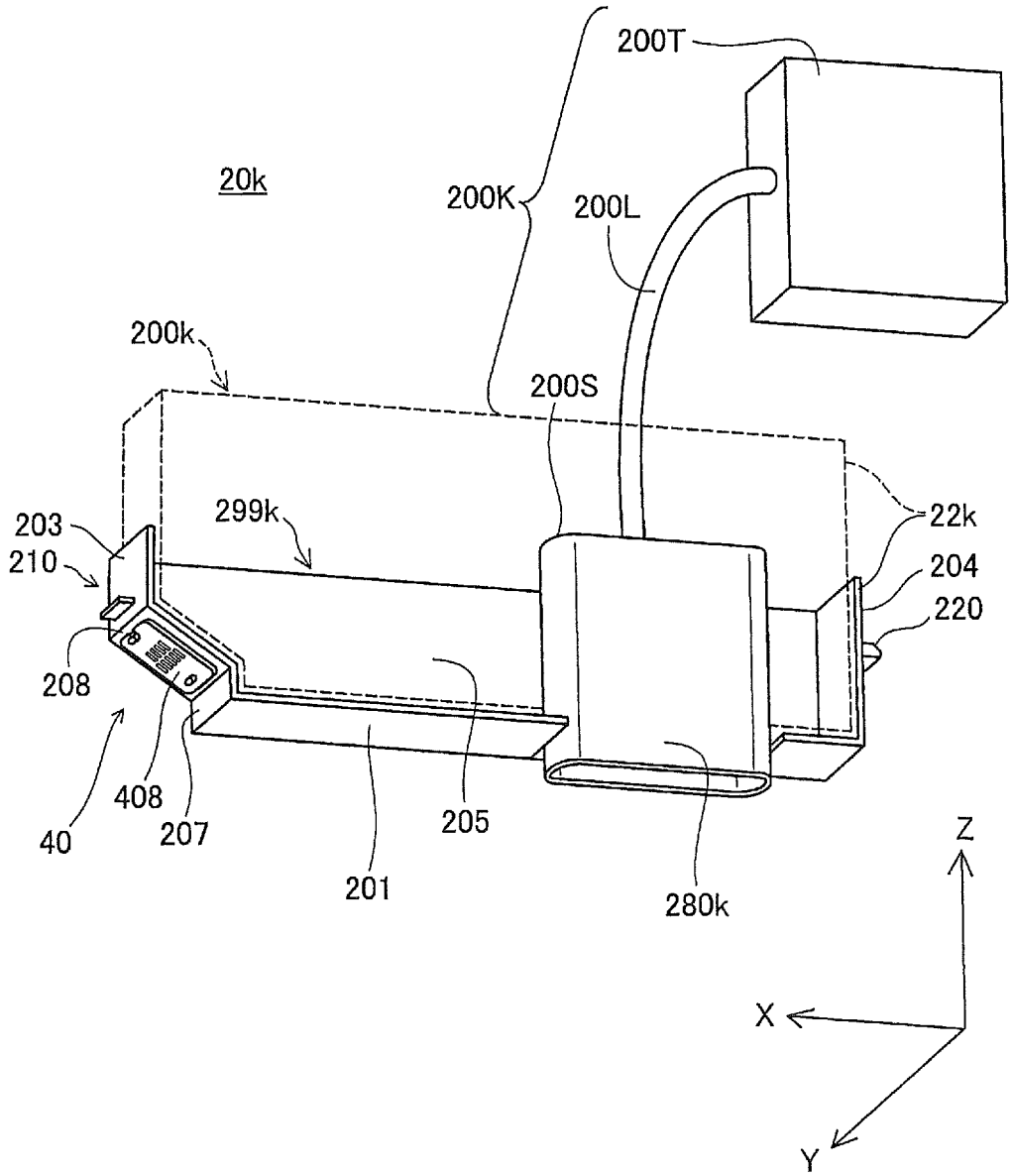
FIG. 38 is a perspective view illustrating the structure of a cartridge with an adapter according to another embodiment.

FIG. 38 is a perspective view illustrating the structure of a cartridge 20*k* with an adapter according to another embodiment. The cartridge 20*k* includes an adapter 299*k*, an external tank 200T, a tube 200L and an auxiliary adapter 200S which can all be mated together for mounting into the holder of the printing apparatus. The adapter 299*k* has the same structure as that of the adapter 299*j* described above with reference to FIG. 37. The external tank 200T contains printing material and is located outside the printer 50 shown in FIG. 1. The auxiliary adapter 200S has an ink supply structure 280*k*. The tube 200L is used to supply the printing material from the external tank 200T to the auxiliary adapter 200S. The external tank 200T, the auxiliary adapter 200S and the tube 200L serves as a container assembly 200*k* configured to contain ink or printing material. As shown by the broken line in FIG. 38, the cartridge 20*k* of this embodiment is thus assumed to have the container assembly 200*k*. The cartridge 20*k* of this embodiment is thus separable to the container assembly 200*k* and the adapter 299*k*, like the cartridge 20*i* shown in FIG. 36 and the cartridge 20*j* shown in FIG. 37. After the printing material in the external tank 200T is used up, the user may replace the external tank 200T with a new one or refill the printing material into the external tank 200T. The adapter 299*k* is reusable. This cartridge 20*k* is compatible with the cartridge 20 of the first embodiment shown in FIG. 7.

A housing 22*k* of the cartridge 20*k* is structured as a combination of a housing for the virtual container assembly 200*k* and a housing for the adapter 299*k*. The structure of the virtual container assembly 200*k* and the structure of the adapter 299*k* are similar to the structure of the cartridge 20*j* described above with reference to FIG. 37 with our without some variations. Otherwise the cartridge 20*k* has the similar structure to that of the cartridge 20 of the first embodiment shown in FIG. 7 with or without some variations. The cartridge 20*k* may thus be structured by the combination of the container assembly 200*k* and the adapter 299*k* as described above.

E. Modification of Lever

According to the above embodiment, the elastic member 682 is provided separately from the lever 80 (FIG. 22). The lever 80 may be made of an elastically deformable material. A modification of the lever is described with reference to FIGS. 39 and 40.

Figure 39A:
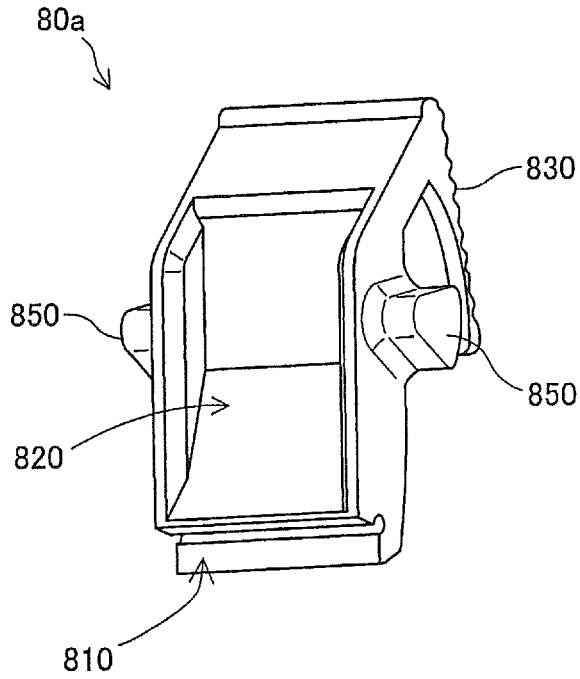
FIGS. 39A and 39B illustrate the structure of a lever according to one modification.
Figure 39B:
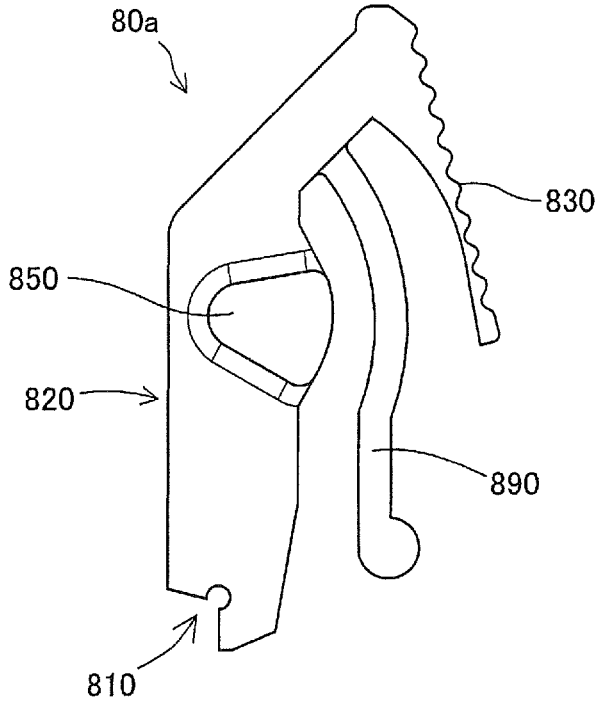

FIGS. 39A and 39B illustrate the structure of a lever 80*a* according to one modification. FIG. 39A is a perspective view showing the appearance of the lever 80*a*, and FIG. 39B is a side view showing the appearance of the lever 80*a*. The differences from the lever 80 of the first embodiment are that the lever 80*a* additionally has an arm member 890 to be elastically deformable, has an operating member 830*a* of a different shape and does not include the groove 870. Otherwise the lever 80*a* has the similar structure to that of the lever 80 according to the first embodiment (FIG. 19). The lever 80*a* is made of a synthetic resin, such as polypropylene.

Figure 40:
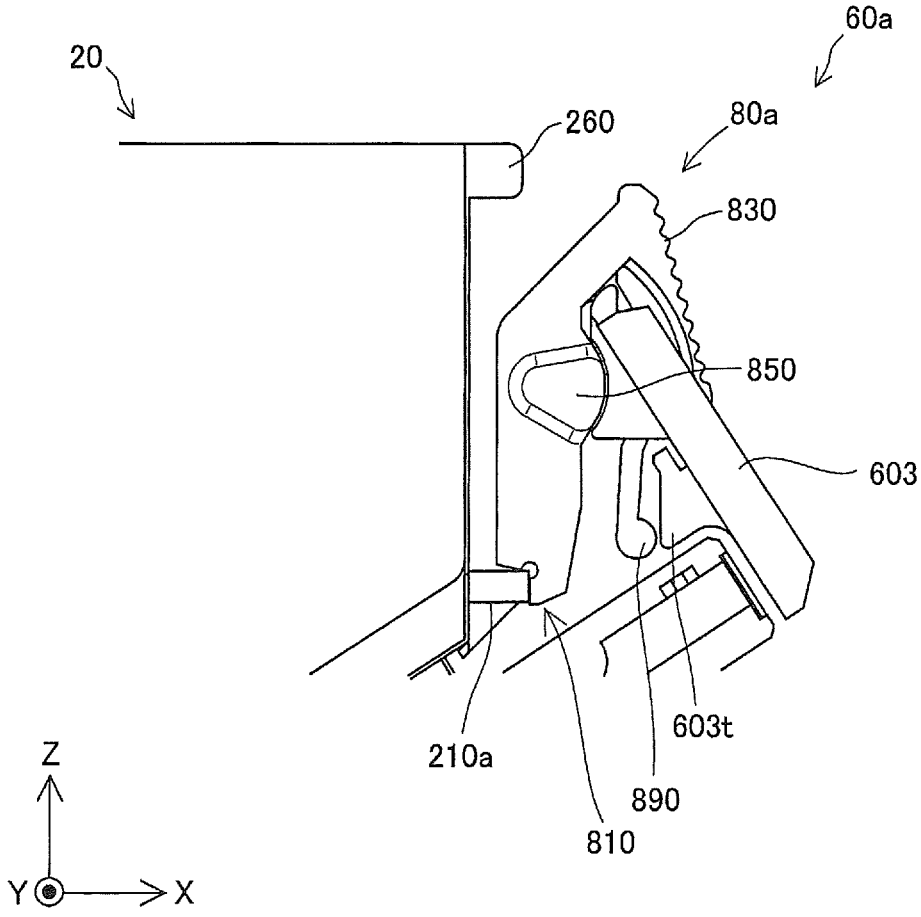
FIG. 40 illustrates attachment of the cartridge to a holder according to one modification.

FIG. 40 illustrates attachment of the cartridge 20 to a holder 60*a*. According to this embodiment, the cartridge 20 has a first cartridge-side restriction portion 210*a* without the second portion 214 (FIG. 12). The shaft body 850 of the lever 80*a* is attached to the first device-side side wall member 603. When the lever 80*a* is turned about the shaft body 850, the arm member 890*a* abuts a projection 603*t* formed as part of the first device-side side wall member 603 to be elastically deformed.

F. Modifications of Cartridge-Side Terminals

Figure 41A:
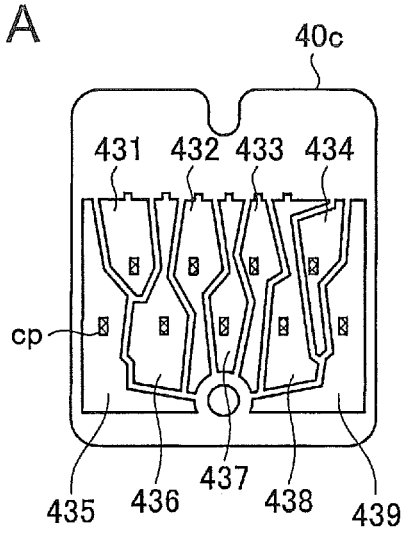
FIGS. 41A to 41C show modifications of the terminal shape.
Figure 41B:
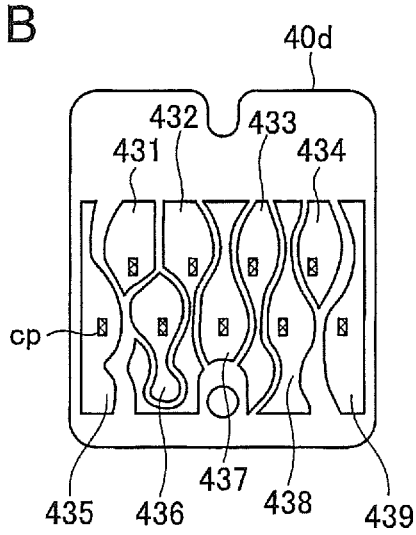
Figure 41C:
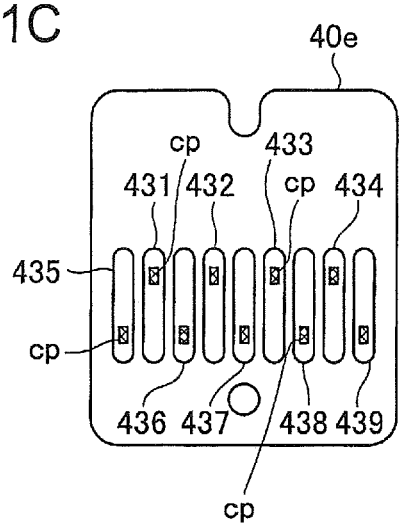

FIGS. 41A to 41C show modifications of the terminal shape on the circuit board. The difference from the circuit board 40 shown in FIG. 10A is that circuit boards 40*c* to 40*e* have different shapes of the terminals 431 to 439. The respective terminals on the circuit board 40*c* shown in FIG. 41A and on the circuit board 40*d* shown in FIG. 41B have irregular shapes, instead of the approximate rectangular shape according to the first embodiment (FIG. 10A). In the circuit board 40*e* shown in FIG. 41C, the nine terminals 431 to 439 are arrayed in one line, wherein the attachment detection terminals 435 and 439 are located on both ends, and the attachment detection terminals 431 and 434 are respectively located between the attachment detection terminal 435 and the power terminal 436 and between the attachment detection terminal 439 and the data terminal 438. In these circuit boards 40*c* to 40*e*, the contact portions cp of these terminals 431 to 439, which are in contact with the device-side terminals corresponding to these terminals 431 to 439, have the same arrangement as that of the circuit board 400 shown in FIG.

10A. The individual terminals may have the shapes of various variations as long as the contact portions cp have the same arrangement.

G. Other Modifications

The foregoing has described the invention in detail with reference to the illustrative embodiments. The invention is, however, not limited to the above embodiments, but a multiplicity of variations and modifications may be made to the embodiments without departing from the scope of the invention. Some examples of possible modifications are described below.

G-1. First Modification

The second cartridge-side restriction element 220 is provided on the fourth face 204 according to the above embodiment, but may be omitted as appropriate. For example, when there is a relatively small clearance between the cartridge 20 and each slot of the holder 60, the motion of the fourth face 204-side of the cartridge 20 in the +Z-axis direction can be restricted without the second cartridge-side restriction element 220 through abutment of the whole or part of the outer surface of the fourth face 204 with the second device-side side wall member 604. This keeps the cartridge 20 in the holder 60. According to another embodiment, an elastic member made of, for example, rubber may be provided between the fourth face 204 of the cartridge 20 and the second device-side side wall member 604 of the holder 60. The motion of the fourth face 204-side of the cartridge 20 in the +Z-axis direction may be restricted through the friction of the elastic member against the fourth face 204 of the cartridge 20 and the second device-side side wall member 604 of the holder 60. This elastic member may be a separate member from the cartridge 20 or the holder 60 or may be joined with the fourth face 204 of the cartridge 20 or with the second device-side side wall member 604 of the holder 60. In the application without the second cartridge-side restriction element 220, the second device-side restriction element 620 provided on the second device-side side wall member 604 (FIG. 15) may also be omitted.

The second cartridge-side restriction element 220 is the projection according to the above embodiment, but may be another form, for example, a recess. In this latter application, the second device-side restriction element 620 provided on the second device-side side wall member 604 may be a projection. According to another embodiment, the holder 60 may have an additional member configured to press the fourth face 204-side of the second face 202 of the cartridge 20 in the −Z-axis direction. For example, the holder 60 may have a slidable rod member. After the cartridge 20 is placed in the cartridge chamber 602, the fourth face 204-side of the second face 202 of the cartridge 20 may be pressed by the rod member.

G-2. Second Modification

The first cartridge-side restriction portion 210 is provided at the position close to the intersecting part 295 according to the above embodiment, but may be provided at any arbitrary position on the third face 203 within the range 40Y or may be extended outside of the range 40Y. (FIG. 12). Locating the first cartridge-side restriction portion 210 within the range 40 enables fine adjustment of the direction of the sloped surface with the cartridge-side terminals mounted thereon. This ensures the stable electrical connection between the cartridge-side terminals and the device-side terminals.

G-3. Third Modification

According to the above embodiment, as shown in FIG. 22, the lever 80 has the pair of shaft bodies 850, and the retainer 690 has the bearing elements 654. According to another embodiment, the lever 80 may have bearing elements, and the retainer 690 may have shaft bodies. According to the above embodiment, the lever 80 and the retainer 690 including the second retainer member 680 are unitized and attached to the holder 60 for easy assembly of the printer. The retainer 690 is, however, not essential. According to another embodiment, bearing members may be formed integrally with the outer wall 603W of the holder 60 to receive and fix the lever 80.

G-4. Fourth Modification

As mentioned above, the present invention is not restricted to the inkjet printer and its ink cartridge but is applicable to any of various liquid ejection devices configured to eject a liquid other than ink and its liquid container, for example, without limitation, the liquid ejection devices and their liquid containers given below:

1. image recording device, such as a facsimile machine;
2. color material ejection device used to manufacture color filters for image display devices, e.g., liquid crystal displays;
3. electrode material ejection device used to form electrodes of, for example, organic EL (electroluminescence) displays and field emission displays (FED);
4. liquid ejection device configured to eject a bioorganic material-containing liquid used for manufacturing biochips;
5. sample ejection device used as a precision pipette;
6. lubricating oil spray device;
7. resin solution spray device;
8. liquid spray device for pinpoint spray of lubricating oil at precision machinery including watches and cameras;
9. liquid ejection device configured to eject transparent resin solution, such as ultraviolet curable resin solution, onto the substrate, so as to manufacture a hemispherical microlens (optical lens) used for, for example, optical communication elements;
10. liquid spray device configured to spray an acidic or alkaline etching solution, in order to etch the substrate; and
11. (11) liquid ejection device equipped with liquid ejection head for ejecting a very small volume of droplets of another arbitrary liquid.

The "liquid droplet" means a state of liquid ejected from the liquid ejection device and may be in a granular shape, a teardrop shape or a tapered threadlike shape. The "liquid" herein may be any material ejectable by the liquid ejection device. The "liquid" may be any material in the liquid phase. For example, liquid-state materials of high viscosity or low viscosity, sols, gel water, various inorganic solvents and organic solvents, solutions, liquid resins and liquid metals (metal melts) are included in the "liquid". The "liquid" is not restricted to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The "ink" includes general water-based inks and oil-based inks, as well as various liquid compositions, such as gel inks and hot-melt inks, but is not limited as such.

G-5. Fifth Modification

The invention may be accomplished by the following variations. The symbols in parentheses after the elements in each of the variations correspond to the symbols of the respective elements described in the first embodiment.

First Variation

A cartridge (20) detachably attached to a printing device (50) comprises a first face (201) arranged to form an outer surface of the cartridge, the first face (201) having an ink supply structure (280) to be connected with the printing device; a second face (202) opposed to the first face (201); a third face (203) arranged to have one side (291) that is connected with the second face (202) and the other side (290) that is opposite to the one side (291), the third face (203) being located between the first face (201) and the second face (202) with respect to an opposed direction (Z-axis direction), along which the first face (201) and the second face (202) are opposed to each other; a fourth face (204) opposed to the third face (203), the fourth face (204) being arranged to connect with the first face (201) and the second face (202); a corner section (265) arranged to form an outer surface (265) of connecting the first face (201) with the third face (203); cartridge-side terminals (400) provided on the corner section (265), the cartridge-side terminals (400) being arranged to receive an external force of pressing up the cartridge (20) from device-side terminals (700) of the printing device (50) in an attached state of the cartridge (20) to the printing device (50); and a first cartridge-side restriction element (210) provided on the third face (203) and arranged to be locked by a lever (80) of the printing device (50) in the attached state and thereby restrict motion of the cartridge (20) in a press-up direction, wherein the first cartridge-side restriction element (210) is provided at a position close to the cartridge-side terminals (400).

Second Variation

A cartridge (20) detachably attached to a printing device (50) comprises a first face (201) arranged to form an outer surface of the cartridge, the first face (201) having an ink supply structure (280) to be connected with the printing device; a second face (202) opposed to the first face (201); a third face (203) arranged to have one side (291) that is connected with the second face (202) and the other side (290) that is opposite to the one side (291) and is located between the first face (201) and the second face (202) with respect to an opposed direction (Z-axis direction), along which the first face (201) and the second face (202) are opposed to each other; a fourth face (204) opposed to the third face (203), the fourth face (204) being arranged to connect with the first face (201) and the second face (202); a corner section (265) arranged to form an outer surface (265) of connecting the first face (201) with the third face (203); cartridge-side terminals (400) provided on the corner section (265), the cartridge-side terminals (400) being arranged to receive an external force of pressing up the cartridge (20) from device-side terminals (700) of the printing device (50) in an attached state of the cartridge (20) to the printing device (50); and a first cartridge-side restriction element (210) provided on the third face (203) and arranged to be locked by a lever (80) of the printing device (50) in the attached state and thereby restrict motion of the cartridge (20) in a press-up direction, wherein the first cartridge-side restriction element (210) is located closer to the other side (290) than the one side (291).

Third Variation

A cartridge (20) detachably attached to a printing device (50) comprises a first face (201) arranged to form an outer surface of the cartridge, the first face (201) having an ink supply structure (280) to be connected with the printing device; a second face (202) opposed to the first face (201); a third face (203) arranged to have one side (291) that is connected with the second face (202) and the other side (290) that is opposite to the one side (291) and is located between the first face (201) and the second face (202) with respect to an opposed direction (Z-axis direction), along which the first face (201) and the second face (202) are opposed to each other; a fourth face (204) opposed to the third face (203), the fourth face (204) being arranged to connect with the first face (201) and the second face (202); a corner section (265) arranged to form an outer surface (265) of connecting the first face (201) with the third face (203); cartridge-side terminals (400) provided on the corner section (265), the cartridge-side terminals (400) being arranged to receive an external force of pressing up the cartridge (20) from device-side terminals (700) of the printing device (50) in an attached state of the cartridge (20) to the printing device (50); and a first cartridge-side restriction element (210) provided on the third face (203) and arranged to be locked by a lever (80) of the printing device (50) in the attached state and thereby restrict motion of the cartridge (20) in a press-up direction, wherein the first cartridge-side restriction element (210) is provided at a position close to the other side (290).

Like the first embodiment described above, any of the first to the third variations advantageously prevents positional misalignment of the cartridge-side terminals relative to the printing device and thereby ensures stable electrical connection between the cartridge-side terminals and the device-side terminals. In any of the first to the third variations, when the direction from the first face side to the second face side in the opposed direction (Z-axis direction) in the attached state is the +Z-axis direction and the direction from the second face side to the first face side is the −Z-axis direction, the first cartridge-side restriction element is preferably located on the −Z-axis direction side of the axis of rotation of the lever.

Fourth Variation

A cartridge (20) detachably attached to a printing device (50) comprises an ink supply structure (280) that is connected with the printing device; cartridge-side terminals (400) arranged to receive an external force of pressing up the cartridge (20) from device-side terminals (700) of the printing device (50) in an attached state of the cartridge (20) to the printing device (50); and a first cartridge-side restriction element (210) located on an identical side with the cartridge-side terminals (400) and arranged to be locked by a lever (80) of the printing device (50) in the attached state and thereby restrict motion of the cartridge (20) in a press-up direction, wherein the first cartridge-side restriction element (210) is located close to the cartridge-side terminals (700).

When the press-up direction is the +Z-axis direction and the opposite direction to the press-up direction is the −Z-axis direction, the first cartridge-side restriction element is preferably located on the −Z-axis direction side of the axis of rotation of the lever.

Like the first embodiment described above, the fourth variation advantageously prevents positional misalignment of the cartridge-side terminals relative to the printing device and thereby ensures stable electrical connection between the cartridge-side terminals and the device-side terminals.

G-6. Sixth Modification

The invention may be accomplished by the following variations. The symbols in parentheses after the elements in each of the variations correspond to the symbols of the respective elements described in the first embodiment.

First Variation

A cartridge (20) detachably attached to a printing device (50) comprises: a first face (201) arranged to form an outer surface of the cartridge, the first face (210) having a printing material supply port (280) that is connected with the printing device; a second face (202) opposed to the first face (201); a third face (203) arranged to have one side (291) that is connected with the second face (202) and the other side (290) that is opposite to the one side (291), the third face (203) being located between the first face (201) and the second face (202) with respect to an opposed direction (Z-axis direction), the opposed direction being a direction along which the first face (201) and the second face (202) are opposed to each other; a fourth face (204) opposed to the third face (203), the fourth face (204) being arranged to intersect the first face (201) and the second face (202); a fifth face (205) arranged to intersect the first face (201), the second face (202), the third face (203) and the fourth face (204); a sixth face (206) opposed to the fifth face (205); a corner section (265) arranged to form an outer surface (265) of connecting the first face (201) with the third face (203); cartridge-side terminals (400) provided on the corner section (265), the cartridge-side terminals (400) being arranged to receive an external force of pressing up the cartridge (20) from device-side terminals (700) of the printing device (50) in an attached state of the cartridge (20) to the printing device (50); and a first cartridge-side restriction element (210) provided on the third face (203) and arranged to be locked by a lever (80) of the printing device (50) in the attached state and thereby restrict motion of the cartridge (20) in a press-up direction, wherein with respect to the opposed direction of the fifth face (205) and the sixth face (206) (Y-axis direction), the first cartridge-side restriction element (210) is located not outside but inside a range (40Y) where the cartridge-side terminals (400) are provided.

Second Variation

A cartridge (20) detachably attached to a printing device (50) comprises: a printing material supply port (280) that is connected with the printing device; cartridge-side terminals (400) provided on an outer surface of the cartridge (20), the cartridge-side terminals (400) being arranged to receive an external force of pressing up the cartridge (20) from device-side terminals (700) of the printing device (50) in an attached state of the cartridge (20) to the printing device (50); and a first cartridge-side restriction element (211) provided on the same side of the outer surface as that with the cartridge-side terminals (400), the first cartridge-side restriction element (211) being arranged to be locked by a lever (80) of the printing device (50) in the attached state to restrict motion of the cartridge (20) in a press-up direction (+Z-axis direction), wherein with respect to a width direction of the cartridge, the first cartridge-restriction element (211) is located not outside but inside a range (40Y) where the cartridge-side terminals (400) are provided. According to the first or the second variation, the cartridge-side terminals receive the force in the press-up direction from the device-side terminals. This enables fine adjustment of the direction of the part where the cartridge-side terminals are provided and ensures stable electrical connection between the cartridge-side terminals and the device-side terminals. According to the first or the second variation, it is preferable that the first cartridge-side restriction element is located below the axis of rotation of the lever. The term "below" herein corresponds to, for example, −Z-axis direction or a reverse direction to the press-up direction.

Some of the benefits of the different embodiments will now be discussed. Terminals must be precisely positioned and stably fixed while the ink cartridge is mounted in the printer, in order to ensure reliable electrical communication between the cartridge and the printer. Because the engagement portion of the first restriction portion is located adjacent to the terminal bearing structure, positioning action of the first restriction portion occurs close to where positioning is most needed (i.e., the terminals of the terminal bearing structure). The elastic force from the printer-side terminals can be properly counteracted against. Also, positional shift of the terminals, which can occur due to vibration during printing operations, can be suppressed. Therefore, positioning of the terminals is more stable, thus maintaining the stable electrical connection between the cartridge-side terminals and the device-side terminals.

Moreover, because the lever is not made integral with the cartridge, the material for producing the cartridge can be different from the material used for producing the lever. Also, the material of the cartridge can be selected with less concern for flexibility and durability requirements, and with greater focus on other properties such as resistance to ink.

Additionally, because the lever is not on the cartridge, no special care is needed to prevent creep deformation of the lever in packaging of the cartridge for transportation and distribution. This simplifies packaging requirements and improves the user's convenience. Because the lever is not an integral part of the cartridge, the cartridge can be made smaller. This further allows size reduction of the packaging material, such as paper or box, used to package the cartridge for transportation or distribution of the cartridge, thus advantageously reducing transportation and parts costs. Also because the lever is not integral with the cartridge, the first cartridge-side restriction element can be made with a small size and simple structure, and with higher rigidity, compared with the structures described in U.S. Publication No. 2005/0151811, for example. This results in significantly reducing the possibility of plastic deformation of the first cartridge-side restriction element. In the attached or mounted state, the cartridge can be kept at the proper position in the cartridge mounting structure, which maintains normal or good contact between the cartridge-side terminals and the printer-side terminals and reduces the possibility of poor electrical communication. Since the first cartridge-side restriction element can have a small size and simple structure, no special care to prevent creep deformation of the lever is required in packaging for transportation and distribution of the cartridge, unlike the cartridges of U.S. Publication No. 2005/0151811. This reduces packaging requirements and also improves the user's convenience.

It is possible for the structure that connects the cartridge terminal structure and the cartridge's engagement portion to each other, to be only rigid structure (which is not the case with the flexible levers of U.S. Publication No. 2005/0151811). In this case, less vibration is transmitted from the engagement portion to the cartridge terminals, so electrical communication is more stable.

Because the terminal plane and/or the contact portion plane of the terminals is neither parallel nor perpendicular to the plane (BP) defined by the leading edge (288), the surface of the cartridge terminals can be properly wiped during insertion of the cartridge into the printer. In addition, this configuration reduces or eliminates insulation fragments (dust) that can be generated if the printer terminals scrape for long distances against the circuit board during installation of the cartridge.

Because the printer terminals apply, against the cartridge terminals, an elastic force which includes a vector component in the direction in which the cartridge is detached from the printer, there is no need to provide a spring like the spring 103 described in U.S. Pat. No. 6,955,422. In other words, the elastic force from the printer side terminals serves to both press the printer side and cartridge side terminals together, and also to move the cartridge in the direction for removal from the printer when engagement between the first restriction portion and the printer lever is released. So there is no need to provide an additional spring as in the case of the U.S. Pat. No. 6,955,422, which enables a simpler structure and reduced costs.

Because the first restriction portion is adapted to engage with the engagement portion of the lever so as to restrict movement of the cartridge in the direction opposite to the mounting direction, as a result, the position of the cartridge terminals will be maintained in place with respect to the mounting direction by the elastic force of the apparatus-side contact forming members, and with respect to the direction opposite to the mounting direction by the first restriction portion, when the cartridge is mounted in the printer. Since the cartridge terminals are "sandwiched" in this way, they are firmly fixed from moving in both the mounting direction and the direction opposite from the mounting direction. There is thus less likelihood of misalignment or disconnection between the cartridge terminals and the apparatus-side contact forming members, compared with the one-sided restriction by the elastic piece 40 and related configuration of U.S. Pat. No. 7,008,053.

When the ink supply system supplies ink to the printing apparatus, if held too securely, then contact with some of the apparatus-side contact forming members (terminal 734 in FIG. 31 for example), might not be secure. By locating the engagement portion of the first restriction portion to the left of a right edge of a rightmost terminal of the plurality of terminals and to the right of a left edge of the leftmost terminal of the plurality of terminals the ink cartridge can tilt sufficiently so that the electrical connection between the plurality of terminals and the apparatus-side contact forming members can be even more stable.

When the engagement portion of the second restriction portion is located farther from the plane defined by the leading edge than is the engagement portion of the first restriction portion, the possibility that the first side restriction portion will become disengaged from the printer engagement portion can be more effectively reduced, compared with the case when the engagement portion of the first restriction portion is farther from the plane defined by the leading edge than is the engagement portion of the second restriction portion from the plane defined by the leading edge.

When the distance between the engagement portion of the first restriction portion and the plane defined by the leading edge is less than the distance between a pivot point of the lever and the plane defined by the leading edge when the ink supply system supplies ink to the printing apparatus, the lever serves to restrict motion. This reduces the possibility of the first restriction portion becoming unlocked or disengaged from the engagement portion of the lever, thus creating a stable electrical connection between the plurality of terminals and the contact forming members and reducing the possibility of poor continuity. The first restriction portion can move about the axis of rotation of the lever when force is applied from the contact forming members. This reduces the possibility that the engagement portion of the first restriction portion becomes uncoupled from the engagement portion of the lever.

When the ink supply system supplies ink to the printing apparatus and the engagement portion of the first restriction portion is to the left of a pivot point of the lever and the engagement portion of the first restriction portion to the right and the ink supply structure facing down, the first restriction portion generates rotational moment on the lever to turn the lever about the axis of rotation of the lever in the reverse direction to the unlocking direction. This reduces the possibility that the engagement portion of the first restriction portion is unlocked from the engagement portion of the lever and further ensures the stable electrical connection between the plurality of terminals and the apparatus side contact forming members. Further, the possibility that the engagement portion of the first restriction portion becoming unlocked from the engagement portion of the lever is reduced.

By providing the first restriction portion in such a position so that at least a portion of the engagement portion of the first restriction portion is located substantially at the widthwise center of the body, the first restriction portion is located extremely near to the plurality of terminals so that the electrical connection between the plurality of terminals and the apparatus side contact forming members can be stable.

It should also be appreciated that the features described herein can be part of a cartridge itself, as part of a combination of a cartridge and a printing apparatus or in other words when the cartridge is installed and/or as part of a system for supplying ink or other printing material to a printing apparatus without departing from the spirit of the invention.

The matters described in the respective aspects according to any parts of the invention may be added to any of the various variations described above.

Those skilled in the art will recognize that the present invention has many applications, may be implemented in many manners and, as such is not to be limited by the foregoing embodiments and examples. Any number of the features of the different embodiments described herein may be combined into one single embodiment and alternate embodiments having fewer than or more than all of the features herein described are possible. Functionality may also be, in whole or in part, distributed among multiple components, in manners now known or to become known.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims. While there had been shown and described fundamental features of the invention as applied to being exemplary embodiments thereof, it will be understood that omissions and substitutions and changes in the form and details of the disclosed invention may be made by those skilled in the art without departing from the spirit of the invention. Moreover, the scope of the present invention covers conventionally known, future developed variations and modifications to the components described herein as would be understood by those skilled in the art. It is the intention, therefore, to be limited only as indicated by the scope of the claims appended hereto. It is also to be understood that the following claims are intended to cover all of the generic and specific features of the invention herein disclosed and all statements of the scope of the invention that, is a matter of language, might be said to fall therebetween.

What is claimed is:

1. An ink supply system for supplying ink to an ink jet printing apparatus, the ink jet printing apparatus having a lever adapted to move with respect to the printing apparatus, the lever having an engagement portion and the printing apparatus comprising a plurality of apparatus-side contact forming members, the ink supply system comprising:

an ink chamber for storing ink;

an ink supply structure, adapted and configured to supply ink from the ink chamber to the ink jet printing apparatus, the ink supply structure having a mounting direction leading edge defining a plane;

an electrical device and a terminal bearing structure having a plurality of electrically conductive terminals coupled to the electrical device, the terminals adapted and arranged on the terminal bearing structure to make contact with and receive elastic force from the contact forming members at contact portions of said terminals when the ink supply system supplies ink to the printing apparatus; and a first restriction portion including an engagement portion adapted to engage with the engagement portion of the lever so as to restrict movement of the terminal bearing structure in a direction opposite the mounting direction;

wherein the engagement portion of the first restriction portion is positioned adjacent the terminal bearing structure and the contact portions are arranged substantially in a contact portion plane which is neither parallel nor perpendicular to the plane defined by the leading edge when the ink supply system supplies ink to the printing apparatus.

2. The ink supply system of claim 1, wherein the contact portion plane is at an angle of between about 25 and 40 degrees to the plane defined by the leading edge when the ink supply system supplies ink to the printing apparatus.

3. The ink supply system of claim 1, wherein when the ink supply system supplies ink to the printing apparatus, the engagement portion of the first restriction portion is located to the left of the rightmost contact portion of the plurality of terminals and to the right of the leftmost contact portion of the plurality of terminals.

4. The ink supply system of claim 1 further comprising a body including a first surface and a second surface, the first surface and second surface opposite each other, a second restriction portion proximate to the second surface of the body, the terminal bearing structure proximate to the first surface of the body, the second restriction portion including an engagement portion adapted and configured to engage with a respective portion of the ink jet printing apparatus, wherein the distance between the engagement portion of the second restriction portion and the plane defined by the leading edge is more than the distance between the engagement portion of the first restriction portion and the plane defined by the leading edge, when the distances are measured in an orthogonal direction to the plane defined by the leading edge.

5. The ink supply system of claim 1, wherein the distance between the engagement portion of the first restriction portion and the plane defined by the leading edge is less than the distance between a pivot point of the lever and the plane defined by the leading edge when the ink supply system supplies ink to the printing apparatus, when the distances are measured in an orthogonal direction to the plane defined by the leading edge.

6. The ink supply system of claim 1, comprising an adapter wherein the ink supply structure, the terminal bearing structure and the first restriction portion are positioned on the adapter and the ink chamber is adapted and configured to be mated with the adapter.

7. The ink supply system of claim 1, comprising an adapter wherein the terminal bearing structure and the first restriction portion are positioned on the adapter, the ink supply structure is positioned on the ink chamber and the ink chamber is adapted and configured to be mated with the adapter.

8. The ink supply system of claim 1, comprising an adapter, an ink tank external from the ink jet printing apparatus, a tube and an auxiliary adapter wherein the ink supply structure is positioned on the auxiliary adapter, the terminal bearing structure and the first restriction portion are positioned on the adapter and the tube supplies ink from the external tank to the auxiliary adapter when the ink supply system supplies ink to the printing apparatus.

9. An ink supply system for supplying ink to an ink jet printing apparatus, the ink jet printing apparatus comprising a plurality of apparatus-side contact forming members, the ink jet printing apparatus also comprising a lever, the lever adapted to move with respect to the printing apparatus and having an engagement portion, the ink supply system comprising:

an ink chamber for storing ink;

an ink supply structure, adapted and configured to supply ink from the ink chamber to the ink jet printing apparatus, the ink supply structure having a mounting direction leading edge defining a plane;

an electrical device and a terminal bearing structure having a plurality of electrically conductive terminals coupled to the electrical device, the terminals adapted and arranged on the terminal bearing structure to make contact with and receive elastic force from the contact forming members when the ink supply system supplies ink to the printing apparatus; and a first restriction portion including an engagement portion adapted to engage with the engagement portion of the lever so as to restrict movement of the terminal bearing structure in a direction opposite the mounting direction;

wherein the engagement portion of the first restriction portion is positioned adjacent the terminal bearing structure and the terminals are arranged substantially in a terminal plane which is neither parallel nor perpendicular to the plane defined by the leading edge when the ink supply system supplies ink to the printing apparatus.

10. The ink supply system of claim 9, wherein the terminal plane is at an angle of between about 25 and 40 degrees to the plane defined by the leading edge when the ink supply system supplies ink to the printing apparatus.

11. The ink supply system of claim 9 further comprising a body including a front and a rear, the front and rear opposite each other, a second restriction portion proximate to the rear of the body, the terminal bearing structure proximate to the front of the body, the second restriction portion including an engagement portion adapted and configured to engage with a respective portion of the ink jet printing apparatus, wherein the distance between the engagement portion of the second restriction portion and the plane defined by the leading edge is more than the distance between the engagement portion of the first restriction portion and the plane defined by the leading edge, when the distances are measured in an orthogonal direction to the plane defined by the leading edge.

12. The ink supply system of claim 9, wherein when the ink supply system supplies ink to the printing apparatus the engagement portion of the first restriction portion is on the right and the ink supply structure is facing down, the engagement portion of the first restriction portion is to the left of a pivot point of the lever.

13. The ink supply system of claim 9, comprising an adapter wherein the ink supply structure, the terminal bearing structure and the first restriction portion are positioned on the adapter and the ink chamber is adapted and configured to be mated with the adapter.

14. The ink supply system of claim 9, comprising an adapter wherein the terminal bearing structure and the first restriction portion are positioned on the adapter, the ink supply structure is positioned on the ink chamber and the ink chamber is adapted and configured to be mated with the adapter.

15. The ink supply system of claim 9, comprising an adapter, an ink tank external from the ink jet printing apparatus, a tube and an auxiliary adapter wherein the ink supply structure is positioned on the auxiliary adapter, the terminal bearing structure and the first restriction portion are positioned on the adapter and the tube supplies ink from the external tank to the auxiliary adapter when the ink supply system supplies ink to the printing apparatus.

16. An ink supply system for supplying ink to a portion of an ink jet printing apparatus, the system comprising:

a portion of an ink jet printing apparatus, the portion comprising:

a plurality of apparatus-side contact forming members; and a lever adapted to move with respect to the printing apparatus, the lever having an engagement portion;

an ink chamber for storing ink;

an ink supply structure, adapted and configured to supply ink from the ink chamber to the ink jet printing apparatus, the ink supply structure having a mounting direction leading edge defining a plane;

an electrical device and a terminal bearing structure having a plurality of terminals coupled to the electrical device, the terminals contacting and receiving elastic force from the contact forming members at contact portions of said terminals when the ink supply system supplies ink to the printing apparatus; and a first restriction portion including an engagement portion engaged with the engagement portion of the lever so as to restrict movement of the terminal bearing structure in a direction opposite the mounting direction;

wherein the engagement portion of the first restriction portion is positioned adjacent the terminal bearing structure and the contact portions are arranged substantially in a contact portion plane which is neither parallel nor perpendicular to the plane defined by the leading edge when the ink supply system supplies ink to the printing apparatus.

17. The ink supply system of claim 16, wherein the contact portion plane is at an angle of between about 25 and 40 degrees to the plane defined by the leading edge when the ink supply system supplies ink to the printing apparatus.

18. The ink supply system of claim 16 further comprising a body including a front and a rear, the front and rear opposite each other a projection located on the ink supply structure at a position confronting an operating member on the lever;

a holder on the portion of the ink jet printing apparatus, the holder receiving the ink supply structure and comprising a unitized terminal base on which the apparatus-side contact forming members are located;

a retainer on the portion of the printing apparatus, the retainer supporting the lever, the retainer comprising an elastic member that limits the rotatable range of the lever; and a shaft portion of the lever having an inner arc-shaped surface and an outer arc-shaped surface on opposing sides of the shaft body, wherein the inner arc shaped surface is positioned closer to the body than the outer arc-shaped surface;

wherein the first restriction portion includes a second engagement portion that extends vertically relative to the orientation of the first restriction portion, and the lever includes a groove receiving the second engagement portion of the first restriction portion, and wherein the lever is adapted to pivot relative to the shaft body, the centers of the inner arc-shaped surface and the outer arc-shaped surface correspond to the axes of rotation of the lever and the radius of curvature of the inner arc-shaped surface has a smaller radius than the radius of curvature of the outer arc-shaped surface.

19. The ink supply system of claim 16, wherein the lever has two ends and a pivot point intermediate the two ends and wherein when the ink supply system supplies ink to the printing apparatus, the engagement portion of the first restriction portion is on the right and the ink supply structure is facing down, the engagement portion of the first restriction portion is to the left of the pivot point of the lever.

20. The ink supply system of claim 16, comprising an adapter wherein the ink supply structure, the terminal bearing structure and the first restriction portion are positioned on the adapter and the ink chamber is adapted and configured to be mated with the adapter.

21. The ink supply system of claim 16, comprising an adapter wherein the terminal bearing structure and the first restriction portion are positioned on the adapter, the ink supply structure is positioned on the ink chamber and the ink chamber is adapted and configured to be mated with the adapter.

22. The ink supply system of claim 16, comprising an adapter, an ink tank external from the ink jet printing apparatus, a tube and an auxiliary adapter wherein the ink supply structure is positioned on the auxiliary adapter, the terminal bearing structure and the first restriction portion are positioned on the adapter and the tube supplies ink from the external tank to the auxiliary adapter when the ink supply system supplies ink to the printing apparatus.

23. An ink supply system for supplying ink to a portion of an ink jet printing apparatus, the system comprising:

a portion of an ink jet printing apparatus, the portion comprising:

a plurality of apparatus-side contact forming members; and a lever on the printing apparatus adapted to move with respect to the printing apparatus, the lever having an engagement portion;

an ink chamber for storing ink;

an ink supply structure, adapted and configured to supply ink from the ink chamber to the ink jet printing apparatus, the ink supply structure having a mounting direction leading edge defining a plane;

an electrical device and a terminal bearing structure having a plurality of electrically conductive terminals coupled to the electrical device, the terminals contacting and receiving elastic force from the contact forming members when the ink supply system supplies ink to the printing apparatus; and a first restriction portion including an engagement portion engaged with the engagement portion of the lever so as to restrict movement of the terminal bearing structure in a direction opposite the mounting direction;

wherein the engagement portion of the first restriction portion is positioned adjacent the terminal bearing structure and the terminals are arranged substantially in a terminal plane which is neither parallel nor perpendicular to the plane defined by the leading edge when the ink supply system supplies ink to the printing apparatus.

24. The ink supply system of claim 23, wherein the terminal plane is at an angle of between about 25 and 40 degrees to the plane defined by the leading edge when the ink supply system supplies ink to the printing apparatus.

25. The ink supply system of claim 23, wherein when the ink supply system supplies ink to the printing apparatus, the engagement portion of the first restriction portion is located to the left of a right edge of a rightmost terminal of the plurality of terminals and to the right of a left edge of a leftmost terminal of the plurality of terminals.

26. The ink supply system of claim 23 further comprising a body including a first surface and a second surface, the first surface and second surface opposite each other, a second restriction portion proximate to the second surface of the body, the terminal bearing structure proximate to the first surface of the body, the second restriction portion including an engagement portion engaged with a respective portion of the ink jet printing apparatus, wherein the distance between the engagement portion of the second restriction portion and the plane defined by the leading edge is more than the distance between the engagement portion of the first restriction portion and the plane defined by the leading edge, when the distances are measured in an orthogonal direction to the plane defined by the leading edge.

27. The ink supply system of claim 23, wherein the lever has two ends and a pivot point intermediate the two ends and wherein the distance between the engagement portion of the first restriction portion and the plane defined by the leading edge is less than the distance between the pivot point of the lever and the plane defined by the leading edge when the ink supply system supplies ink to the printing apparatus, when the distances are measured in an orthogonal direction to the plane defined by the leading edge.

28. The ink supply system of claim 23, comprising an adapter wherein the ink supply structure, the terminal bearing structure and the first restriction portion are positioned on the adapter and the ink chamber is adapted and configured to be mated with the adapter.

29. The ink supply system of claim 23, comprising an adapter wherein the terminal bearing structure and the first restriction portion are positioned on the adapter, the ink supply structure is positioned on the ink chamber and the ink chamber is adapted and configured to be mated with the adapter.

30. The ink supply system of claim 23, comprising an adapter, an ink tank external from the ink jet printing apparatus, a tube and an auxiliary adapter wherein the ink supply structure is positioned on the auxiliary adapter, the terminal bearing structure and the first restriction portion are positioned on the adapter and the tube supplies ink from the external tank to the auxiliary adapter when the ink supply system supplies ink to the printing apparatus.

* * * * *